US008360948B1

(12) United States Patent
Sjostedt et al.

(10) Patent No.: US 8,360,948 B1
(45) **Date of Patent: *Jan. 29, 2013**

(54) SYSTEM AND METHOD FOR FOLDING AND HANDLING STACKS OF CONTINUOUS WEB

(75) Inventors: Richard Sjostedt, Ashland, MA (US); Steven P. Lewalski, Melrose, MA (US); Bruce J. Taylor, Manchester, NH (US); John M. Fiske, Winchester, MA (US)

(73) Assignee: Lasermax Roll Systems, Inc., Burlington, MA (US)

( * ) Notice: Subject to any disclaimer, the term of this patent is extended or adjusted under 35 U.S.C. 154(b) by 347 days.

This patent is subject to a terminal disclaimer.

(21) Appl. No.: 12/754,256

(22) Filed: Apr. 5, 2010

Related U.S. Application Data

(60) Continuation of application No. 12/176,952, filed on Jul. 21, 2008, now Pat. No. 7,690,882, which is a division of application No. 11/541,120, filed on Sep. 29, 2006, now Pat. No. 7,402,130.

(51) Int. Cl.
*B31F 1/08* (2006.01)

(52) U.S. Cl. ..... 493/411; 493/356; 493/448

(58) Field of Classification Search ..... 493/411–415, 493/356, 357, 448; 270/5.01, 32, 39.01, 270/39.02, 39.05, 40
See application file for complete search history.

(56) References Cited

U.S. PATENT DOCUMENTS

| | | | | |
|---|---|---|---|---|
| 4,846,454 | A | 7/1989 | Parkander | |
| 5,062,597 | A | 11/1991 | Martin et al. | |
| 5,064,179 | A | 11/1991 | Martin | |
| 5,156,350 | A | 10/1992 | Wales et al. | |
| 5,360,213 | A | 11/1994 | Crowley et al. | |
| 5,383,130 | A | 1/1995 | Kalisiak | |
| 5,558,318 | A | 9/1996 | Crowley et al. | |
| 5,701,717 | A | 12/1997 | Gutknecht | |
| 5,820,539 | A | 10/1998 | Strahm | |
| 5,979,732 | A | 11/1999 | Crowley et al. | |
| 6,120,043 | A | 9/2000 | Crowley et al. | |
| 6,321,512 | B1 * | 11/2001 | O'Connor et al. | 53/429 |
| 6,511,408 | B2 * | 1/2003 | Miki et al. | 493/413 |
| 6,729,471 | B2 * | 5/2004 | O'Connor et al. | 206/494 |
| 6,949,060 | B2 | 9/2005 | Lenk | |

* cited by examiner

*Primary Examiner* — Hemant M Desai
(74) *Attorney, Agent, or Firm* — William A. Loginov; Loginov & Associates, PLLC

(57) ABSTRACT

This invention provides a system and method for separating, folding, stacking and transporting a continuous web that allows stacks of web that are relatively large (four-feet-high or more) to be generated at high speed directly beneath the folding mechanism and to be transferred as complete, discrete stacks to downstream locations and stack utilization devices without interrupting the ongoing, upstream stack-folding and stack-formation process. A zigzag folded web passes by a pair of opposing front and rear compression plate assemblies, with fingers that are extended to selectively project into the folding area, onto a stack supported by a vertically moving supporting mechanism. The supporting mechanism cycles between an ever-lower position in which upper, loose pages of the folded web pass by plate fingers (when retracted) and an upper position in which the stack engages and presses upwardly against the now-extended plate fingers to compress the stack. After the web is separated above the chute, the supporting mechanism eventually travels to the base where the now-completed stack is conveyed to a downstream location. While the supporting mechanism is occupied transferring the completed, old stack, new folded web is deposited on a deployed temporary support that allows a new stack to form thereon until the supporting mechanism has completed the transfer of the old stack, and is ready to receive the new stack from the temporary support.

26 Claims, 44 Drawing Sheets

SYSTEM AND METHOD FOR FOLDING AND HANDLING STACKS OF CONTINUOUS WEB

RELATED APPLICATIONS

This application is a continuation of U.S. patent application Ser. No. 12/176,952, filed Jul. 21, 2008, entitled SYSTEM AND METHOD FOR FOLDING AND HANDLING STACKS OF CONTINUOUS WEB, which is a divisional of U.S. patent application Ser. No. 11/541,120, entitled SYSTEM AND METHOD FOR FOLDING AND HANDLING STACKS OF CONTINUOUS WEB, now U.S. Pat. No. 7,402,130, the entire disclosure of each of which is herein incorporated by reference.

BACKGROUND OF THE INVENTION

1. Field of the Invention

This invention relates to folders and more particularly to systems and methods for folding continuous web into one or more stacks in large volume and at high speed.

2. Background Information

In high-speed, large-volume printing operations, such as those employed in bulk-mailing activities and print-on-demand applications, it is quite common to use a continuous web that contains printing and other enhancements. This web is transferred through a variety of operations within the overall printing system. A printed web may be fed initially to downstream web utilization devices (such as printers, embossers, cutters and folders) using a driven roll stand that pays out web from a source roll as the web is drawn by the downstream devices. The web may, at various time in the process be draw up onto a take-up roll for refeeding to a further downstream web-utilization process. At some stage in the process it may be desirable to maintain the web in continuous form, but render it into one or more stacks of folded continuous web. Typically, web is folded into a stack in a "zigzag" fashion in which individual, substantially equal-length sections or pages are folded atop one another. Often, the web includes widthwise perforations, crease lines or other stress-relief points that facilitate folding by a set of folder beater units along the desired fold lines. These can be applied by a web manufacturer and exist in the web of the original source roll, or can be added by a particular utilization device in the system. A prior art folder is shown and described in U.S. Pat. No. 5,558,318, entitled SEPARATOR FOR FORMING DISCRETE STACKS OF FOLDED WEB, by H. W. Crowley, et al., the teachings of which are expressly incorporated herein by reference. This folder is designed to create short discrete stacks that are drawn away by a conveyor belt, or a continuous flow ("waterfall") of folded web that must be collected into a larger-height stack at a location remote from the conveyor.

When a folder completes a stack of web, based either on completing a particular job, or reaching a maximum stack height, the upstream end of the folded web stack is typically separated from the downstream folded stack by a cutter unit and the stack is driven away from the folder before a new stack can be formed. Often, the process of vacating the existing stack is cumbersome, as a large completed stack may weigh several hundred pounds and extend over four feet high. Various devices and conveyances for handling such large stacks are taught in U.S. Pat. No. 6,120,043, entitled METHOD AND APPARATUS FOR BUSINESS FORMS PROCESSING, by H. W. Crowley, et al., the teachings of which are expressly incorporated herein by references. This reference relates to the receipt of a waterfall of folded continuous web onto a tilting table from a folder (such as the folder referenced above) and forming a stack on the table, which is subsequently transferred to various carts and dollies for later processing and/or use. As is clear by the description of the reference, the formation and handling of large stacks of folded web typically entails many stack formation and handling components and fairly involved handling processes that (while being simple and reliable) may entail interruptions in the process streams while downstream stack handling is accomplished.

SUMMARY OF THE INVENTION

This invention overcomes the disadvantages of the prior art by providing a system and method for separating, folding, stacking and transporting a continuous web that allows stacks of web that are relatively large (three-feet-high or more) to be generated at high speed directly beneath the folding mechanism and to be transferred as complete, discrete stacks to downstream locations and stack utilization devices without interrupting the ongoing, upstream stack-folding and stack-formation process.

In one embodiment, a device that separates and continuously folds and stacks continuous web includes a swinging chute that delivers web to a set of beaters and spirals for zigzag folding. The zigzag folded web is deposited into a folding area defined by a set of front, rear and side stack guides. The zigzag folded web passes by a pair of opposing front and rear compression plate assemblies, with fingers that are extended to selectively project into the folding area, onto a stack supported by a vertically moving supporting mechanism. The supporting mechanism cycles between an ever-lower position in which upper, loose pages of the folded web pass by plate fingers (when retracted) and an upper position in which the stack engages and presses upwardly against the now-extended plate fingers to compress the stack. The plate fingers can be spring-loaded to absorb some of the pressure from the compressed stack and to allow upward deflection to signal a maximum rise limit for the supporting mechanism. In this manner the growing stack maintains a tight geometric formation through frequent compression cycles as new material is added to the stack top. After the web is separated above the chute, the supporting mechanism eventually travels to the base where the now-completed stack is conveyed to a downstream location. While the supporting mechanism is occupied transferring the completed, old stack, new folded web is deposited on a deployed temporary support that allows a new stack to form thereon until the supporting mechanism has completed the transfer of the old stack, and is ready to receive the new stack from the temporary support.

In an illustrative embodiment, the temporary support and plates are adapted to move gradually downwardly away from the chute, spirals and beaters so as to increase the possible height of the new stack until the supporting mechanism can return to its upper location beneath the folding area. The base can include a location for docking a cart that is adapted to receive the stack from the supporting mechanism. The supporting mechanism can, thus, include conveyors for moving the stack toward the cart and a retractable, transport conveyor can be provided to the base to bridge the gap between the cart and the supporting mechanism. A series of narrow belts on the transport conveyor allow it to rise up between gaps ribs that compose the supporting surface of the cart.

In a further embodiment, a stack inverter receives carts containing stacks that are deposited thereon by the device. Each stack-containing cart is rolled into a bracket assembly at the bottom of a pivoting framework on the inverter. A second cart is positioned at the top of the framework in an inverted orientation with wheels facing upwardly. A second bracket assembly removably secures the second, inverted cart. The second cart is previously installed in the upper bracket assembly while the upper brackets are at the top of the framework. The upper and lower bracket assemblies slide along the framework toward and away from each other, being attached to the opposite sides of a moving, motorized lifter chain. The brackets move evenly with respect to a pivot that interconnects to the frame base. After the cart with a stack is mounted in the bracket assembly, the brackets are moved toward each other by the lifter chain. This raises the lower cart up over the floor surface and also lowers the upper cart. The top of the stack is engaged by the upper, inverted cart surface. When a sufficient pressure is attained between the carts and the now-compressed stack, the user grasps a handle and rotates the framework about the pivot. Since the carts and stack are balanced about the pivot, rotation is relatively effortless. A braking motor is provided in operative connection with the pivot to resist excessive rotation at speed. When the framework is inverted by 180 degrees, the upper cart is now in the lower position, and vice versa. The brackets are then moved away from each other until the new lower cart and stack engage the floor. The cart is then withdrawn with an inversed stack supported thereon.

In further embodiments, a variety of in-line carts, typically having powered conveyors that can be controlled by the device, are chained together to receive a series of output stacks therealong from the device. The carts can, thus, act as a modular conveyor that transports each completed stack to a downstream location for utilization or the carts can each be loaded, in turn, with a stack. Where each cart is loaded in turn, the carts can be subsequently separated to then be moved to a utilization location.

BRIEF DESCRIPTION OF THE DRAWINGS

The invention description below refers to the accompanying drawings, of which.

DETAILED DESCRIPTION OF AN ILLUSTRATIVE EMBODIMENT

A. System Overview

Figure 1:
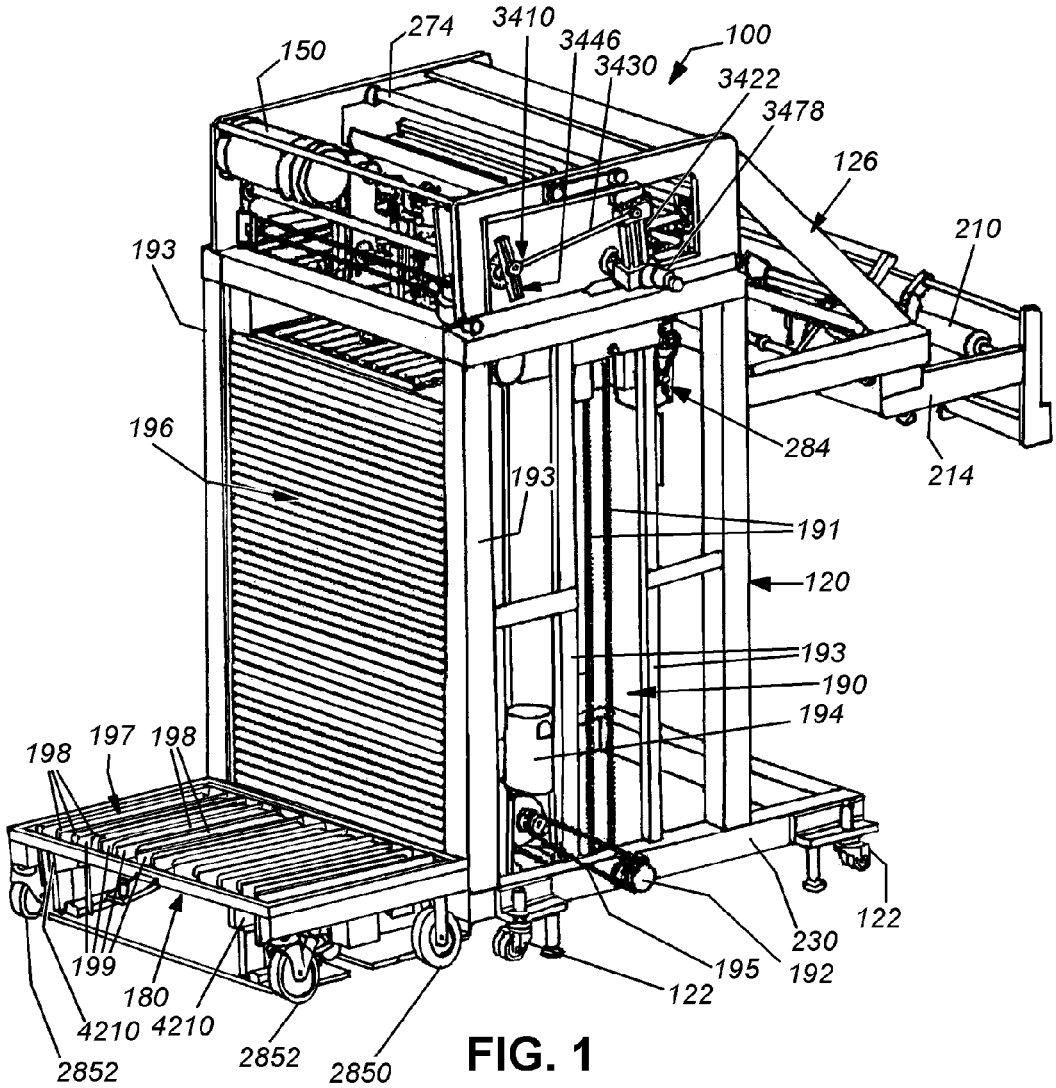
FIG. 1 is a perspective view of a device for cutting, folding and handling stacks for continuous web according to an illustrative embodiment of this invention.
Figure 2:
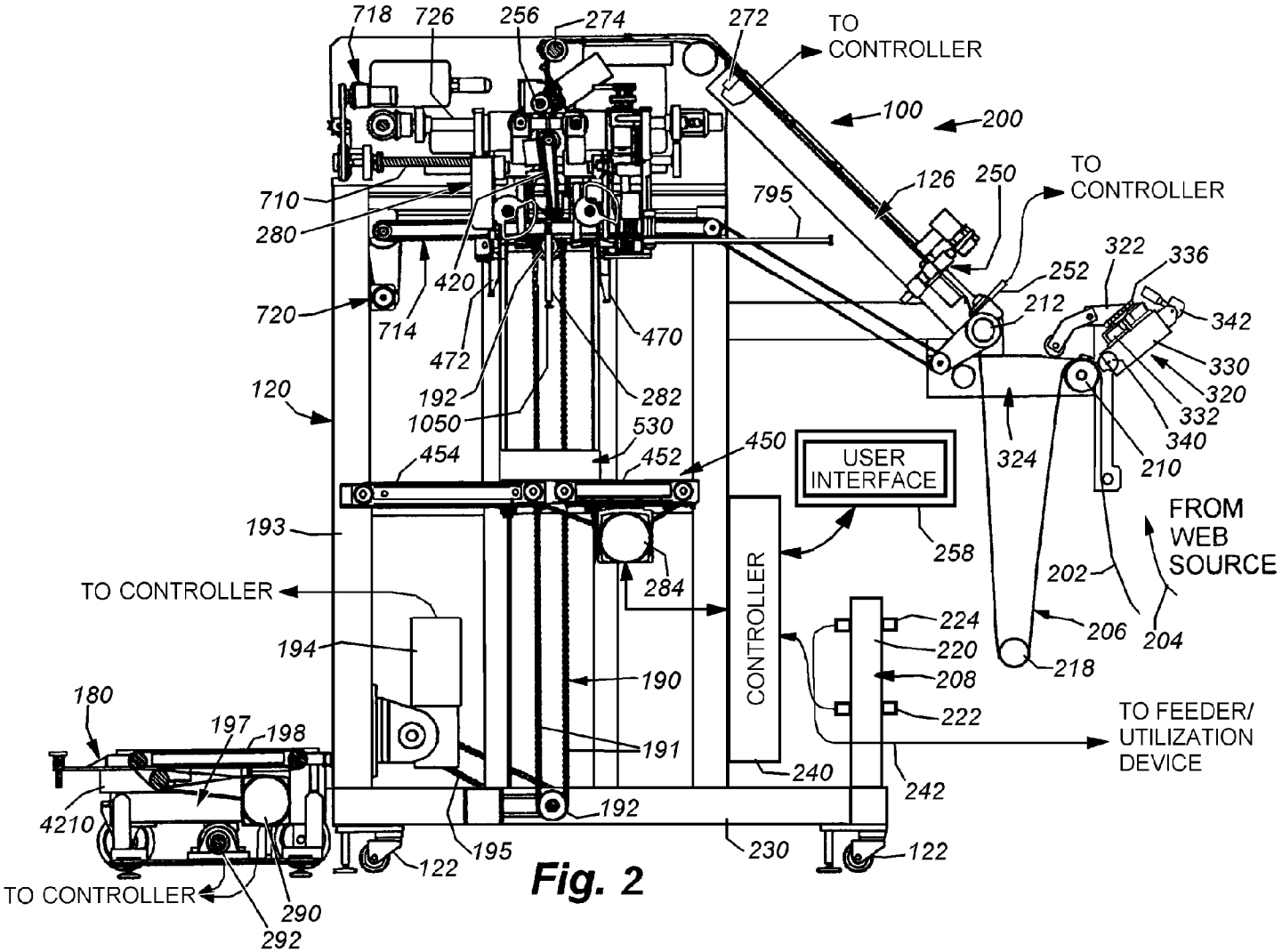
FIG. 2 is an exposed side view of the device of FIG. 1 detailing the internal components and web feed path of a continuous web.

FIGS. 1 and 2 show a device 100 for separating, folding, stacking and handling continuous web in accordance with an embodiment of this invention. The device 100 is part of an overall system 200 for handling continuous web 202 according to an exemplary embodiment of this invention. The web includes perforations, fold-creases or another stress concentration at predictable intervals that correspond to a desired form length (letter, legal, A-4, etc.) that facilitates folding in a manner described below. The system 200 transfers the perforated web, which can be paper or any other foldable and stackable ribbon of material, from a web-processing or utilization device (not shown) that may, in turn, receive continuous web from a driven source roll stand such as that shown and described in U.S. Pat. No. 5,156,350, entitled ROLL SUPPORT AND FEED APPARATUS, by H. W. Crowley, the teachings of which are expressly incorporated herein by reference. Alternatively the processing device can, itself, be a driven roll stand that supplies a printed/processed continuous web directly to the device 100. Where the processing device receives web from a downstream source, it can be one or more devices including a printer, embosser, perforator, or any other device (or combination of multiple devices) that perform desired finishing operations on the web 202 while it remains in a continuous, unseparated form.

In one embodiment, the processing device can deliver web downstream (arrow 204) based upon the draw of web using, for example, a free loop 206 that is maintained at a predetermined height/size by a loop sensor 208. The loop is maintained between a pair of roller sets 210 and 212, mounted on an integral upstream framework 214 of the device. A separate loop stand can be provided in alternate embodiments. The loop sensor 208 can be ultrasonic or optical. In this embodiment, the loop sensor 208 is an upright 220 that extends from the device frame base 230. The upright supports a pair of optical sensors 222 and 224, between which the bottom of the web loop 206 is maintained by selectively controlling feed of the roll sets 210 and 212. A controller 240 consisting of various microprocessor and state-machine circuits regulates the various functions of the device 100. The controller 240 receives signals from the sensors 222 and 224 and uses these signals to drive the roll sets 210 and 212. Alternatively (or in addition), web delivery from the source device 110 can be synchronized with the movement of downstream devices using, for example, control signals exchanged (via link 242) between the controller 240 of the device 100 and an upstream processing device. Note that the web loop 206 includes a weighted dancer roll 218 of relatively basic design to damp and/or prevent billowing as the web moves through the loop. Alternate mechanisms can be employed, such as a downward-acting fan. In addition in other embodiments, the loop may be undamped or unweighted.

Referring further to the illustrations of FIGS. 1 and 2, the separating, folding, stacking and handling device 100 includes a plurality of discrete components that perform various operations on the web 202. The components are housed within a housing or framework 120 that is portable (see wheels 122 on base 230 that engage the floor), and that can define an open construction, closed/cased construction, or a combination of open and closed construction as needed to satisfy safety and dust-control concerns. Web 202 is delivered from the upstream device and web loop 206 via a ramp assembly 126 that can include a tractor-pin feed unit (for web having pin-feed holes along its widthwise edges) as an option, and typically employs a pinless drive roller assembly 250. The pinless feed mechanism is used to drive a pinless web at a registered rate into the operative components of the device using (for example) preprinted registration marks on the web. An example of a pinless feed system is shown and described in U.S. Pat. No. 5,979,732, entitled METHOD AND APPARATUS FOR PINLESS FEEDING OF WEB TO A UTILIZATION DEVICE, by Crowley, et al., the teachings of which are expressly incorporated herein by reference. Briefly, a mark sensor 252 allows registration of printed marks, pin holes, perforations or other fiducials at predictable intervals on the web 202. A plurality of mark sensors can be provided to read marks on either side of the web, on each of opposing web sides. In one embodiment, the mark sensor employs a sensing "window" that opens at predetermined time intervals, and searches for the presence or absence of a mark within these time windows. The timing of the sensing window can be synchronized to the device's central drive motor 150, which includes an encoder that records movement. The central drive motor 150 drives all feeding and handling components via appropriate gearing and transmission units to be described further below. Depending upon the location of the mark within the sensing window, the drive roller assembly 250 (which is independently controllable via a stepper motor clutch and/or transmission) is advanced or retarded as appropriate to maintain web synchronization so that perforations are presented to the downstream cutter 256 at the correct time. As described further below, the controller 240 communicates via a user interface 258 mounted at a convenient location on or near the device. The user interface 258 in this embodiment, includes a touch screen that allows the user to monitor and control, for example, form length and width, maximum and minimum stack size, and speed of operation, among other parameters.

The ramp 126 facilitates movement of the web to a heightened position (for example over six-feet above the device base 230 in the device 100 so that it overlies the required folding and supporting components and allows formation of a requisite large-height stack within the framework 120. The ramp can include a set of weighted, low-friction straps and/or a movable cover that protects the web and maintains it flatly against the ramp surface. As will be described below, the upper, downstream end of the ramp includes a top-of-form sensor 272 that detects the leading edge of a new web during thread-up of the device and assists in facilitating proper registration.

The web 202 is driven from the ramp 126 around a curved top end into an "urge" or "tension" roller assembly 274 that can include a clutch or speed control that maintains the web 202 exiting the ramp under constant tension (based upon clutch slippage). The throughput speed of the device's infeed assembly (rollers 250 and 274), the source device, or both, is controlled to maintain the loop 206 within the desired size range. In one embodiment, the web source feeds web as it drawn by the device. To this end the source may include its own feed loop (not shown), directly upstream of the device loop 206.

For the purposes of this description, orientation of the device 100 shall be as follows: "front" and "rear," shall refer to the upstream-to-down-stream direction of web flow with the rear being the side extending transverse to the upstream-to-downstream direction and facing the infeed ramp 126 and the front side extending parallel to the rear side opposite the rear side and facing the stack removal cart 180, which is shown docked to front end of the base 230. The device's "sides" shall generally be the opposing, substantially parallel sides that extend along the upstream-to-downstream direction between the front and rear sides. "Vertical" shall be a direction generally transverse to a supporting surface for the device (e.g. the floor adjacent to the base 230) and extending upwardly therefrom and downwardly thereto. Horizontal shall be a direction generally perpendicular to vertical. The term "widthwise" shall refer to a direction extending between the sides and transverse to the upstream-to-downstream or front-to-rear direction, as appropriate. Also, the terms "up," "upward" or "top" shall refer to a vertically oriented direction and/or location extending away from the floor and base 230. Likewise, the terms "down," "downward" or "bottom" shall refer to a vertically oriented direction and/or location extending toward the floor and base 230. All directions and locations herein are provided merely as conventions, and are thus provided to assist the reader in understanding relative positioning of components within the system 200 and device 100.

From the urge/tension roller 274, the web 202 is directed downstream (arrows 133) through the cutter 256. The cutter 256 of this embodiment is a rotary cutter having a spiral-shaped blade of conventional design. It is selectively operated to separate the web 202 as described further below. Any appropriate cutter type can be employed according to alternate embodiments, and the use of a rotary cutter is exemplary only. A rotary cutter is advantageous in this embodiment in that it typically allows the web to remain in motion during the cut process, avoiding unwanted interruptions in web movement. In one example, the device and other system components are expressly adapted to operated at a high-volume and high-speed, particularly suited to an industrial or commercial application. This speed can exceed a web-throughput of 300 feet per minute.

Figure 3:
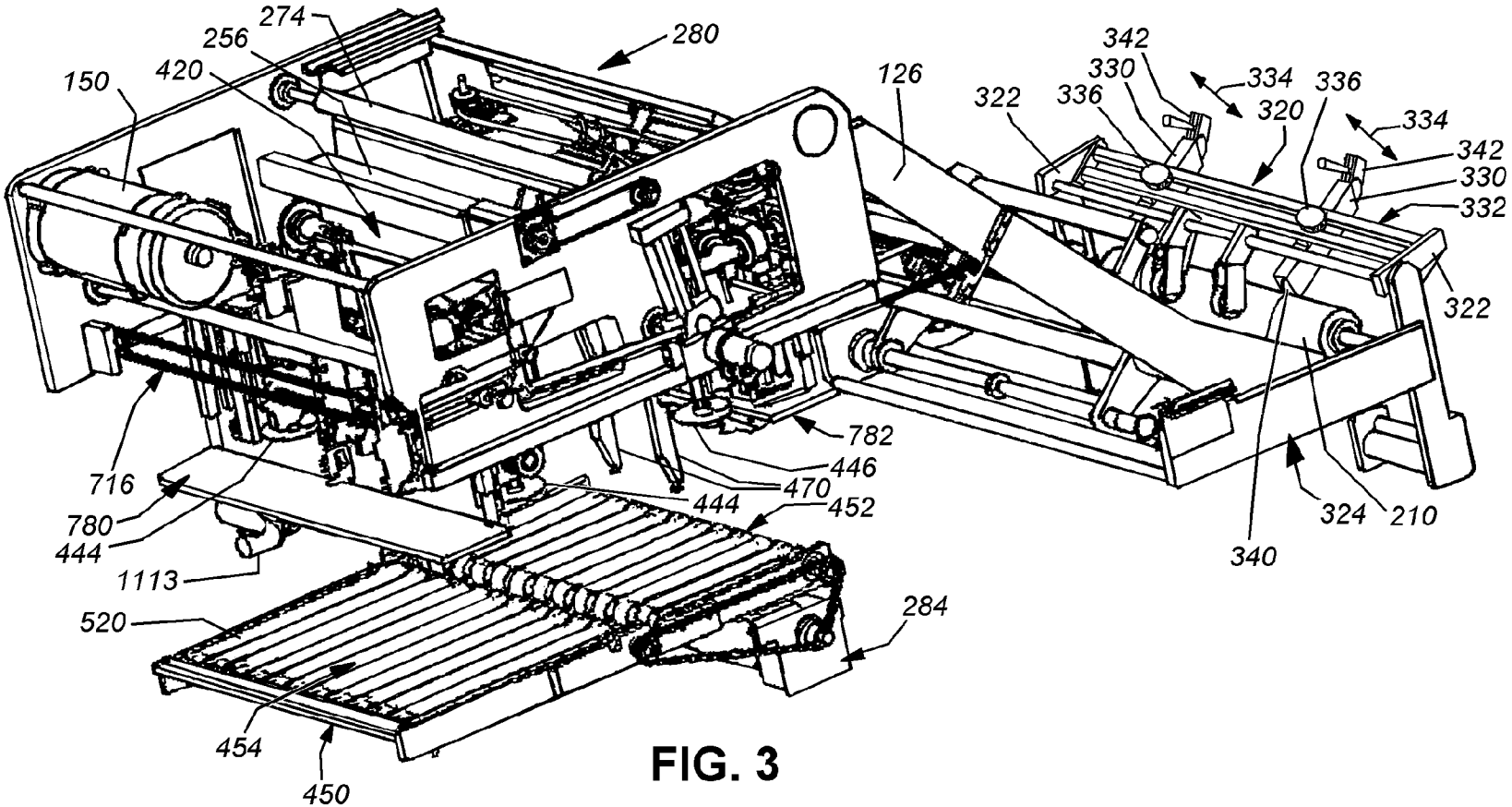
FIG. 3 is an exposed perspective view of the internal components for feeding, cutting, folding, stacking and supporting/transporting stacks of continuous webs, and for forming elongated perforations in the infeed web, of the device of FIG. 1.
Figure 3A:
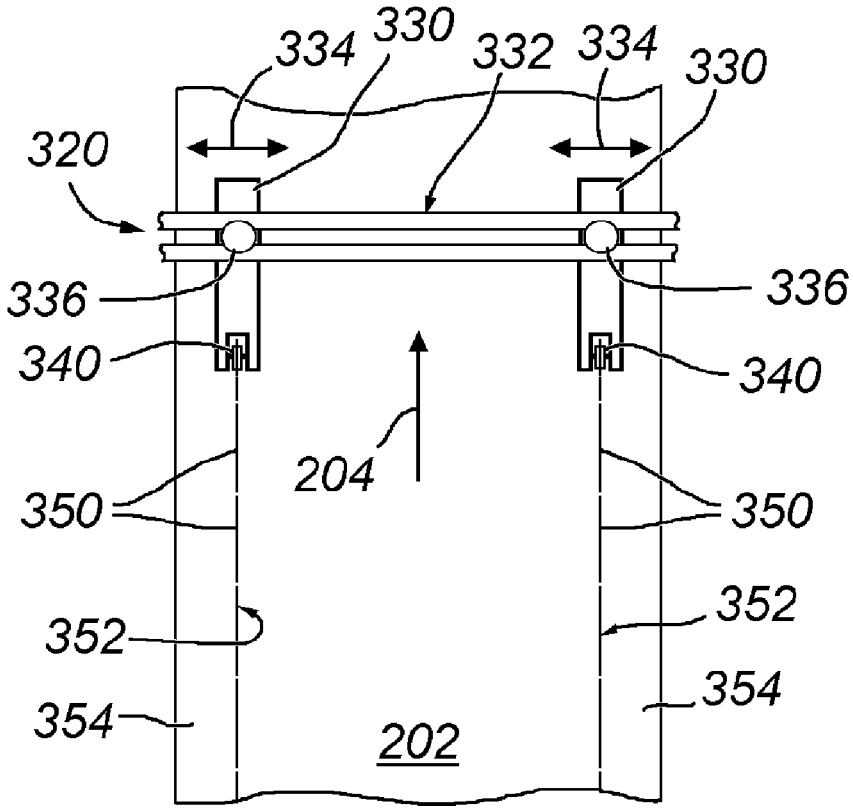
FIG. 3A is a plan view of a slitter/perforator as shown in FIG. 3 mounted adjacent to an infeed of the device of FIG. 1, forming perforations along each of opposing widthwise side edges of the web.
Figure 3B:
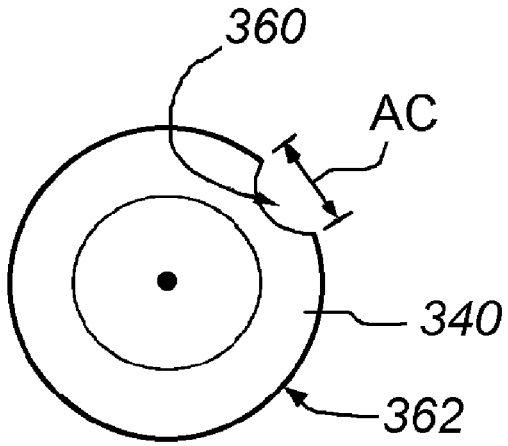
FIG. 3B is a side view of a perforator wheel for use in the slitter perforator shown in FIGS. 3 and 3A.

Downstream of the cutter 256 is positioned a folding mechanism 280. The construction and function of the folding mechanism 280 is described in substantial detail below. In general (referring as needed to the exposed views of FIGS. 3, 4 and 6), the folding mechanism 280 consists of a reciprocating/swinging pendulum or director chute 420, through which the web passes. The director chute 420 completes one swing cycle (from side-to-side) for each "page" or section length of folded web. The downstream end of the director chute 420 can include a driven roller assembly 422 to assist on driving web out of the chute, particularly after the cutter has separated the web. In addition, the downstream end of the chute can also include opposing pairs of extendible fingers 430 and 432 that are selectively actuated to move between a retracted position out of the web path and an extended position, which aids in guiding the web at the end and beginning of stack formation. The operation of the fingers 430, 432 is described in detail below.

The director chute 420 swings in conjunction with continually rotating cam-like beaters 440 and 442 of known design that crease the web along pre-arranged fold lines or lines of stress relief (such as equally spaced perforations) into the desired zigzag fold pattern. Two pairs of supporting spirals 444 and 446 of known design rotate continuously, and engage the respective front and rear edges of a zigzag folded web received from the swinging director chute 420 and beaters 440. The spirals 444, 446 rotate at a desired rate in synchronization with the director chute and beaters to transport the web folds onto the top of a forming stack 150. This synchronization is achieved by gears interconnected between these components and the central drive motor 150. The folded stack (see below) is supported generally on a supporting mechanism 450 that consists of a rear set of conveyor belts 452 and a front set of conveyor belts 454 in this embodiment. The belt sets 452 and 454 are driven by a belt drive motor assembly 284 (see FIGS. 2 and 3) in response to the device controller 240 at selected times (as described further below) to remove a completed stack from the folding area. The rear and front belt sets 452, 454 are composed of individual parallel belts 510 and 512, respectively, aligned to move in an upstream-to-downstream direction. The belt sets 452, 453 ride on respective rear and front rollers 460, 462 and 464, 466 (see FIG. 4). These rollers are rotatably mounted in the side plates 520 of a belt roller frame. The belts 510, 512 can be constructed from any acceptable friction-generating elastomer, such as polyurethane.

Figure 4:
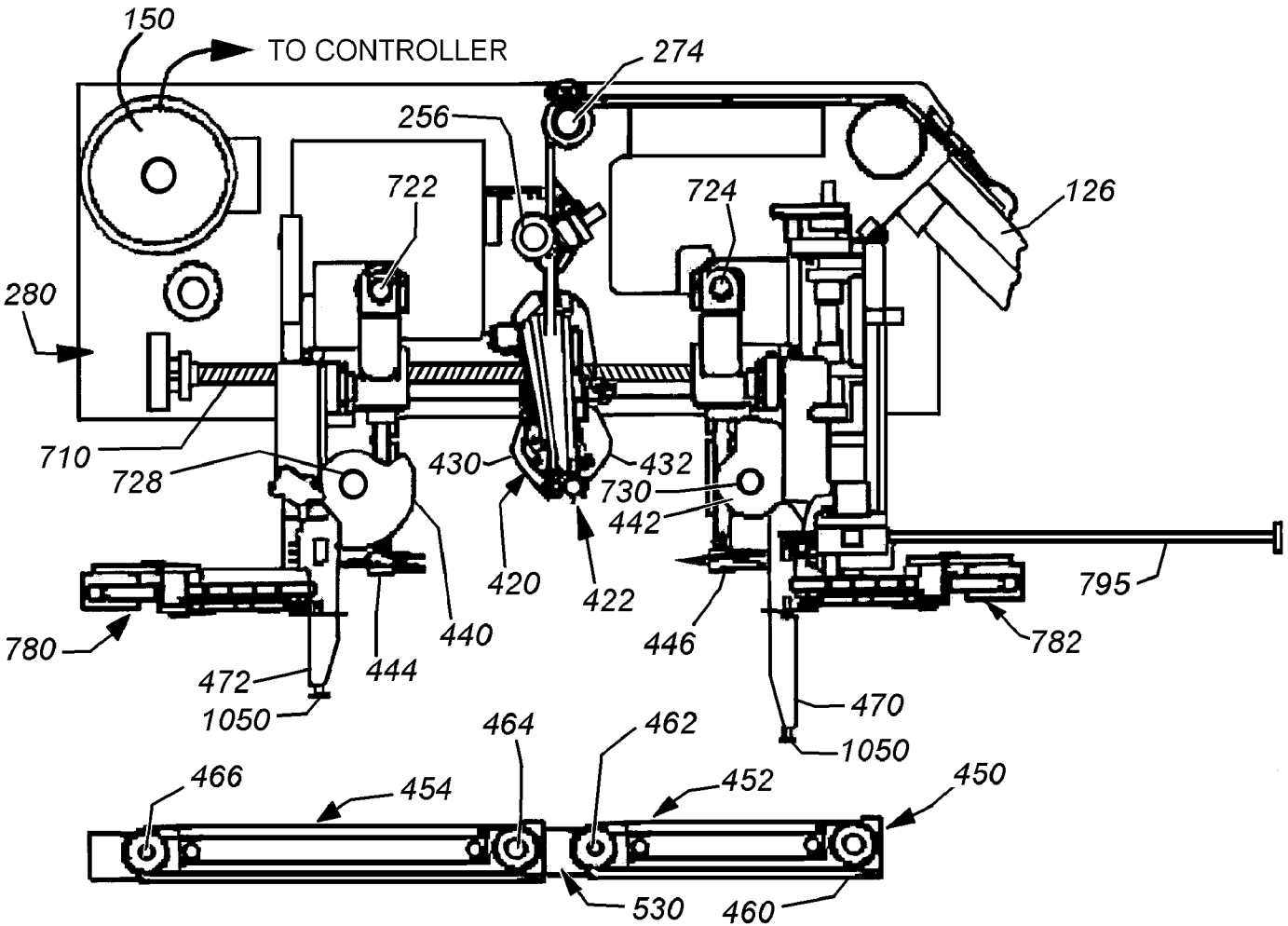
FIG. 4 is a more detailed exposed side view of the internal components for folding, stacking and supporting/transporting stacks for the device of FIG. 1.
Figure 6:
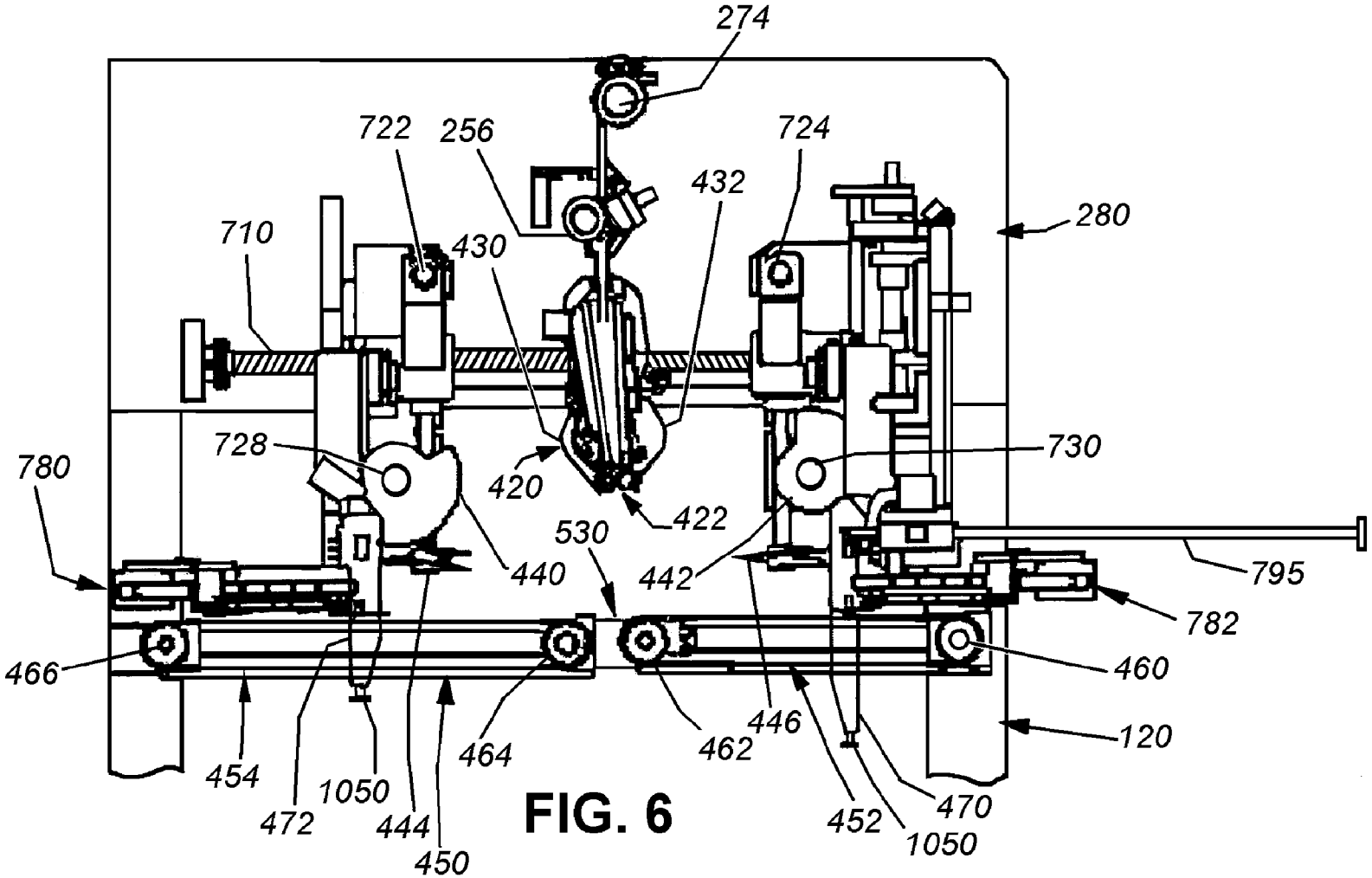
FIG. 6 is an exposed side view of the internal components for folding, stacking and supporting/transporting stacks for the device of FIG. 1, showing the stack supporting mechanism in close proximity to the overlying components, ready to receive a stack of folded web.

The belts 510, 512 are separated from each other in a widthwise direction by lengthwise gaps 522. This enables a set of rear and front stack guides 470, 472 to pass through the belts when the supporting mechanism is raided to an uppermost position as shown in FIG. 6 (from a lowered position as shown in FIG. 4). The function and construction of the stack guides is to maintain the squareness of the stack as it grows on the supporting mechanism, as described below these guides are adjustable for form length in the manner of other folding and stacking components described herein. Since the gaps 522 are continuous, they allow for a wide range of adjustable movement of the stack guides 470, 472.

Likewise, the belt sets 452 and 452 are separated by a gap 530 that extends in a widthwise direction across the supporting mechanism 450 between opposing frame sides 520. This gap 530 allows passages of two opposing side stack guides 282 (see FIG. 2). These guides are also adjustable for form width and are mounted with other components to enable such adjustment. As the gap 530 is relatively continuous, the side stack guides 282 can be adjusted variably over a wide range of form widths. The gap 530 is between ½ and 1½ inches in an exemplary embodiment, and does not adversely affect the movement of stacks between belt sets 452 and 454 as a stack is moved along the supporting mechanism 450.

In general, the number of stack guides 470, 472 and 282 and their relative spacing/positioning is sufficient to define a "bin" for receiving and constraining the stack as it forms, while the guides are sized in width and located to remain free of interference with various moving components for folding, stacking supporting and transporting the stack as described herein. Also, the bottom ends of the stack guides 470, 472 and 282 are tapered as generally shown to avoid binding on the edges of the stack as it is formed and moved vertically.

The stack supporting mechanism 450 is adapted to move bottommost position adjacent to the base and a topmost position in close proximity to the overlying folding and stacking components (280). A chain-driven lifter assembly (termed generally "lifter" herein) 190 (FIGS. 1 and 2) is provided to the device 100. The lifter 190 comprises a pair of drive chains 191 on each of opposing sides of the framework 120. The chains 191 extend vertically in the framework 120 between a respective driven sprocket 192 that is rotatably fixed in the frame base 230 and corresponding idler sprocket 193 rotatably fixed in an upper region of the framework 120. The driven sprockets are connected together by a shaft assembly that extends across the base 230. The chains 191 are driven in synchronization via the driven sprockets 192 and shaft assembly using a lifter motor 194 that is mounted in the frame base 230 (or another convenient position), and is operated under direction of the controller 240. The lifter motor 194 can be a stepper motor and/or include an encoder for measuring movement and tracking the current vertical location of the supporting mechanism within the framework 120. It transfers motion to the sprockets 192 via a transmission and connecting chain 195.

Figure 5:
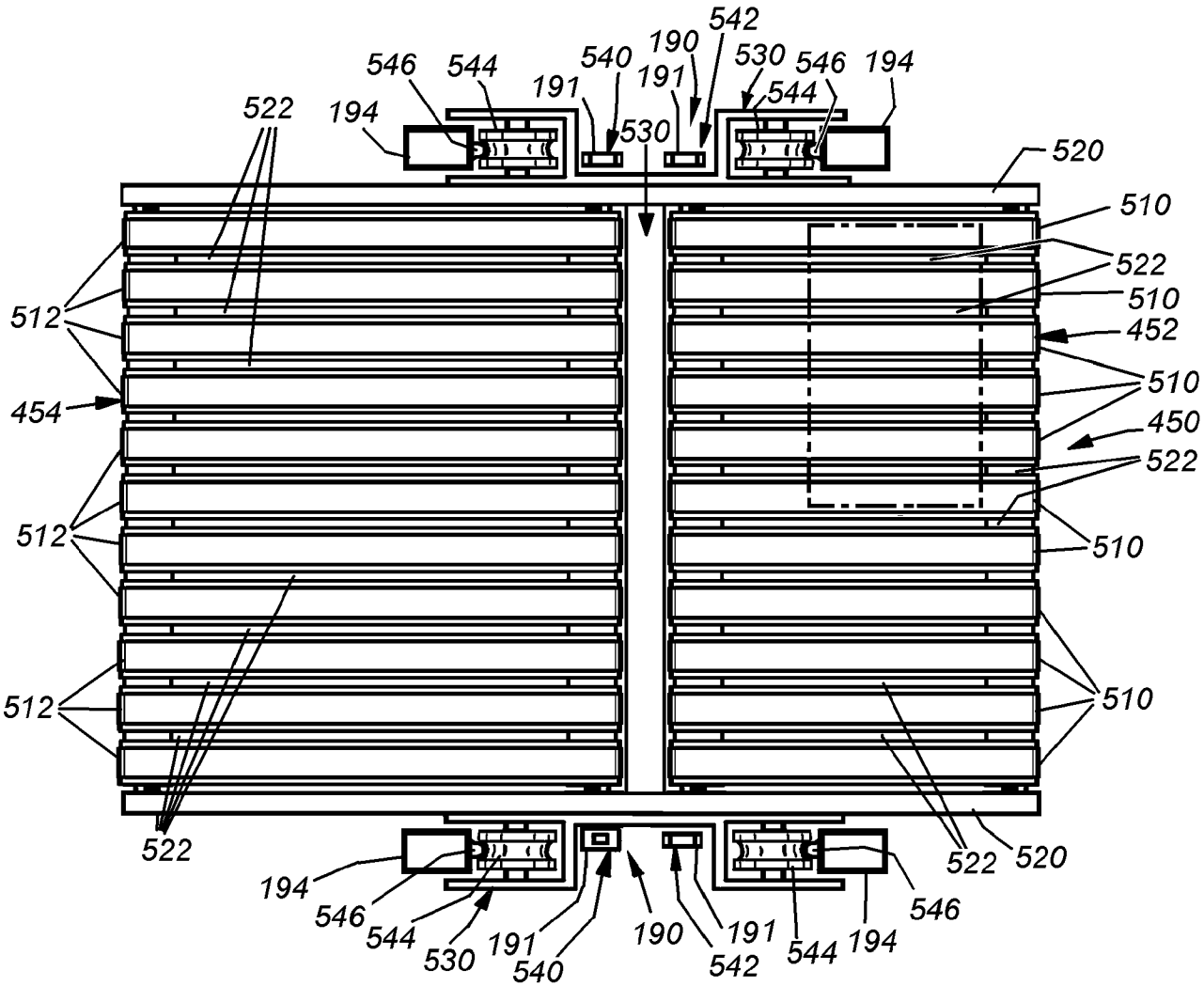
FIG. 5 is a top view of the stack supporting mechanism for the device of FIG. 1 including cross sectional views of various chain drives and roller guides for facilitating vertical movement.
Figure 8:
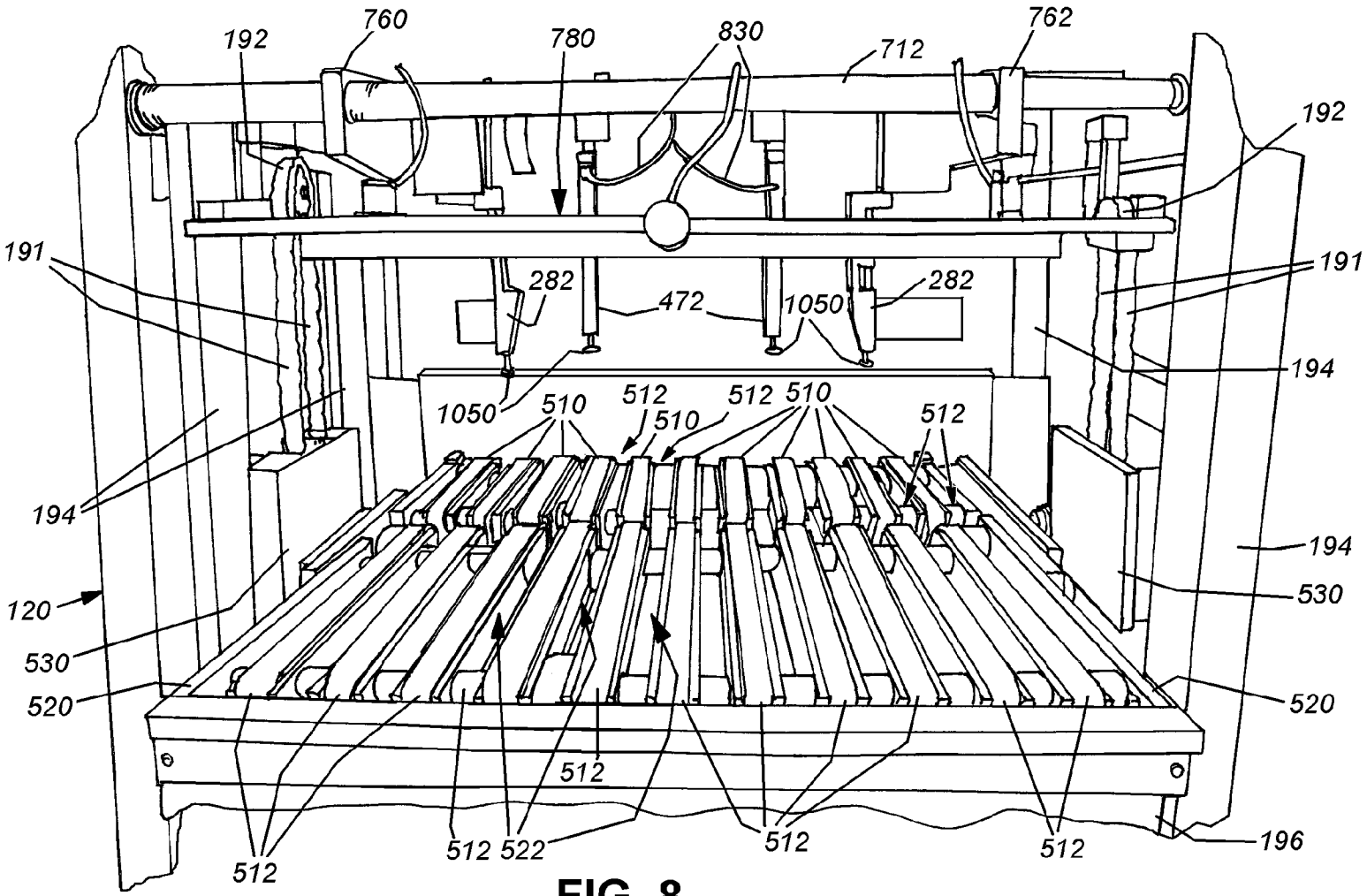
FIG. 8 is a front end perspective view of the stack-formation area of the device of FIG. 1 with the supporting mechanism moved remote from the overlying internal components.

With further reference to FIGS. 5 and 8, the lifter chain 191 is attached to a mounting bracket 530 at an attachment point 540 on each of opposing sides of the supporting mechanism 450. The opposing side 542 of each chain 191 (the "return" side) remains unattached to the supporting mechanism 450 for free movement. The bracket 530 captures rollers 544 that ride on rails 546 formed on opposing faces of two pairs of frame posts or uprights 194. In this manner, the stack supporting mechanism 450 can ride vertically between an uppermost position for receiving a new stack and a lowermost position, adjacent to the frame base 230, which allows expulsion of a completed stack. In particular, as the chains 191 are driven upwardly and downwardly they pull upon the supporting mechanism 450. The lifter 190 thereby moves the overall supporting mechanism 450 upwardly and downwardly to (both) create more vertical space for the growing stack (maintaining the stack top at the proper level relative to the folding and stacking mechanism 280), and allow the completed stack to transit to the base area for removal. Note that a variety of alternate linear lifting mechanisms can be employed in alternate embodiments. Such mechanisms include, but are not limited to, rack and pinion drives, hydraulic and pneumatic linear motors, electric linear motors, lead screws and/or cable-and-pulley mechanisms. Likewise a variety of bearing arrangements can be employed to facilitate linear vertical movement including pillow blocks, etc.

Reference is now made to FIGS. 2, 3, 3A and 3B, which detail an infeed web slitter/perforator assembly 320. In some applications removal of web edges is desired to create book-sized sheets. The slitter/perforator assembly 320 is mounted on a pair of bars that extend upstream from the device' sensing loop frame 324. This frame 324 supports the loop rollers 210 and 210. The loop passes onto the upstream roller 210, where it encounters a pair of slitter/perforator heads 330. The heads are mounted on a slotted cross beam 332, which allow the heads 330 to be movably positioned (double arrows 334) at any location(s) along the width of the web 202. The position of each slitter is fixed in place by tightening a screw knob 336 that selectively applies friction between the head 330 and cross beam 332. Each head supports a cutter wheel 340 that rotates freely in engagement with the web 202 as it passes over the roll 210. The roll 210 can be elastomeric so that, when the wheels 340 are pressurably applied against the roll they positively slice through the intervening web 202. A lever assembly 342 on each head 330 can be used to selectively drive the wheels 340 into engagement with the roll 210. This lever contains a cam or other conventional mechanism (not shown) that moves the wheels along an internal slide along into engagement with the rolls against a retraction force normally provided by an internal spring (not shown). A variety of mounting assemblies and engagement mechanisms can be employed according to alternate embodiments.

In an illustrative embodiment, the overall web 202 maintains its full width as it enters the separating, folding and stacking components of the device. In other words, the heads 330 do not fully separate the web edges. Rather, the web edges receive a long perforation 350 (FIG. 3A) that is separated by short connections 352. In one example, the perforations are between approximately 4 and 6 inches long while the perforation is approximately 1/16-3/16 inch long. The precise measurements for the perforation and connection are highly variable. In general, they are sized and arranged to allow outer edges 354 of the sheets in the stack to be easily broken away as a group, after stacking, by a bending or twisting action applied to the edge group. To create the desired perforation pattern, the wheel 340 contains a notch 360 formed on the sharp slitter edge 362. The approximate arc length AC of the notch 360 defines the length of the connection between perforations, while the surrounding circumference of the edge 262 generally defines the length of the perforation.

Referring to FIG. 1, the front edge of the supporting mechanism 450 is attached to movable safety barrier 196 that comprises a plurality of, flexibly joined (tambour-style) metal strips that extend across the width of the framework front between front uprights 1937. As shown below (see FIG. 23) the barrier rides in a track that extends along the facing edges of the uprights and along facing edges of the base 230. As the supporting mechanism 450 moves downwardly, the barrier 196 passes into the base. The barrier prevents users and others from inadvertently extending a hand or other article into the lower end of the framework where damage to the device 100 or injury may result.

As will be described further below, the front side of the device 100 includes a base-attached conveyor system 197. The conveyor system 197 is adapted to receive a cart 180 as described above, the conveyor system consists of driven belts 198 that extend the approximate length of the cart and ride between parallel cart slats 199. The belts are driven by a motor assembly 290 (see FIG. 2) at predetermined times in response to the controller 240. The belts allow a stack to be transported from the supporting mechanism 450 onto the cart 180 when the supporting mechanism is lowered into alignment with the cart 180 and belts 198. As will be described below, the belts normally interfere with movement of the surrounding cart framework and slats. Thus, the belts can be raised and lowered to allow a cart to be docked with, and undocked from, the conveyor system as needed. A lift motor assembly 292 is located within the conveyor system to enable raising and lowering of the belts.

B. Cutting, Folding and Stacking Components

Figure 7:
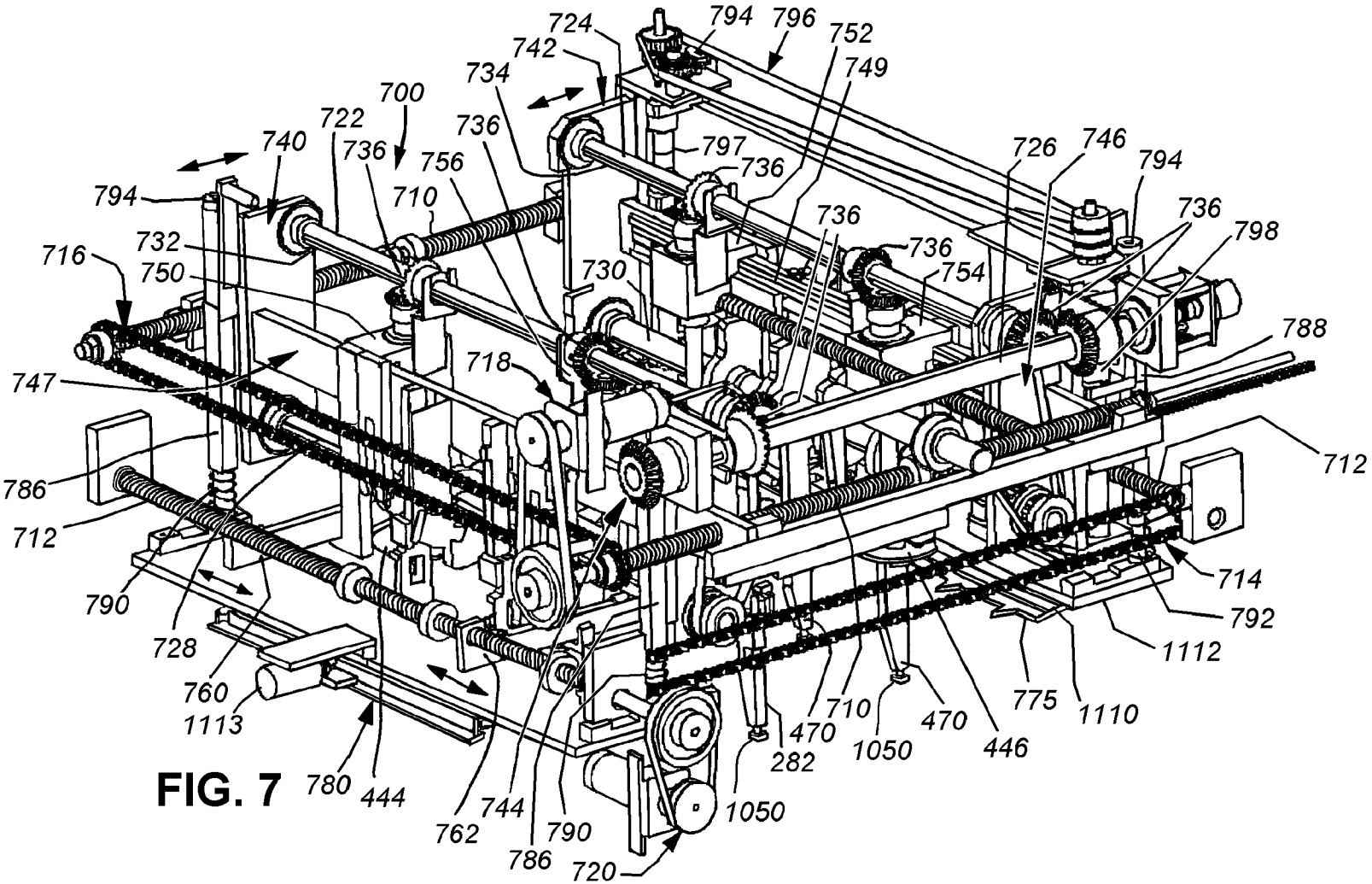
FIG. 7 is an exposed perspective view of cutting, stacking and folding components of the device of FIG. 1.

Reference is now made to FIG. 7, which details the components of the device 100 adapted for separating/cutting, folding and stacking of continuous web in accordance with an embodiment of the invention.

With reference further to FIG. 7, the stack guides 470, 472, 282, beaters 440, 442, spirals 444, 446 and other components that must be sized to conform to a given folded form width and length are all be mounted on a common, movable subframe 700 within the overall framework 120. This subframe allows these components to be adjusted for size in both a front-to-back and side-by-side direction. In this manner the system can adjustably accommodate differing side-to-side web widths (for example, between 8-inch and 16-inch) and differing front-to-rear folded-section/page lengths (for example, between 11-inch and 14-inch). The precise adjustment range is highly variable according to various embodiments.

In the illustrative embodiment, the system rides on two orthogonal pairs of lead screws, a front-to back pair 710 and a side-to-side pair 712. The lead screws 710, 712 are synchronized in rotation by respective chain-and-sprocket assemblies 714, 716. While the screws can be hand-rotated in an alternate embodiment, the adjustment in the present embodiment is automatic and performed by respective adjustment motor assemblies 718, 720. In this embodiment, the motors are stepper motors or otherwise allow their rotation to be tracked (for example counting pulses) so that the current location and degree of movement of each lead screw can be monitored. The folding and stacking components are powered by drive shafts 722, 724, 726, 728 and 730. These shafts are keyed (see slots 732, 734 so that keyed bevel gears 736 can slide freely therealong as the lead screws adjust the spacing of components, while the gears deliver rotational motion. All shafts are connected by appropriate belts and gears to the central drive motor 150 (see FIG. 1). The components are supported by pairs of carriages 740, 742, 744 and 746 with threaded nuts that engage the front-to-rear lead screws 712 and 712. The carriage pairs 740, 744 and 742, 746 are joined by respective cross bars 747 and 749. The cross bars 747, 749 each slidably support respective pairs of individual posts 750, 754 and 752, 756. These posts carry the spirals 444 and 446. A pair of moving lower frame members 760, 762 ride along the side-to-side lead screws 712 and draw the posts toward and away from each other. This serves to vary the widthwise spacing of spirals 444, 446. The posts may also be connected to the beater shafts 728 and 730, allowing the relative spacing and side-to-side position of beaters to vary along their keyways as the posts 750, 754 and 752, 756 and/or moving lower frame members 760, 762 move.

Figure 7A:
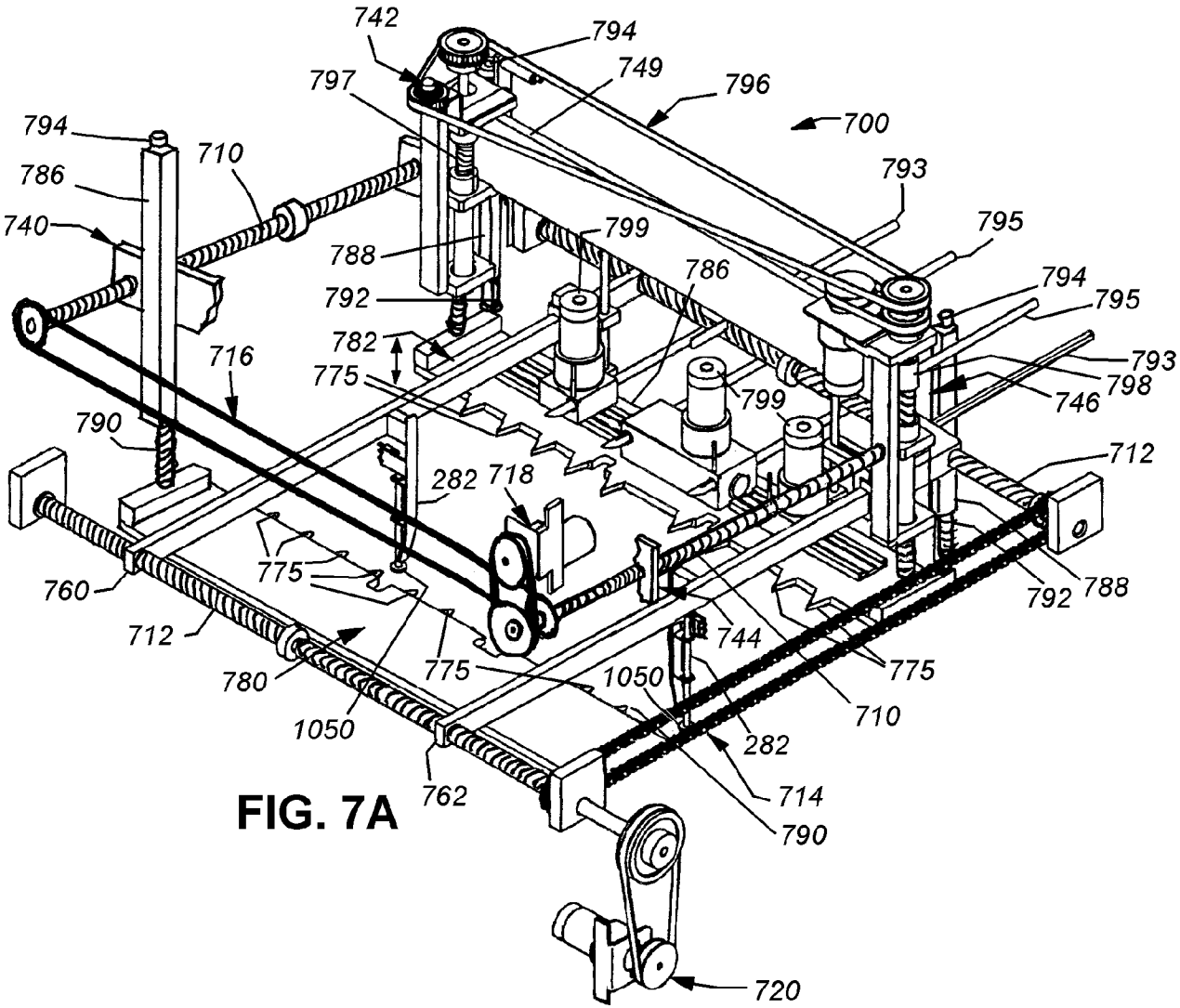
FIG. 7A is an exposed partial perspective view of the temporary support rod and stack compression mechanism of the internal components of the device of FIG. 1.

The moving lower frame members 760 and 762 carry the side stack guides 282 and the movement of the bars 760, 762 adjusts the spacing of the stack guides 282. The pairs of carriages 740, 744 and 742, 746 each carry a compression plate assembly 780 and 782, respectively. The function of the compression plate assemblies 780, 782 is to remove air bubbles from the stack as it forms and ensure complete creasing along stack fold lines so as to ensure the stack is square and compacted as it forms. This is highly desirable since high vertical stacks are formed in accordance with this embodiment. A loose stack is more likely to skew or even topple. With reference also to FIG. 7A, each compression plate assembly 780, 782 is attached to a carriage pair by a respective support post 786 and 788. The support posts 786 and 788 guide a central shaft 790, 792 directly connected to each compression plate 780, 782, respectively. The tops of each shaft 790, 792 are stopped by a collar 794 that limits downward movement of each plate. The shafts 790 and 792 are spring-loaded as shown so that they each exert a few pounds (totaling between approximately 5 and 25 pounds of compression force-per-plate in various embodiments) of pressure when pressed upwardly. As will be discussed below, this pressure allows the stack to be continuously compressed in response to a reciprocating up-and-down movement by the supporting mechanism 450. In one embodiment, the vertical travel of the plates 780, 782 under compression is between approximately ⅜ and ¾ inch. When compressed upwardly, the collars 794 move away from the tops of the support posts 786, 788. In an embodiment, an appropriate sensor can be applied to one or more collar to detect upward movement and thereby limit upward travel of the supporting mechanism.

It should be clear that each compression plate 780, 782 is moved toward and away from the other by movement of the lead-screw-driven carriage pairs 740, 744 and 742, 746. This allows the plates to accommodate differing form lengths. The width of the plates is constant and can accommodate a wide range of widths without adjustment. In this embodiment the front stack guides 472 are fixedly mounted to the front plate assembly 780 at a desired spacing that accommodates a wide range of form widths. Likewise, the rear stack guides 470 are fixedly mounted to the rear plate. In alternate embodiments, these guides may be movable, but they should be indexed to pass between supporting mechanism belts as described above. The stack guides 470, 472 are free to move toward and away from each other along with the plates 482, 480 that carry them. The gaps 522 (FIG. 5) between belts are open to allow free movement of the guides 470, 472 along the range of contemplated form lengths.

Notably, the rear compression plate assembly 782 is mounted on a carriage pair 742, 746 that enables upward and downward movement independent of the subframe 700. A belt and motor assembly 796 drives a respective lead screw 797, 798 on each carriage 742, 746. Each lead screw isolates the plate assembly 882 from the remaining carriage structure, thereby allowing the lead screws to rapidly raise and lower the compression plate assembly without raising or lowering the carriage. This ability to raise and lower the plate 782 assists in stack formation and "tamping" of completed stacks as described in detail below.

The rear compression plate assembly 782 carries a set of outer temporary support rods 793 and inner temporary support rods 795 (also collectively termed the "forks"). As will be described below, the rods 793, 795 include gear racks that engage drive gears attached to drive motors 799 (or other high-speed motor arrangements, such as linear actuators). Briefly, the drive motors 799 drive one or both sets 793, 795 forwardly to span the stacking area when needed to provide temporary support to a new stack while the completed stack is transported downwardly by the supporting mechanism 450 to a waiting cart. This allows continued stack formation without interruption. When the completed stack is no longer present, the supporting mechanism is raised back into position to receive the stack formed on the rods 793, 795, and the rods are withdrawn by the motors 799 to deposit the new, forming stack onto the supporting mechanism. The outer rods 793 are used in conjunction with the inner rods 795 for wider form widths, while the inner rods 795 are used exclusively for narrower form widths. The outer rods 793 are not used for narrower widths, as they might interfere with other stacking components such as the spirals 444, 446. The controller 240 determines when it is appropriate to use the outer rods based upon the form width setting. This setting also instructs movement of the adjustment motor assemblies 718, 720, with the controller monitoring pulses to establish the proper length and width positions.

C. System Operation

Figure 9:
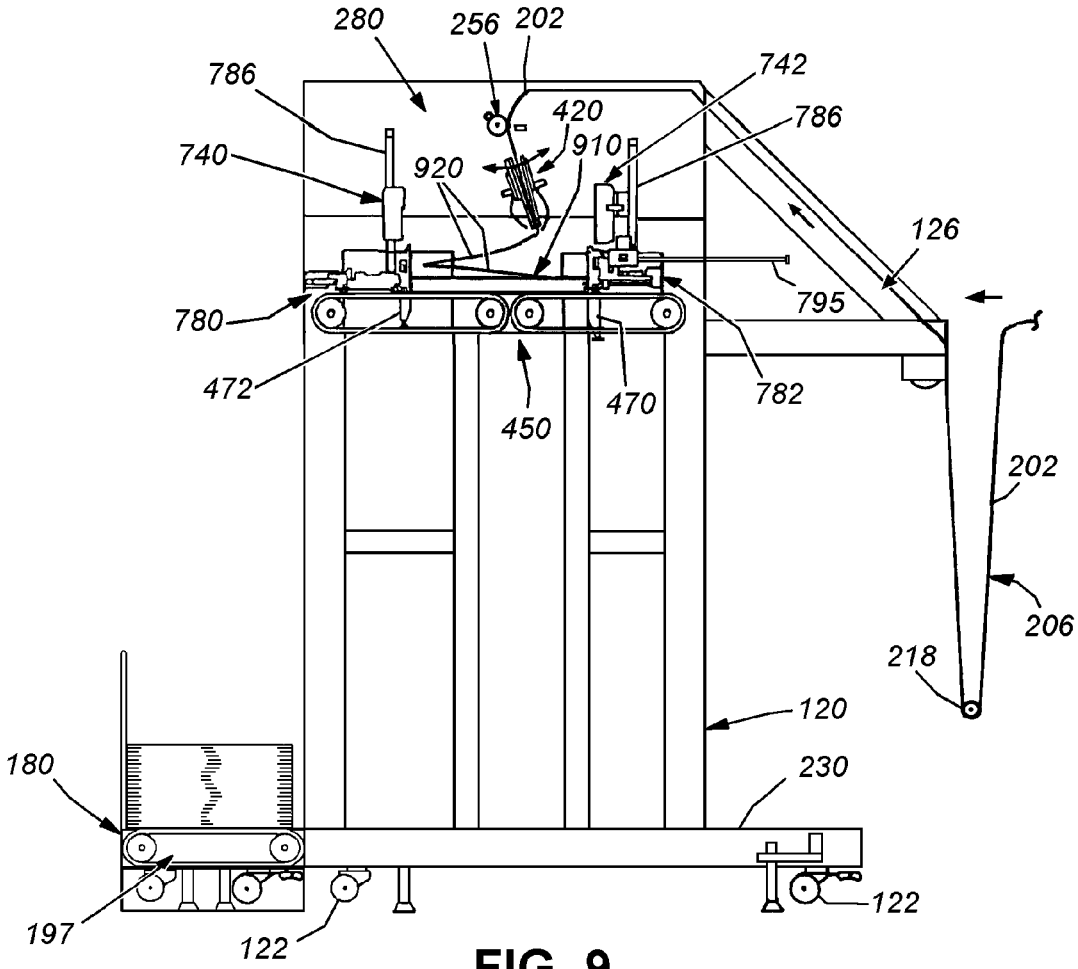
FIG. 9 is an exposed side cross section of the device of FIG. 1 showing initial formation of a stack from web fed along the device feed path.
Figure 10:
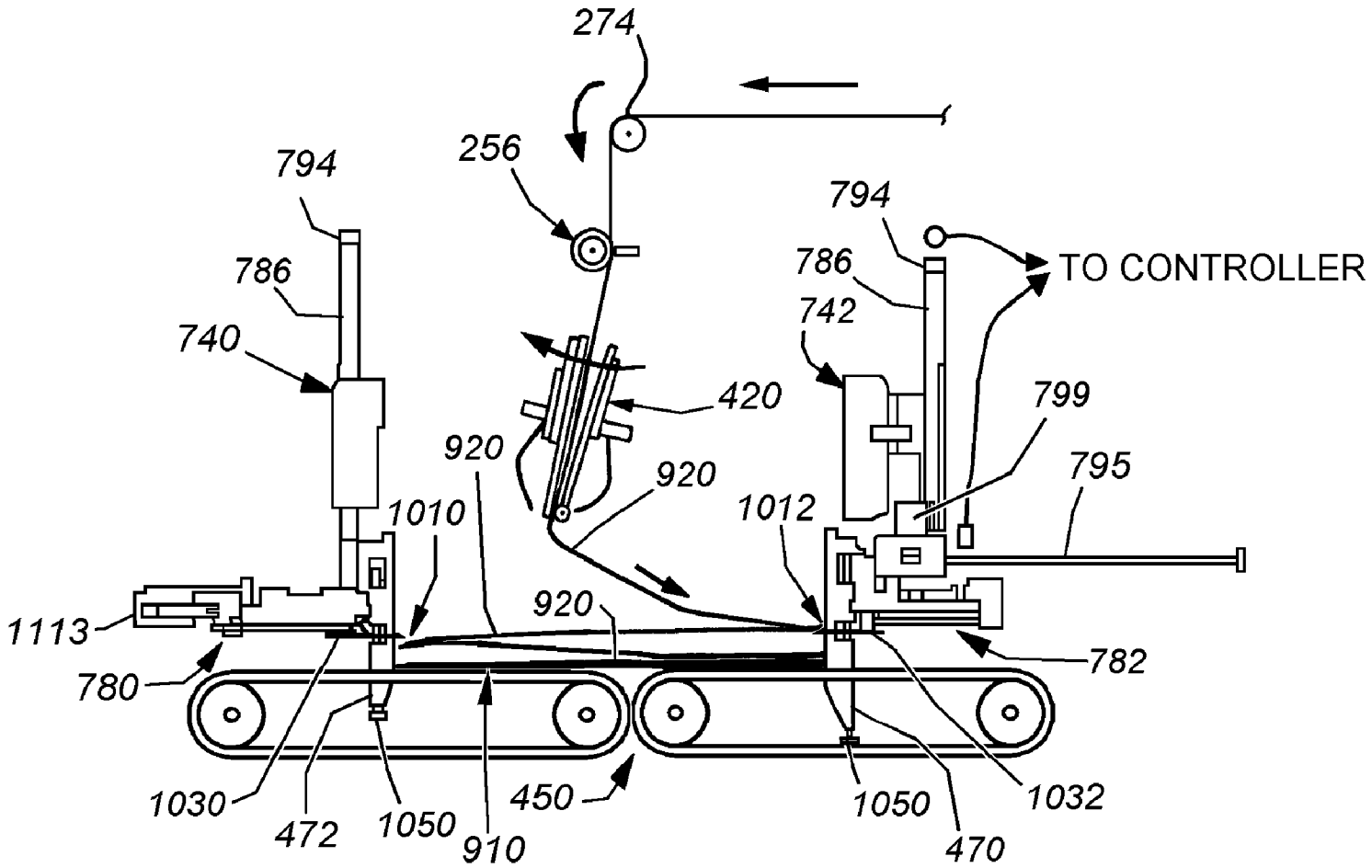
FIG. 10 is a simplified side cross section of the internal components for cutting, folding, stacking and supporting/transporting a stack of continuous web for the device of FIG. 1 showing initial formation of a stack on the supporting mechanism.

Having described the device's components for cutting, folding, stacking and transporting of web, the operation of the device will now be described in further detail. FIGS. 9 and 10 show the beginning of the formation of a new stack 910 as web 202 is driven out of the feed loop 206, up the ramp 126 and into the components for cutting, folding and stacking 280. The swinging director chute (pendulum) 420 guides driven web into the beaters and spirals (omitted for clarity—for illustration of beaters 440, 442 and spirals 444, 446, refer variously to FIGS. 2, 4, 6, 7 and 8 described above). The beaters and spirals crease the web along perforations or other stress reliefs to conventionally form a stream of zigzag folded sections or pages 920. The respective front and rear fold edges 1010, 1012 of the pages 920 are deposited into the confines of the respective stack guides 472, 470, as shown. The side guides 282 have been omitted for clarity. As will be described below, the compression plate assemblies 780, 882 include respective moving plates 1030 and 1032 that define a plurality of finger or claw-like projections (see fingers 775 in FIG. 7).

Figure 11:
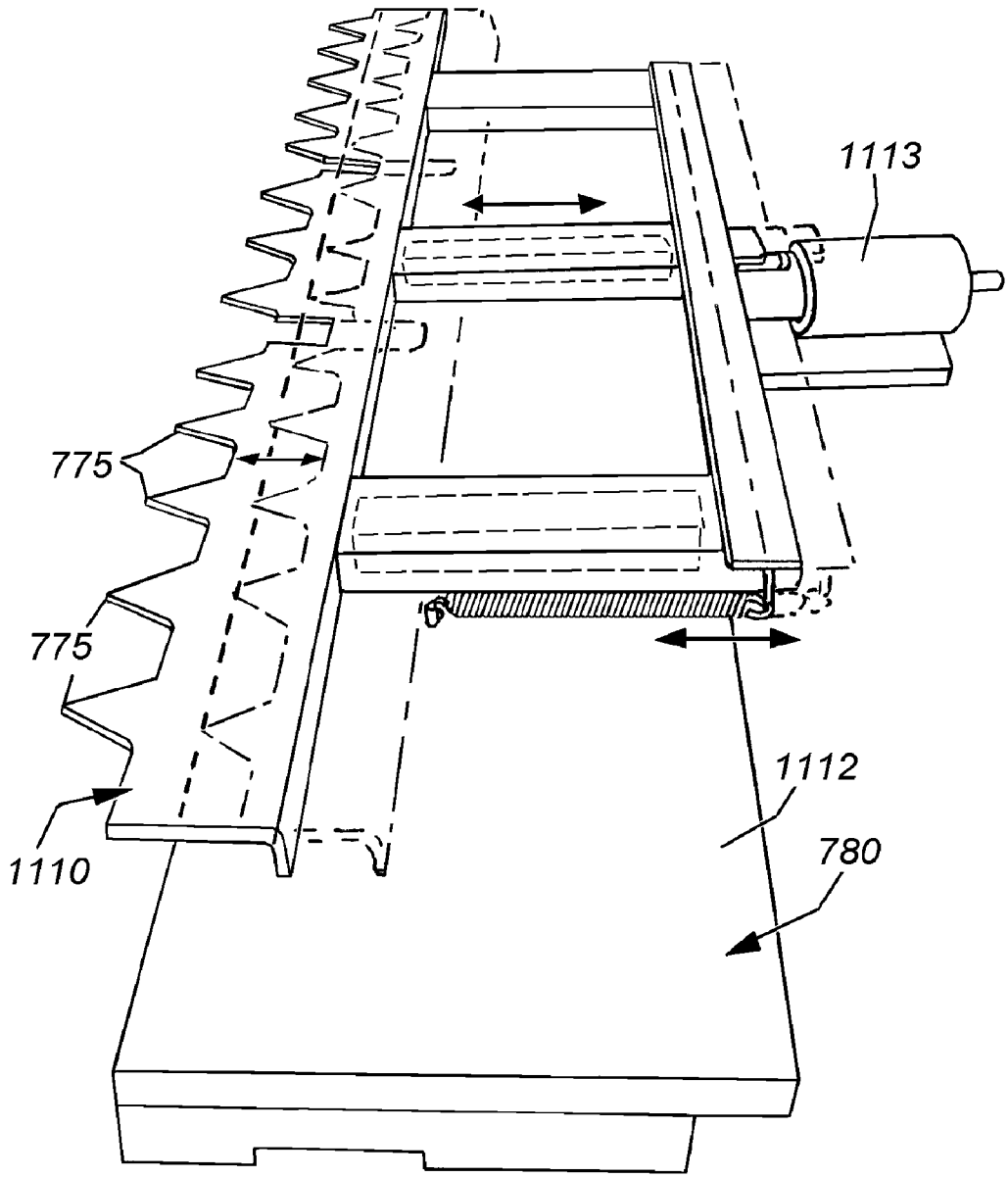
FIG. 11 is a partial perspective bottom view of a compression plate and moving finger arrangement in accordance with an embodiment of the device of FIG. 1.

FIG. 11 details a bottom view of the front compression plate assembly 280. The structure and function of the fingers on the rear plate assembly 282 is similar. As shown, the fingers 775 are formed on a finger plate 1110 slidably mounted on the base plate 1112 of the assembly 780. A linear actuator (i.e. a solenoid) 1113 interconnects the base plate 1112 to the sliding finger plate 1110 and allows front-to-rear movement (double arrow 1114) as shown. A tension spring provides recoil force to withdraw the finger plate to a normally retracted position (shown in phantom) while the actuator applies force, when energized, to extend the finger plate 1110. This action causes each set of fingers 775 to move selectively into and out of interference with the stack front and rear edges 1010, 1012. When withdrawn as shown in FIG. 10, the edges are free to drop onto the underlying stack 910. When extended toward each other, the fingers 1030, 1032 overlap the front and rear edges 1010, 1012, respectively by approximately ¼ to ½ inch on each side (front and rear). Note in FIG. 11 the slots 1120 formed in both the finger plate 1110 and base plate 1112 for accommodating the stack guides 472 (omitted for clarity).

Figure 12:
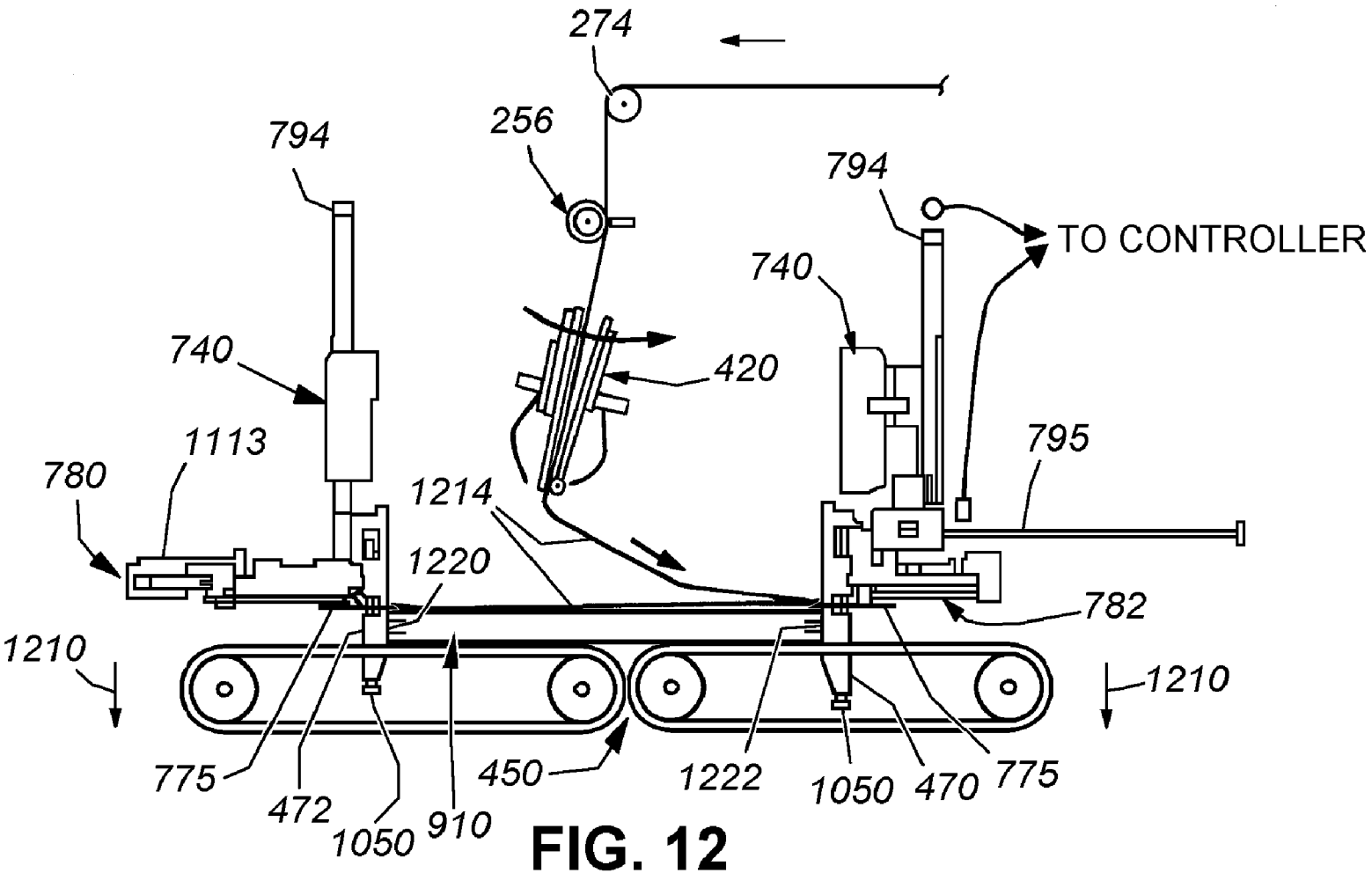
FIG. 12 is a simplified side cross section of the internal components from FIG. 10 showing the continued formation of the stack on the supporting mechanism while the supporting mechanism moves downwardly away from the overlying components to accommodate the increased stack height.

Referring now to FIG. 12 the stack 910, begun in FIGS. 9 and 10, has now grown, with additional pages deposited upon the stack top. At predetermined times (continuously, for example) during the formation of the stack 910, the controller 240 signals the lifter 190 to move the supporting mechanism downwardly (arrows 1210) a predetermined distance. This allows maintain a relatively constant spacing with respect to the director chute 420 and other folding/stacking components. This also ensures that most of the newly formed sheets 1214 (which may still be loosely folded) reside at a level beneath the compression plate fingers 775, shown in FIG. 12 in a retracted state, free of interference with the stack front and rear edges 1220 and 1222.

Figure 13:
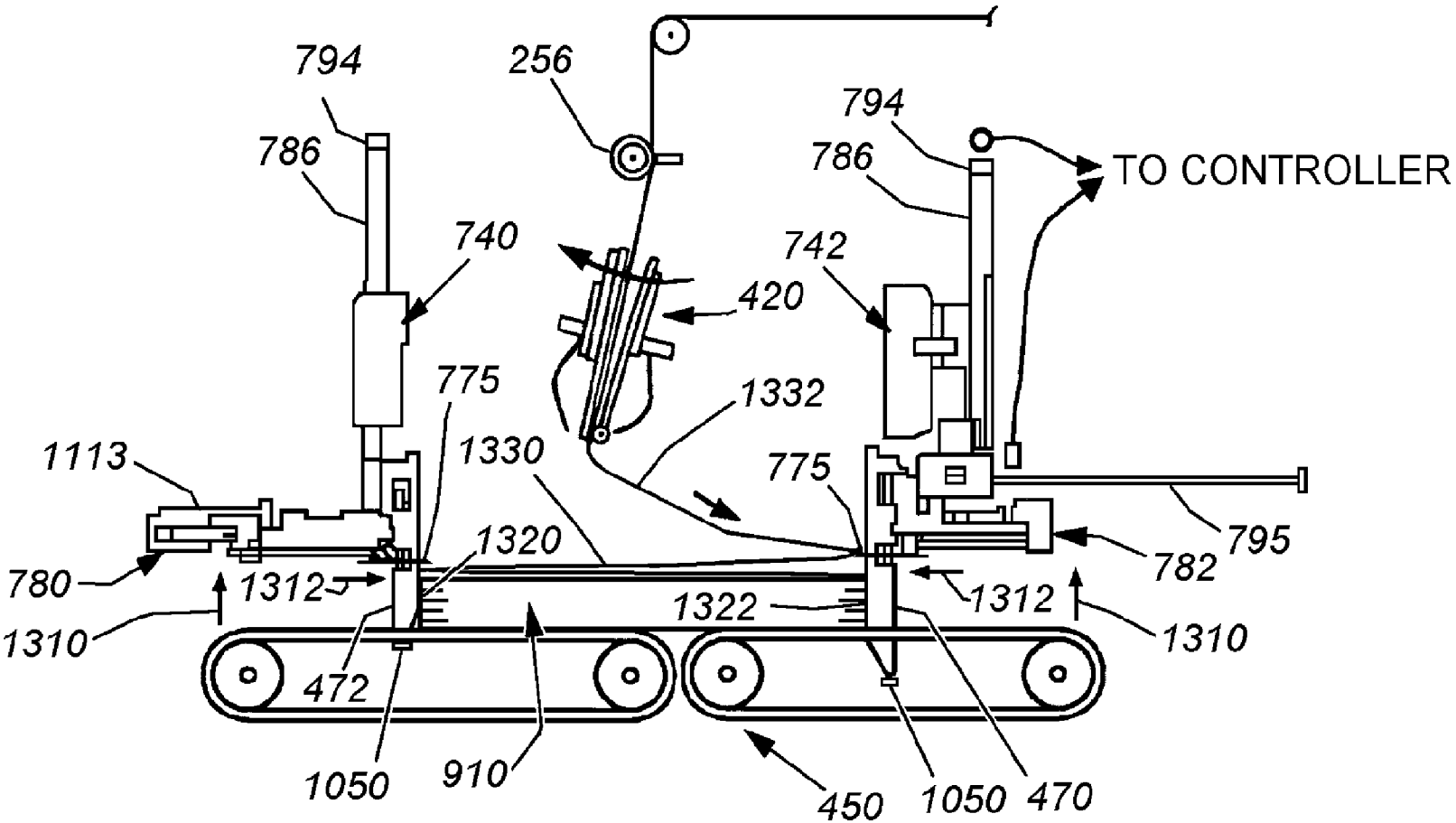
FIG. 13 is a simplified side cross section of the internal components from FIG. 10 showing the continued formation of the stack on the supporting mechanism while the supporting mechanism moves upwardly toward the now-extended compression plate fingers.

Referring now to FIG. 13, the supporting mechanism 450 now moves from a lowermost point of vertical travel upwardly (arrows 1310) toward the compression plates 780, 782. The compression fingers 775 are driven toward each other as indicated by arrows 1312. Thus as the stack 910 moves toward the compression fingers 775, the front and rear edges are in an interfering relationship with respect to the adjacent compression finger set. Note that the front fold edge of the top sheet 1330 of the stack 910 is positioned below the adjacent compression fingers while the rear fold edge, which joins the fed sheet 1332, is above the adjacent fingers 775. In practice a number of loosely folded sheets delivered from the spirals and beaters will reside above the extended fingers. However the bulk of the newly formed sheets reside below the fingers during a typical stack-compression cycle.

Figure 14:
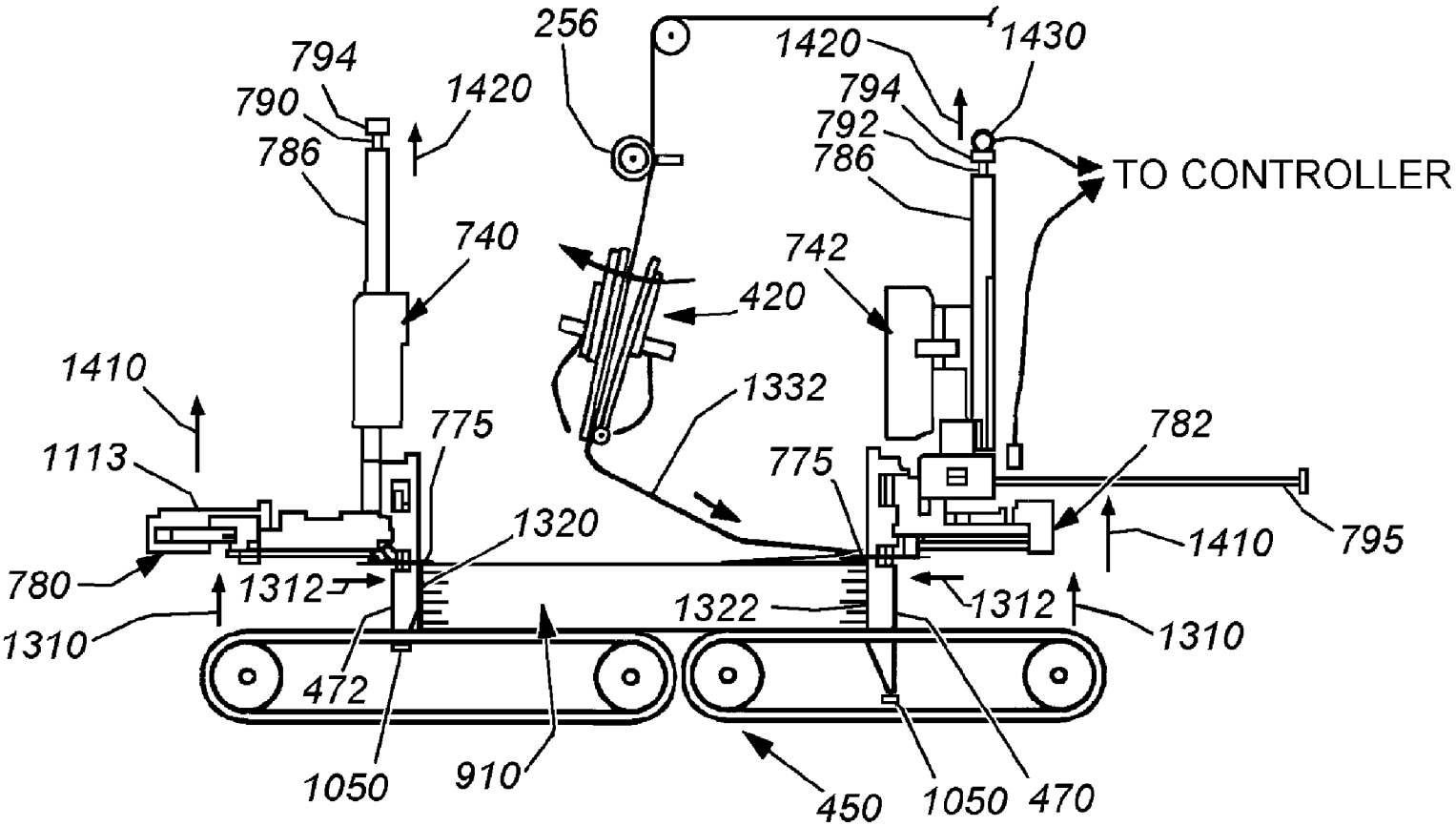
FIG. 14 is a simplified side cross section of the internal components from FIG. 10 showing the continued formation of the stack on the supporting mechanism while the supporting mechanism moves upwardly into engagement with now-extended compression plate fingers to thereby compress the growing stack.

Compression of the stack is completed as shown in FIG. 14. In particular, the supporting mechanism 450 moves upwardly sufficiently for the stack front and rear edges 1320, 1322 to pressurably engage the adjacent extended fingers 775. Accordingly, as the supporting mechanism drives the stack 910 upwardly, the fingers and their overlying plate assemblies 780, 782 are biased upwardly (arrows 1410). This force overcomes the spring pressure exerted on each shaft 790, 792 and the shafts rise as exhibited by upward movement of the stops 794 (arrows 1420). In this embodiment, at least one of the stops communicates with a microswitch or other sensor 1430, that signals the controller 240 when the stop 794 (and, hence the plates 780, 782) have been compressed upwardly a predetermined distance. As such the controller signals the lifter 190 to cease upward movement and again move downwardly a predetermined distance. At all times the chute 420 and associated fold mechanism continue to form the stack 910.

While a sensor 1430 is employed to limit upward movement, it is expressly contemplated that alternate systems can be employed to regulate upward travel of the stack on the compression cycle. For example, a stack top sensor (optical or mechanical) can be employed to sense the position of the stack top or another part of the stack. The lifter motor (194) can likewise be monitored and a predetermined, continually lowered position can be achieved on each successive cycle, thereby approximating the predicted growth in the stack through the known location of the lifter 190.

Note also the presence of button-like projections on each stack guide 470, 472 (and 282) that move vertically if contacted as a result of a paper jam or the presence of a foreign object within the path of the respective stack guide as the supporting mechanism 450 moves upwardly. Activating a button 1050 causes the upward movement of the lifter/supporting mechanism to cease and the lifter to lower the supporting mechanism. These buttons 1050 are each connected to respective shafts that pass vertically through each guide and exit at the guide's top end. At the top end of each guide is a microswitch or other contact sensor that is interconnected to the controller (see exemplary connection cables 830 in FIG. 8). The precise arrangement of contacts and buttons is highly variable. Alternatively optical sensors can be employed.

Figure 15:
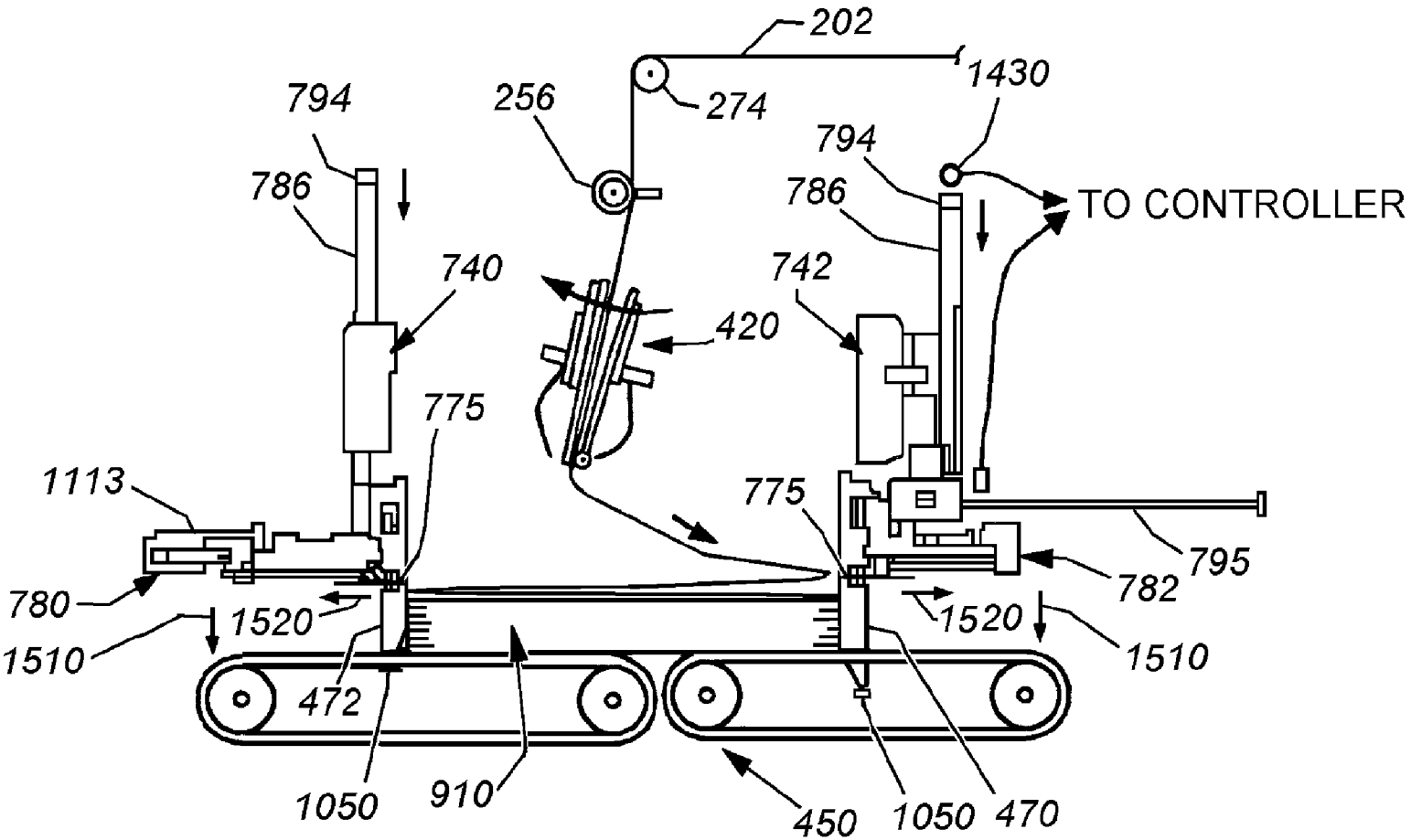
FIG. 15 is a simplified side cross section of the internal components from FIG. 10 showing the continued formation of the stack on the supporting mechanism while the supporting mechanism moves downwardly and the compression plate fingers are retracted to allow newly formed sections of stack to fully contact the underlying main stack.

As shown in FIG. 15, once the stack 910 has been compressed to a desired degree, the supporting mechanism 450, via the lifter moves the stack 910 downwardly (arrows 1510). This provides further clearance for additional folded sheets, which enter the stack from the folding and stacking components above. The degree of lifter descent is registered relative to the rate of growth in the height of the stack so that the stack top remains at a relatively constant height with respect to the folding and stacking mechanism. The controller 240 can monitor the motion of the central drive motor 150, and translate this into the number of sheets deposited on the stack within a given interval. This value can be translated into pulses applied to the lifer motor 194 to, thereby, lower the supporting mechanism 450. Alternatively, a stack top sensor that is monitored by the controller can be employed to direct the lifter to maintain a predetermined spacing between the top of the stack and the folding/stacking components of the device. To facilitate delivery of new folded sheets onto the stack top, the compression fingers 775 are refracted (arrows 1520) away from each other as shown. This defines an uninterrupted path through the funnel defined by the stack guides 470, 472 (and 282 above).

The process of continuously lowering the supporting mechanism to provide predetermined clearance for the growing stack continues throughout the process of stack formation. Likewise, at predetermined time intervals, the supporting mechanism cycles in an upward compression stroke as described in FIGS. 13-15. The compression intervals can occur after a given number of sheets have been added to the stack, based upon a time interval, or as part of a relatively constant oscillatory cycle in which the supporting mechanism drops to a continually lower minimum height and then raises to a maximum height (determined by the compression of the plates 780, 782 (see FIG. 14), or another triggering event).

Note that the tapered ends of the stack guides 470, 472, 282 serve to channel the compressed upper region of the stack back into alignment with the folding area upon each upward stroke of the cycle. While compression tends to significantly justify the sides of the stack, thereby eliminating side skew when the stack is unsupported, some minimal side skew may remain. The tapered ends ensure that the stack properly rises into its aligned position between the stack guides regardless of overall stack height.

Figure 16:
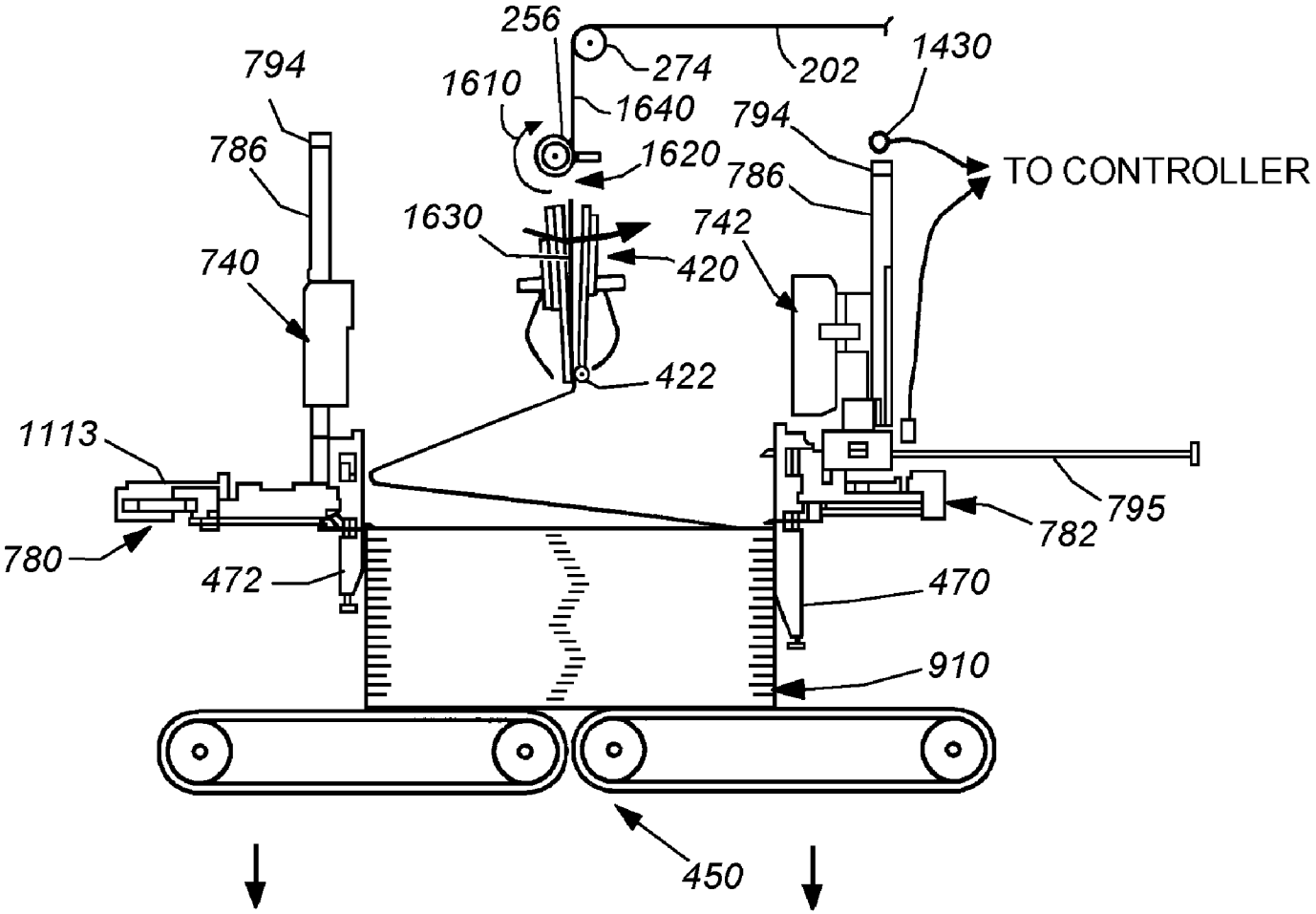
FIG. 16 is a simplified side cross section of the internal components from FIG. 11 showing the process of completing the stack on the supporting mechanism showing the separation of the trailing end of the current stack relative to the leading end of the next stack by the cutter.

With reference to FIG. 16 the stack 910 has reached its completion height (up to approximately 4 feet in the embodiment. The stack 910 reaches its predetermined completion height either (a) when the print process sends an external trigger to the controller from, for example, an upstream web processing or utilization device; or (b) when a maximum stack height is counted in the device by the controller 240 using a page count or sensing by the controller 240 of the attainment of a minimum supporting mechanism (450) height. In other words, a stack may be completed by completion of a print job or in the middle of a job when the stack can grow no larger and the job must extend into another stack (or stacks). Based upon a completion signal, the cutter 256 operates (arrow 1610) to separate the web 202 at gap 1620. Separation is performed at the proper registered location using know registration techniques. The trailing end sheet 1630 of the forming stack 910 is directed through the chute 420 for placement on the top of the completing stack 150. The chute end roller assembly 422 may be adapted to drive the trailing end 1630 at an overspeed so that the end 1630 has time to lay upon the stack 150 before the leading end sheet 1640 of the separated upstream web 202 arrives at the bottom end of the chute 420.

Figure 17:
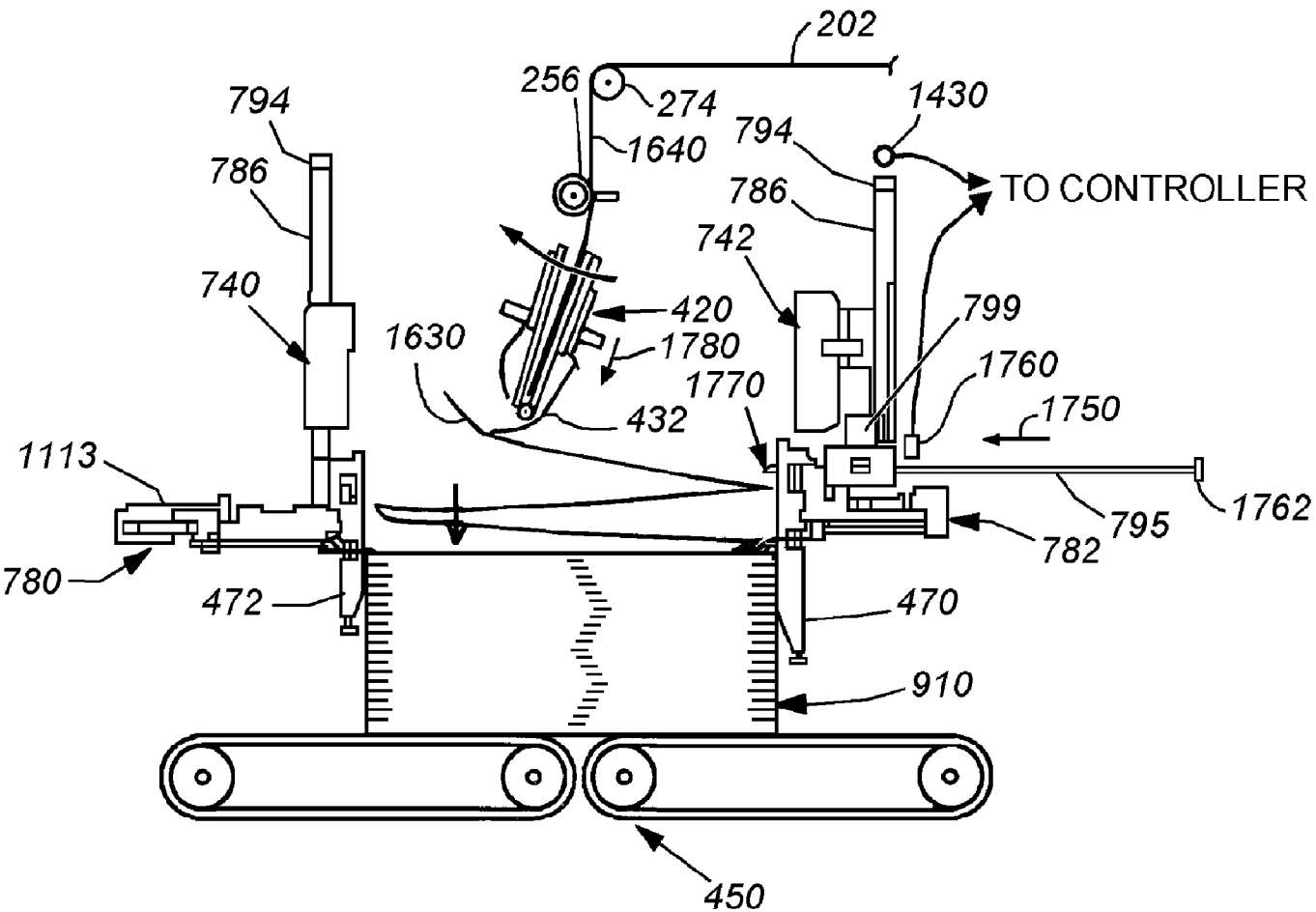
FIG. 17 is a simplified side cross section of the internal components from FIG. 11 showing the completion of the current stack with the trailing end directed out of the pendulum chute and assisted onto the top of the stack by a deployed chute director finger.

Reference is now made to FIG. 17. Since the controller 240 is aware that the stack end sheet 1630 is separated, it now instructs one or both pairs of temporary support rods 793 (shown and described above) and 795 to begin inward movement (arrow 1750). As described above, the pairs of rods 793, 795 are selectively employed depending upon the width of the web. Each of the rods includes a gear rack formation along a side surface. The gear rack formation is adapted to engage a pinion gear mounted with respect to each rack. The pinion gears are driven by respective drive motors 799, mounted on the rear compression plate assembly 782. The drive motors 799 are each operated by the controller 240. The motors rotate to drive the rods inwardly into the folding and stacking area and outwardly, away from the folding and stacking area. In this embodiment, an optical, magnetic or mechanical sensor 1760 is triggered when a stop 1762 at the outward end of each rod 793, 795 is encountered. This limits forward movement of the rods 793, 795 into the stacking area beyond a predetermined limit, thus preventing damage to the rods or motors. In alternate embodiments, the drive motor arrangement for each rod can include encoding or stepping functions to precisely control the movement stroke into and out of the folding area. The inwardly directed ends 1770 of the rods 793, 795 are ramped toward a lower edge as shown (in the manner of a chisel tip). This acts as a scoop to prevent the leading end sheet 1640 of the new stack from falling beneath the rods 793, 795 as they are deployed.

In an illustrative embodiment, the director chute finger assembly 432 can deploy (arrow 1780) at this time. It serves to ensure that the final, trailing sheet 1630 of the formed stack 910 is biased downwardly onto the stack top before the rods 793, 795 deploy. The finger assembly 432 (and opposing finger assembly 430) is constructed from a flexible metal or polymer and includes a spring-loaded curvature that causes it to curve around the downstream opening of the director chute 420 as shown. It should be noted that in an illustrative embodiment, the finger assembly 432 can be omitted from the chute 420. In such implementations, it is assumed that the device effectively delivers the final sheet onto the stack with sufficient flatness to avoid a collision with the temporary support rods 793, 795. The opposing finger assembly, which is used to start a new stack (refer below) is still employed in such an implementation.

Figure 18:
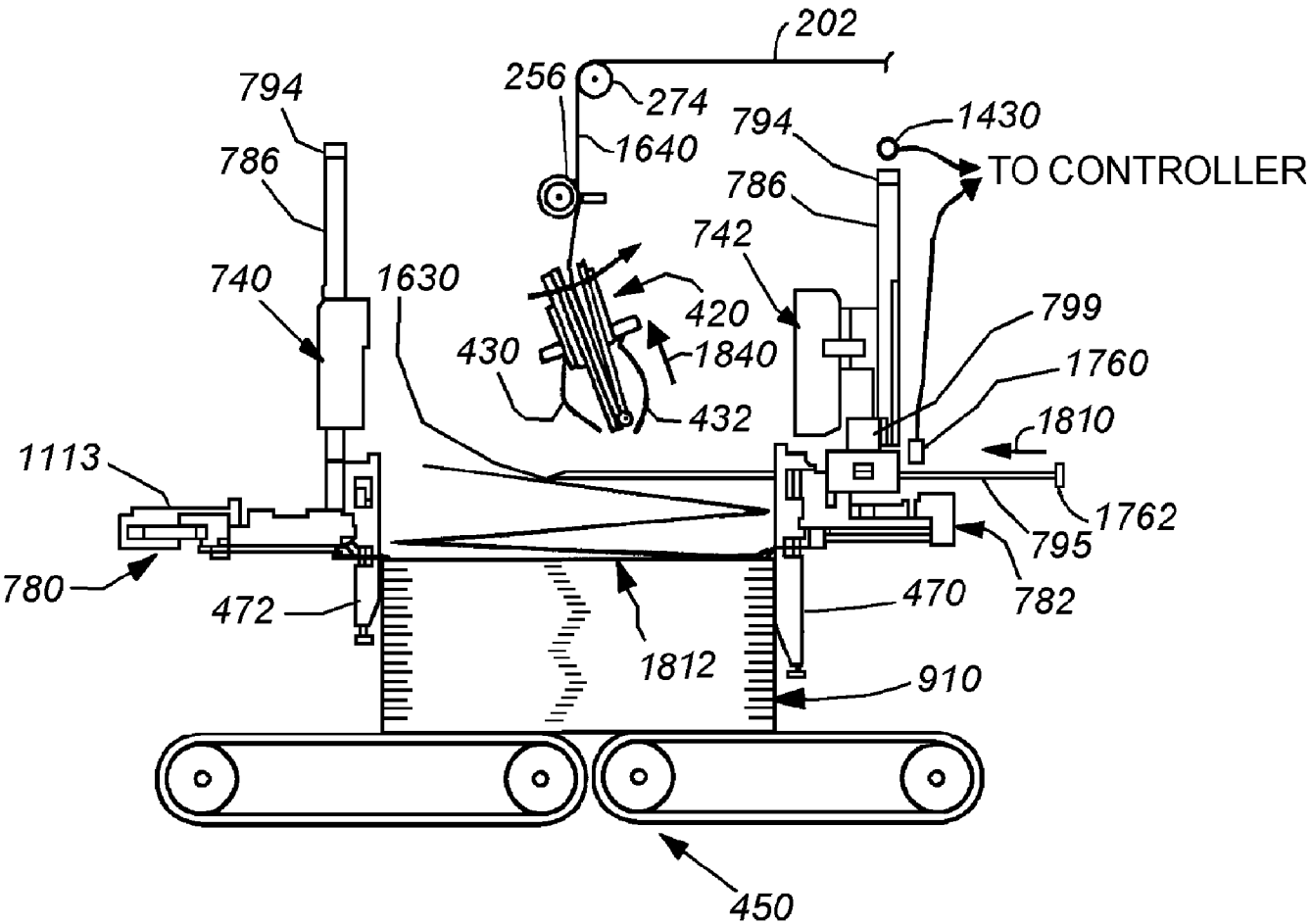
FIG. 18 is a simplified side cross section of the internal components from FIG. 11 showing the completion of the current stack in conjunction with deployment of the temporary support rods to provide a base for the next stack, while the leading edge of the stack is retained in the director chute.

As shown in FIG. 18 the rods 793, 795 have moved (arrow 1810) almost into the stack-forming area, past the front edge guides 430. Meanwhile the trailing sheet 1630 and several upper sheets of the stack 910 are loosely positioned beneath the driven rods 793, 795 at the top of the stack 910. The height between the compressed stack top 1812 and bottom of the temporary support rods 793, 795 is approximately 1 to 2 inches, allowing the rods to pass over the last few topmost sheets of the stack. At this time the leading end 1640 of the web is about to be driven into the stacking area. Note that the extendible finger assembly 432 is retracted at this point in time (arrow 1840).

Figure 19:
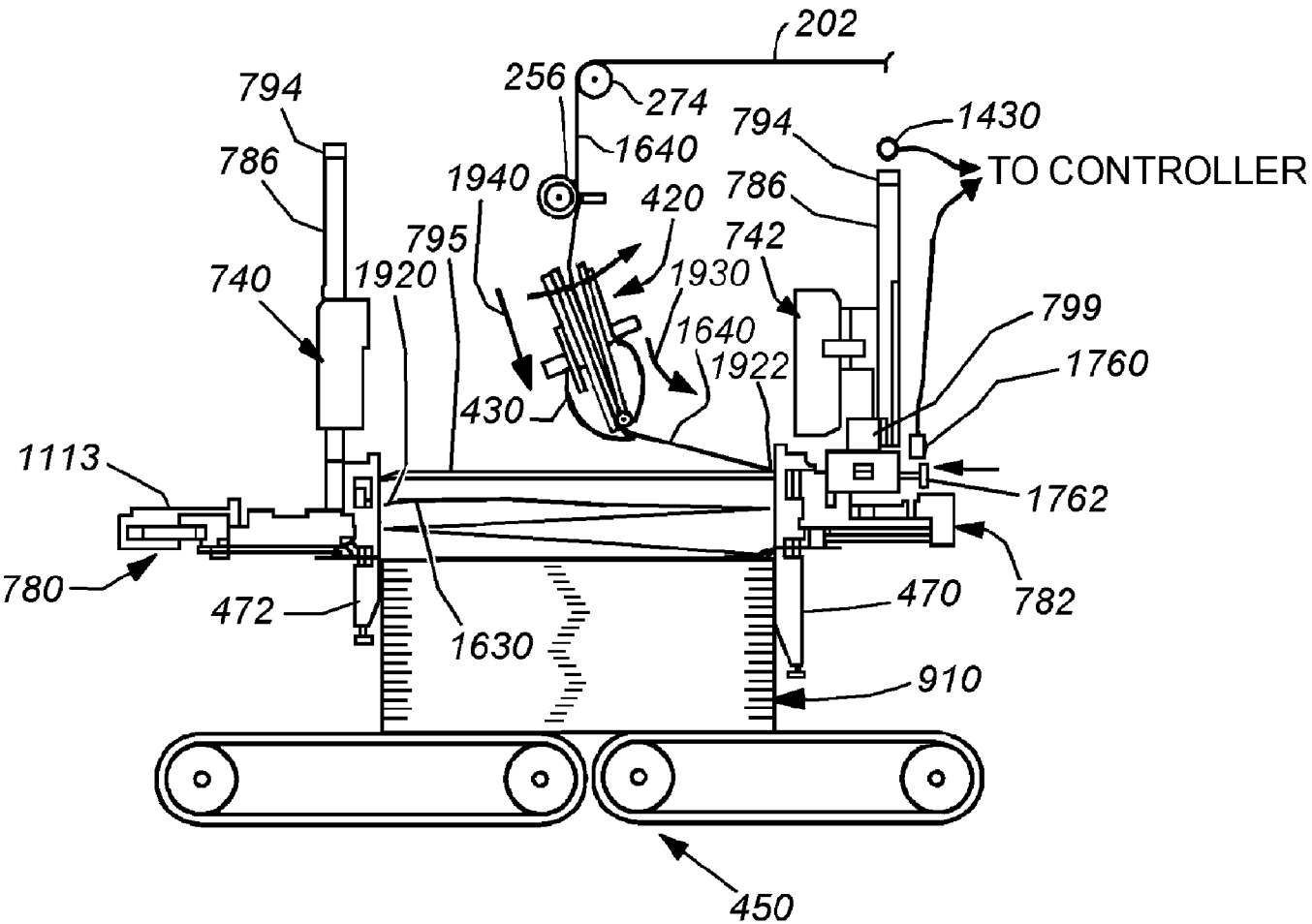
FIG. 19 is a simplified side cross section of the internal components from FIG. 11 showing the completed deployment of the temporary support rods and the driving of the leading edge of the next stack onto the temporary support rods with the assistance of an extended director finger.

Now, in FIG. 19, the rods 793, 795 have fully traversed the folding area and are now ready to support a new stack. The sensors 1760 (or another limiting mechanism) have instructed each rod's motor (799) to stop. Notably, the device is adapted to cause the leading sheet to be directed in either of two initial orientations. The trailing sheet end 1920 is oriented to the front side of the device (left side in FIG. 19). It may be desirable to start the next stack in the opposite orientation. Thus, the device stops the driving motors, allowing the loop 206 to accumulate as the director chute moves to the opposite, rear side (right in FIG. 19) and directs (arrow 1930) the leading end 1922 of the lead sheet 1640 toward the opposite corner, and onto the rods 793, 793. The extendible finger assembly 430 is deployed (arrow 1940) to assist the end 1922 in reaching this corner. This process is termed "skipping a beat," as feeding is skipped for at least one swing of the chute to orient the sheets in an opposing direction. This change in orientation, of course, affects which side of each sheet is on top, and which side is on the bottom of a stack.

Figure 20:
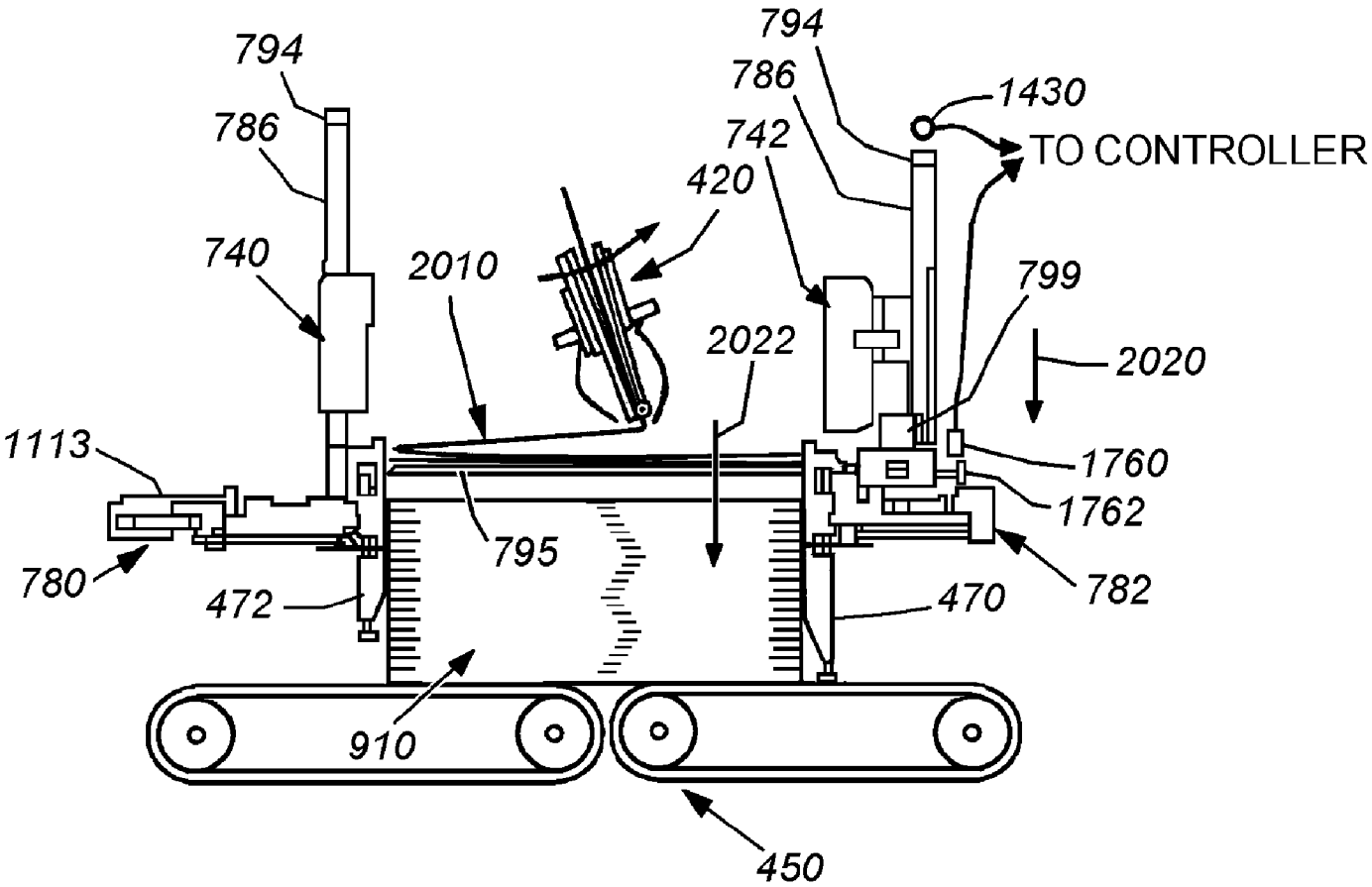
FIG. 20 is a simplified side cross section of the internal components from FIG. 11 showing the completed deployment of the temporary support rods and the continued formation of the new stack on the temporary support rods with the compression fingers retracted out of engagement with the previous, completed stack and the temporary support rods and their associated assembly moving downwardly to briefly "tamp" the completed stack against the temporary support rods.

Referring now to FIG. 20, a new stack 2010 begins to form on the temporary support rods 793, 793 with the director chute 420 and other stacking and folding components moving normally, while the completed stack 910 is ready for transport out of the device. Prior to transport of the completed stack 910, however, the stack is "tamped" to ensure that the top end is square and fully compressed. As such, the rear compression plate assembly 782, which carries the temporary support rods moved downwardly at a maximum rate in response to the motor assembly 796 shown and described above (see FIGS. 7 and 7A that interconnects to the rear carriage assemblies 742, 746 (which are vertically fixed). This motor assembly 796 drives the compression plate assembly 782 downwardly (arrows 2020, 2022) by rotating the above-described lead screws. This brings the temporary support rods into contact with the stack top as shown in FIG. 20. The amount of downward travel can be fixed/preprogrammed or can be limited by upward action of the rear stop 794 and sensor 1430 when the rods begin to compress the stack.

Figure 21:
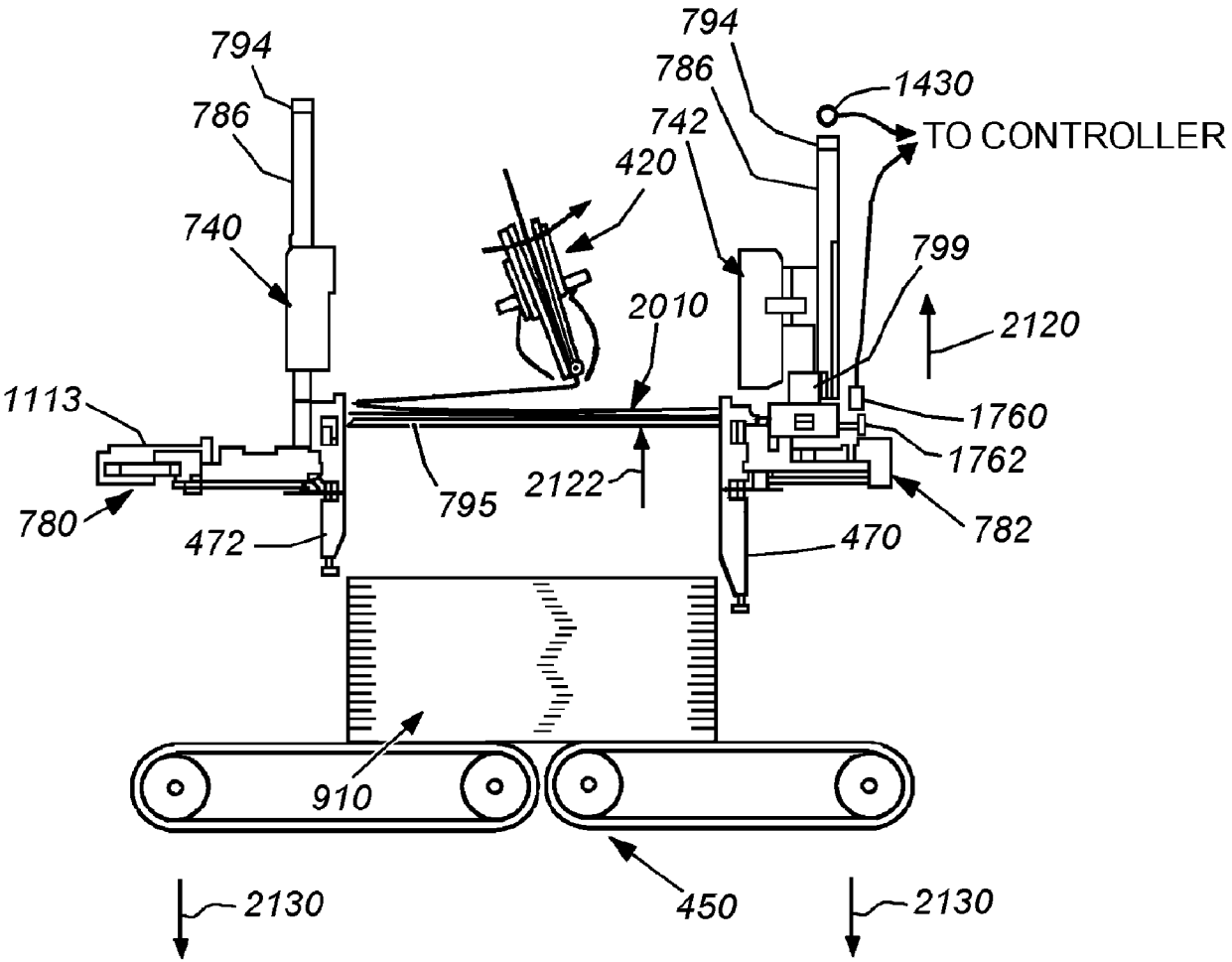
FIG. 21 is a simplified side cross section of the internal components from FIG. 11 showing the continued formation of the new stack on the temporary support rods with the temporary support rods and their associated assembly moving back upwardly a predetermined distance from the tamped position and the supporting mechanism moves downwardly to transport the completed stack to a remote destination.

With reference to FIG. 21, subsequent to the tamping step in FIG. 20, the rear compression plate assembly 782 is moved upwardly (arrows 2120, 2122) as shown to return it to an approximately upper-most position while the stack 2010 continues to form on the temporary support rods. The downward movement during tamping is approximately 3 inches or less, thereby limiting any effect on the formation of the new stack 2010. One or two sheets driven into the stack are slightly deflected as the rods move downwardly to tamp and quickly returned. The new rod position is slightly lower than the upper most position as the motor assembly 796 includes a stepper or encoder that is instructed by the controller 240 to make vertical space for the thickness of the forming stack. The adjustment of rod height can be based upon the number of sheets driven into the stack (based upon the movement of the central drive motor 150 to drive sheets into the stack). Since the completed stack 910 is now tamped, it can begin a downward descent (arrows 2130) toward the cart 180. This descent is controlled by the lifter 190.

Figure 22:
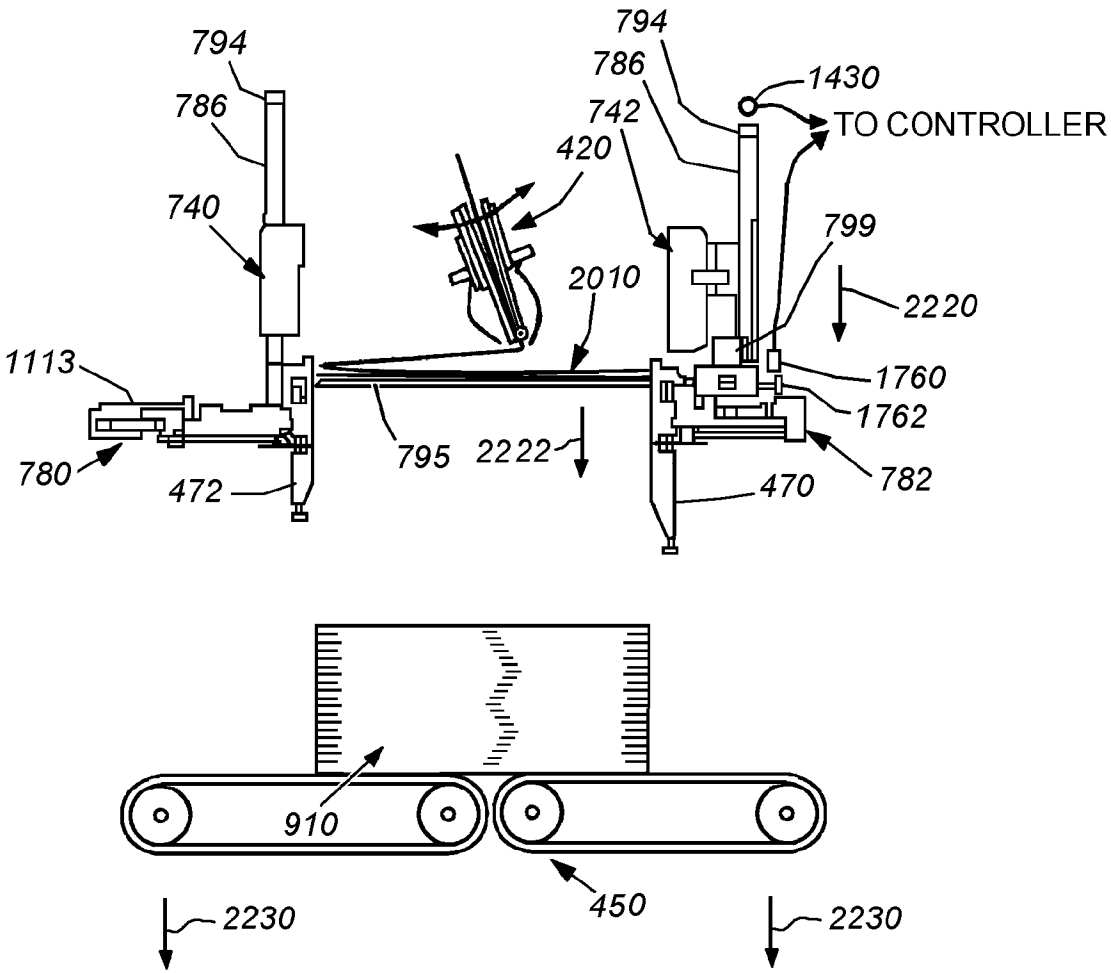
FIG. 22 is a simplified side cross section of the internal components from FIG. 11 showing the continued formation of the new stack on the temporary support rods while the temporary support rods move slowly downwardly to accommodate the growing new stack and the supporting mechanism moves downwardly to transport the completed stack to a remote destination.

As shown further in FIG. 22, the new stack 2010 continues to form on the temporary support rods 793, 795 while the completed stack descends downwardly (arrows 2230) at a maximum rate. The compression plate assembly 782 and rods 793, 795 also continue their slow descent (arrows 2220, 2222) under control of the controller 240 and motor assembly 796 (FIGS. 7 and 7A) to maintain a constant stack top height with respect to the director chute 420 and other fixed height folding and stacking components (e.g. spirals and beaters).

Figure 23:
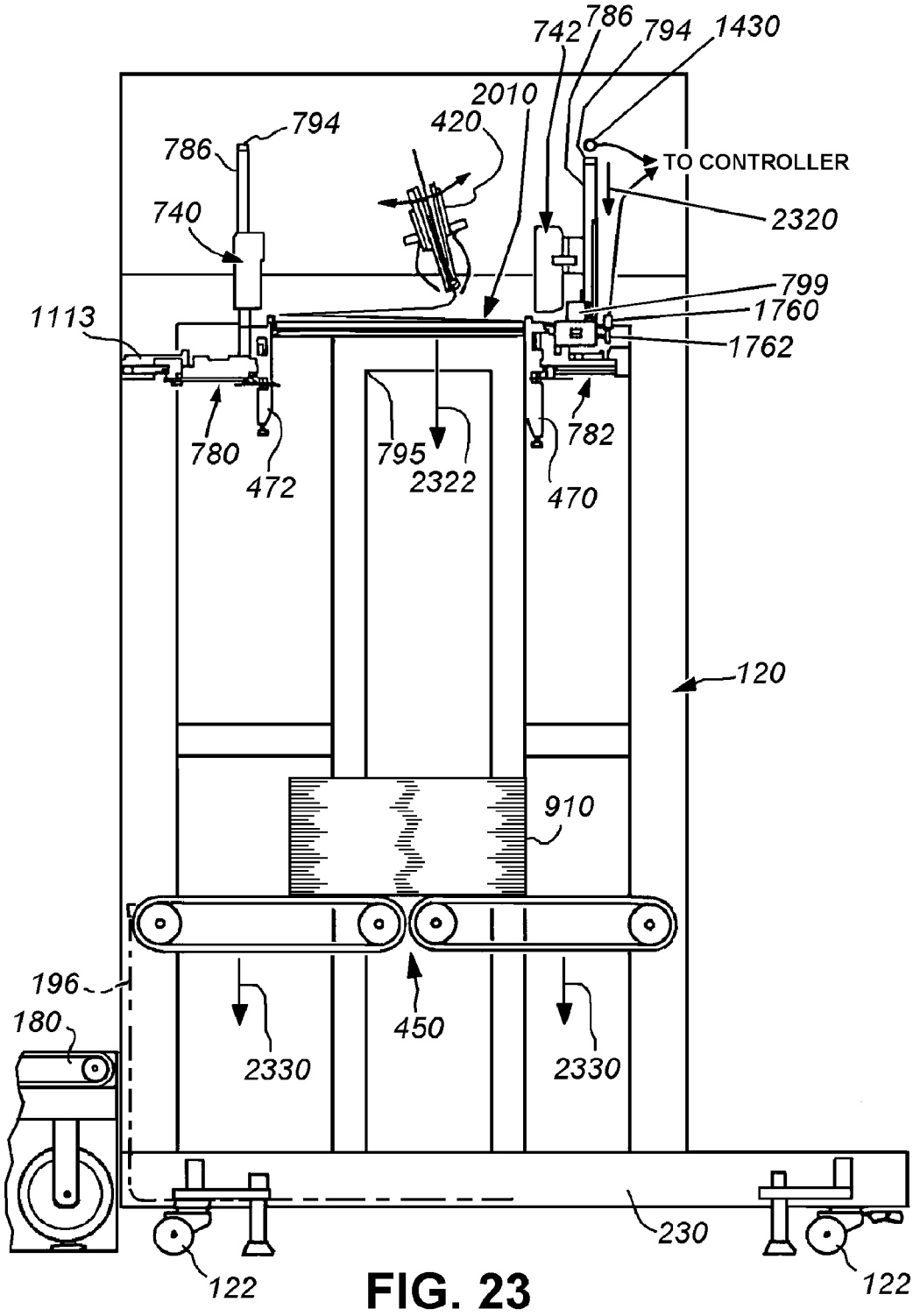
FIG. 23 is a simplified side cross section of the device framework including the internal components from FIG. 11 showing the further continued formation of the new stack on the temporary support rods while the temporary support rods move further downwardly to accommodate the growing new stack and the supporting mechanism moves near to its bottom-most position.

As shown in FIG. 23, the stack 910 has now moved downwardly (arrows 2330) on the supporting mechanism 450 to a position almost in line with the cart. The new stack 2010 continues to form on the temporary support rods 793, 795 while the rods and compression plate assembly 782 continue downward movement at a registered rate (arrows 2320, 2322). Note that the safety gate 196 (shown in phantom) moves around the bottom of the frame base 230 as the attached supporting mechanism 450 descends.

Figure 24:
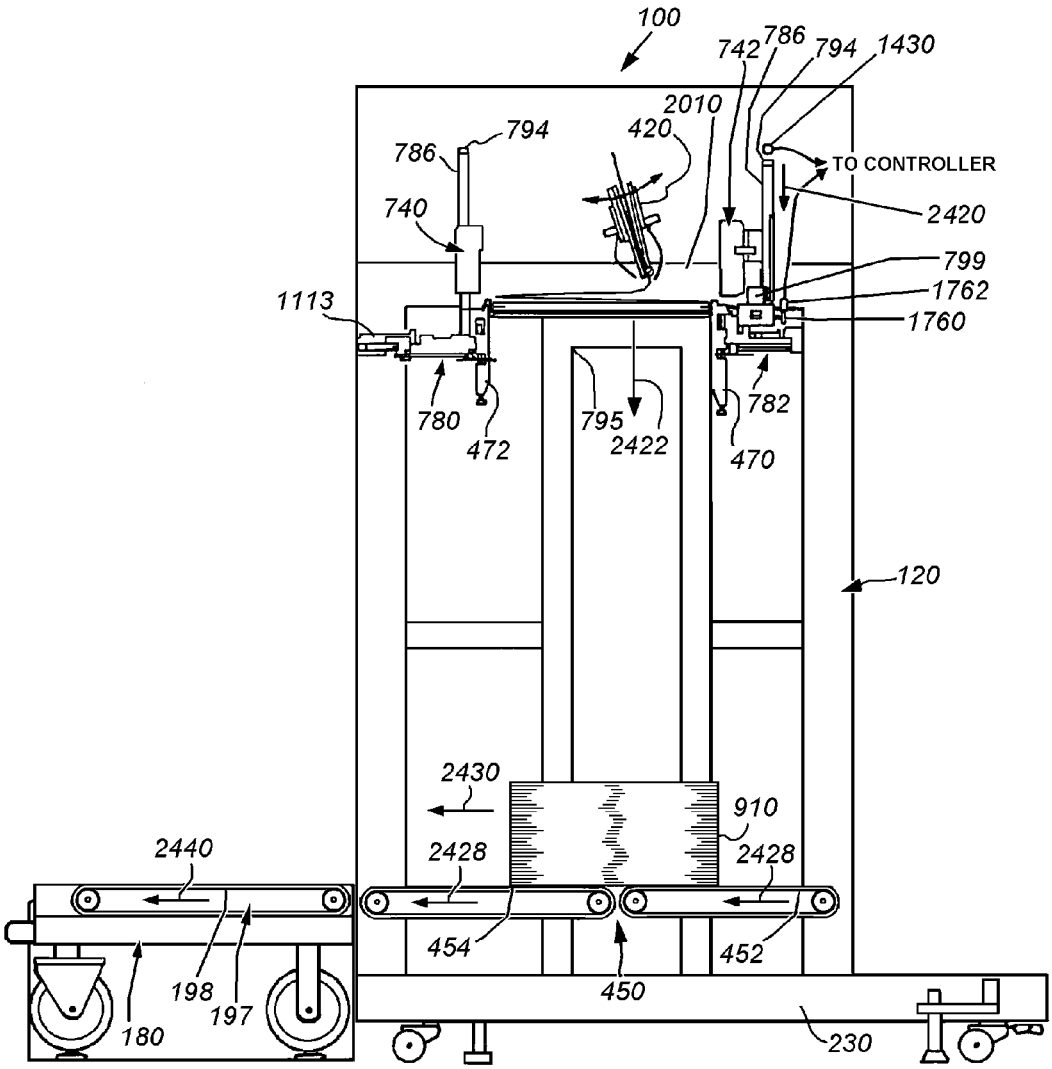
FIG. 24 is a simplified side cross section of the device framework including the internal components from FIG. 11 showing the further continued formation of the new stack on the temporary support rods while the temporary support rods move further downwardly to accommodate the growing new stack and the supporting mechanism arrives its bottom-most position to thereafter convey the completed stack to an adjacent stack cart.

In FIG. 24, the supporting mechanism has reached a bottom-most position with its conveyor belts 452, 454 in line with the top of the cart and the belts 198 of the base-attached transport assembly. The controller instructs the belts 452 and 454 of the supporting mechanism to move (arrows 2428 to thereby transport the completed stack 910 toward the waiting cart 180 (arrow 2430). The belts 198 of the transport system 197 also move (arrow 2440) at the appropriate time to receive the stack 910. Throughout this stack transport operation, the new stack 2010 continues to form on the temporary support rods 793, 795 while the compressor plate assembly 782 with attached rods continues to move downwardly (arrows 2420, 2422) to provided formation clearance for the new stack top.

Figure 25:
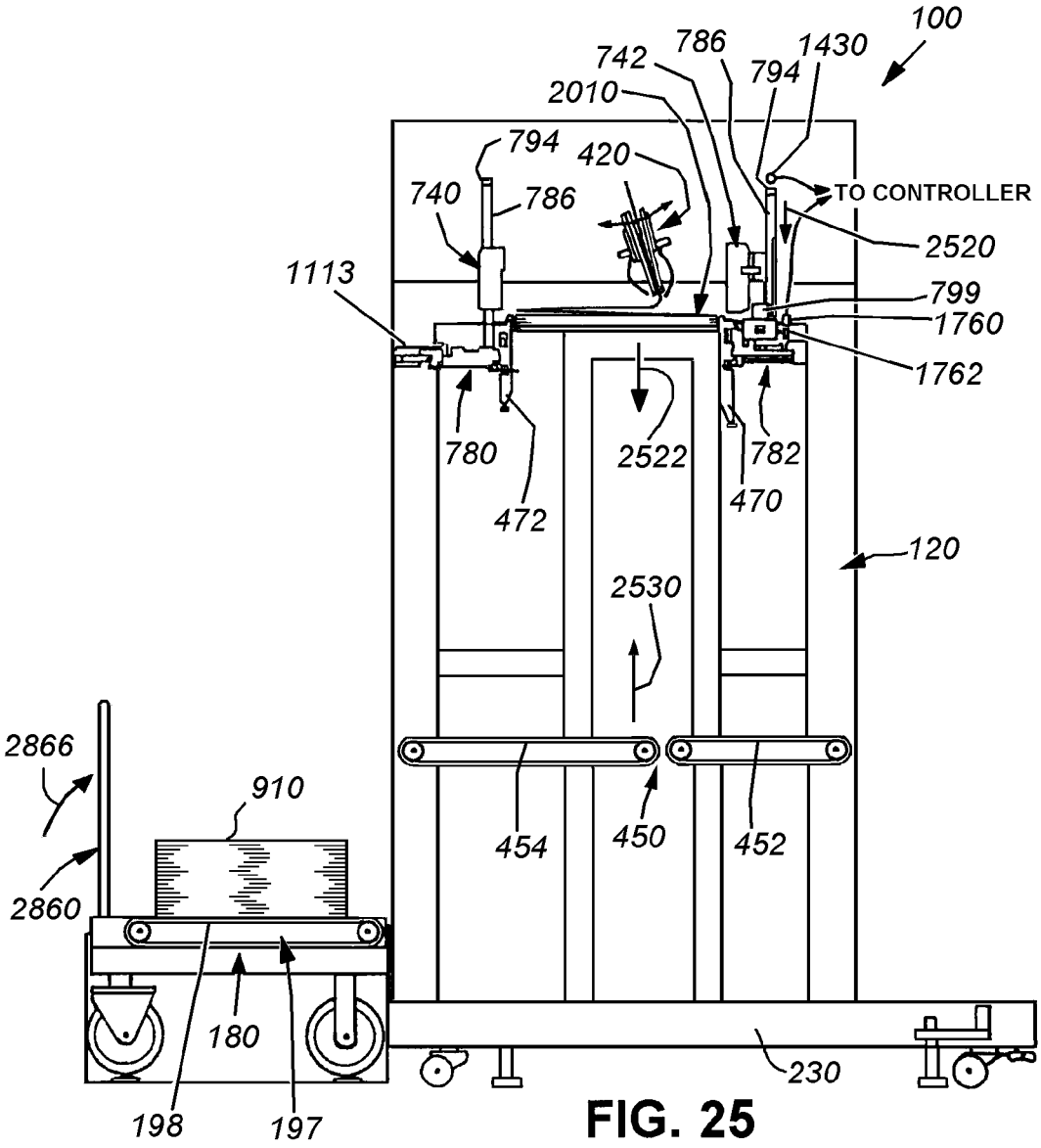
FIG. 25 is a simplified side cross section of the device framework including the internal components from FIG. 11 showing the further continued formation of the new stack on the temporary support rods while the temporary support rods move further downwardly to accommodate the growing new stack and the supporting mechanism drives the completed stack onto an adjacent cart and the empty supporting mechanism moves upwardly toward the temporary support rods.

In FIG. 25, the completed stack 910 has been moved fully onto the adjacent cart 180 under action of the belts 198. In this embodiment, the controller controls belt movement. In an illustrative embodiment, the accurate movement of the stack 910 fully onto the cart 180 is regulated by the controller either by counting pulses from the belt motor (292 in FIG. 2) or by sensing the presence of a stack edge using a sensor (not shown) embedded in the transport system 197 or another component. A variety of well-known techniques for controlling the movement of the stack 910 onto the cart are expressly contemplated. As shown, the supporting mechanism 450 is now being raised (arrow 2530) back toward the folding and stacking components at the top of the device 100 under the power of the lifter. The new stack 2010 continues to form during this time, with the compression plate continuing to move slowly downwardly (arrows 2520, 2522) as described above.

Figure 26:
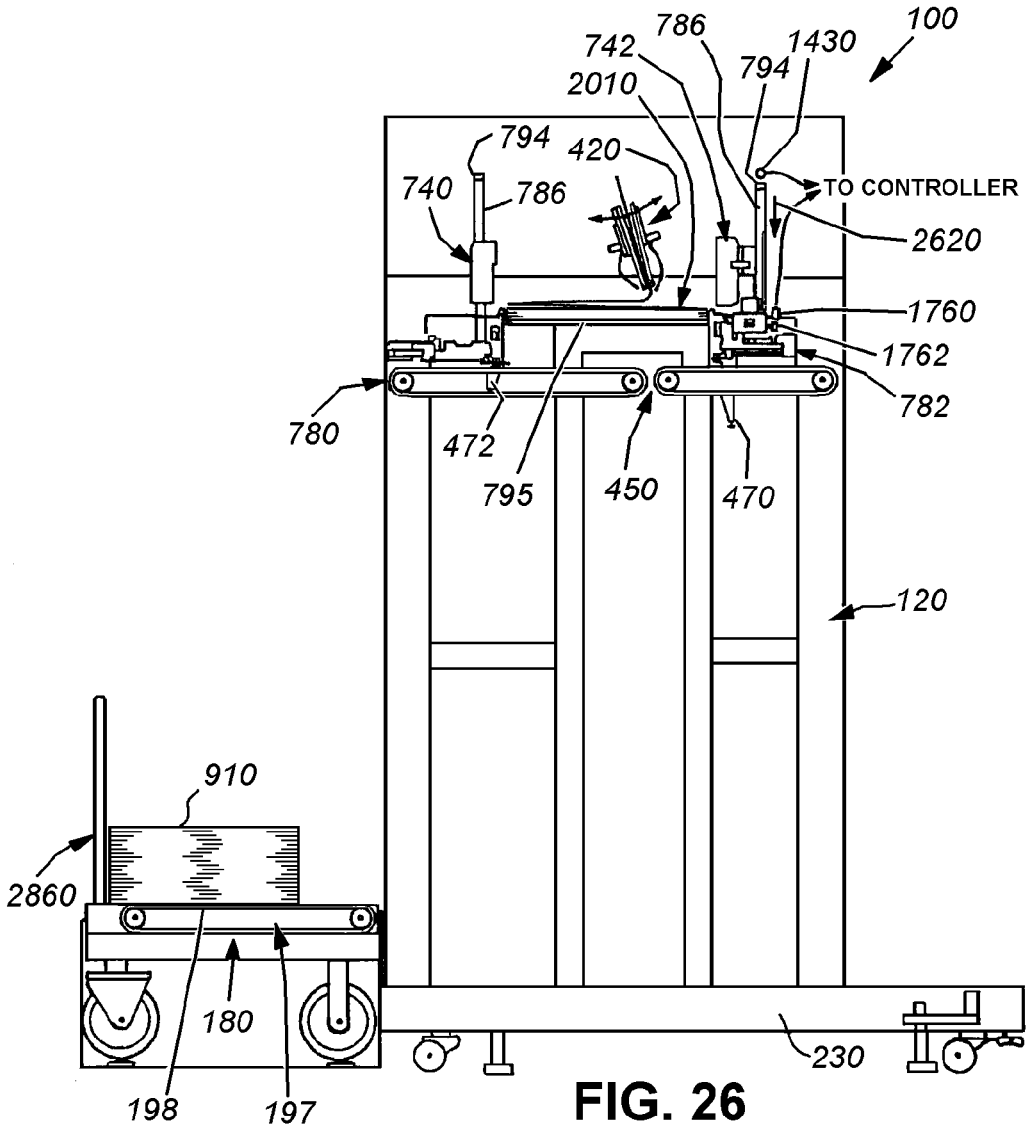
FIG. 26 is a simplified side cross section of the device framework including the internal components from FIG. 11 showing the further continued formation of the new stack on the temporary support rods while the temporary support rods move further downwardly to accommodate the growing new stack and the supporting mechanism has moved upwardly adjacent to the temporary support rods while the completed stack is positioned on the cart with a handle deployed.

In FIG. 26, the supporting mechanism 450 has now reached a predetermined height just beneath the deployed temporary support rods. The compression plate and rods will now cease downward movement (arrows 2620, 2622) as the controller prepares to deposit the new stack 2010 onto the supporting mechanism.

Figure 27:
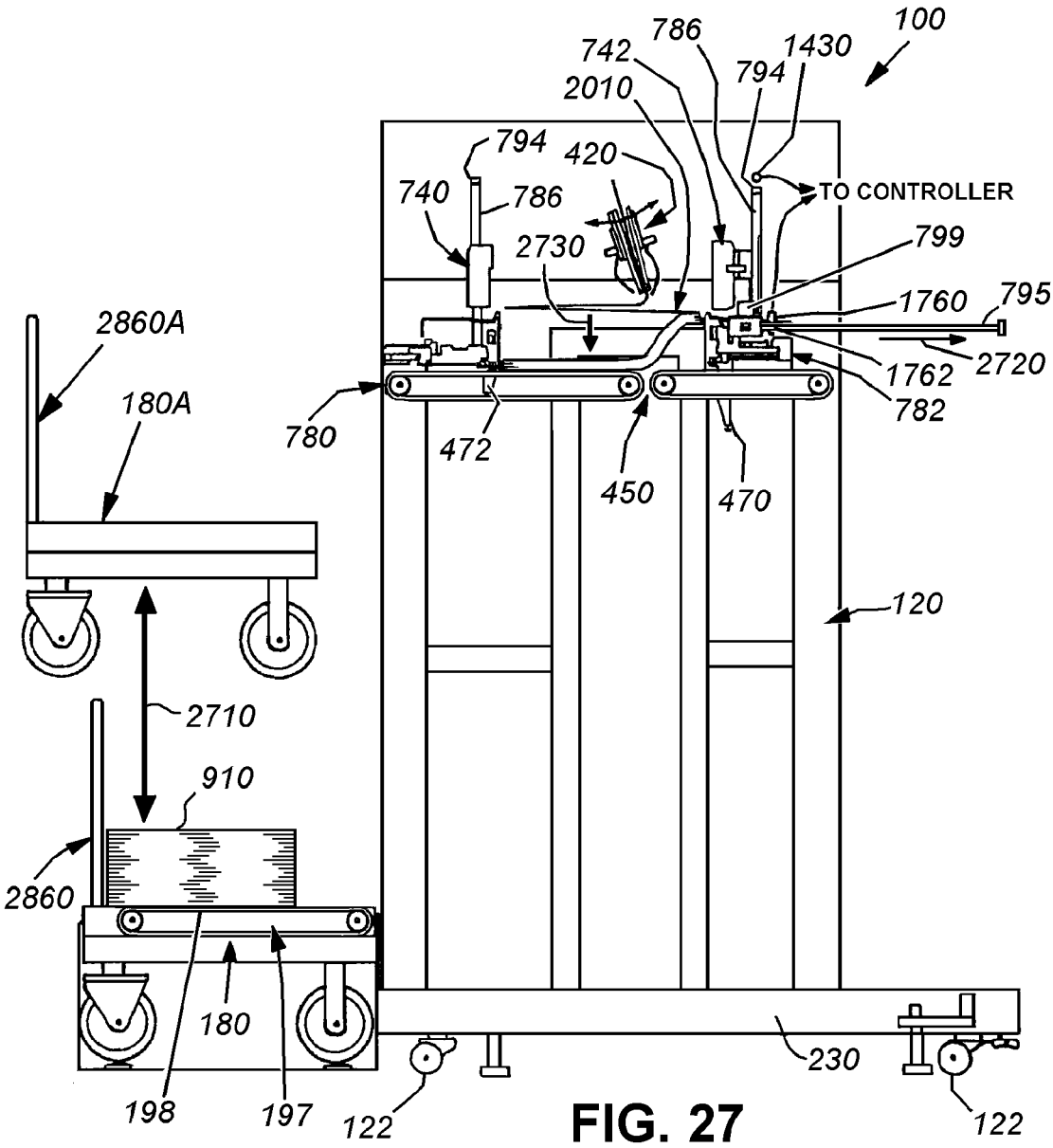
FIG. 27 is a simplified side cross section of the device framework including the internal components from FIG. 11 showing the delivery of the new stack onto the adjacent supporting mechanism by retraction of the temporary support rods while the cart having the completed stack is exchanged for an empty cart that eventually receives the new stack upon its completion.

The transfer of the new stack 2010 is shown in FIG. 27. The controller 240 directs the temporary support rods 793, 795 to move outwardly to a refracted position (arrow 2720). At this time, the new stack 2010 drops (arrow 2730) off the withdrawing rods 793, 795 into the region bounded by the stack supports 470, 472 (and 282), and onto the belts of the supporting mechanism 450. The folding and stacking components continue to produce new folded sheets during this time.

Figure 28:
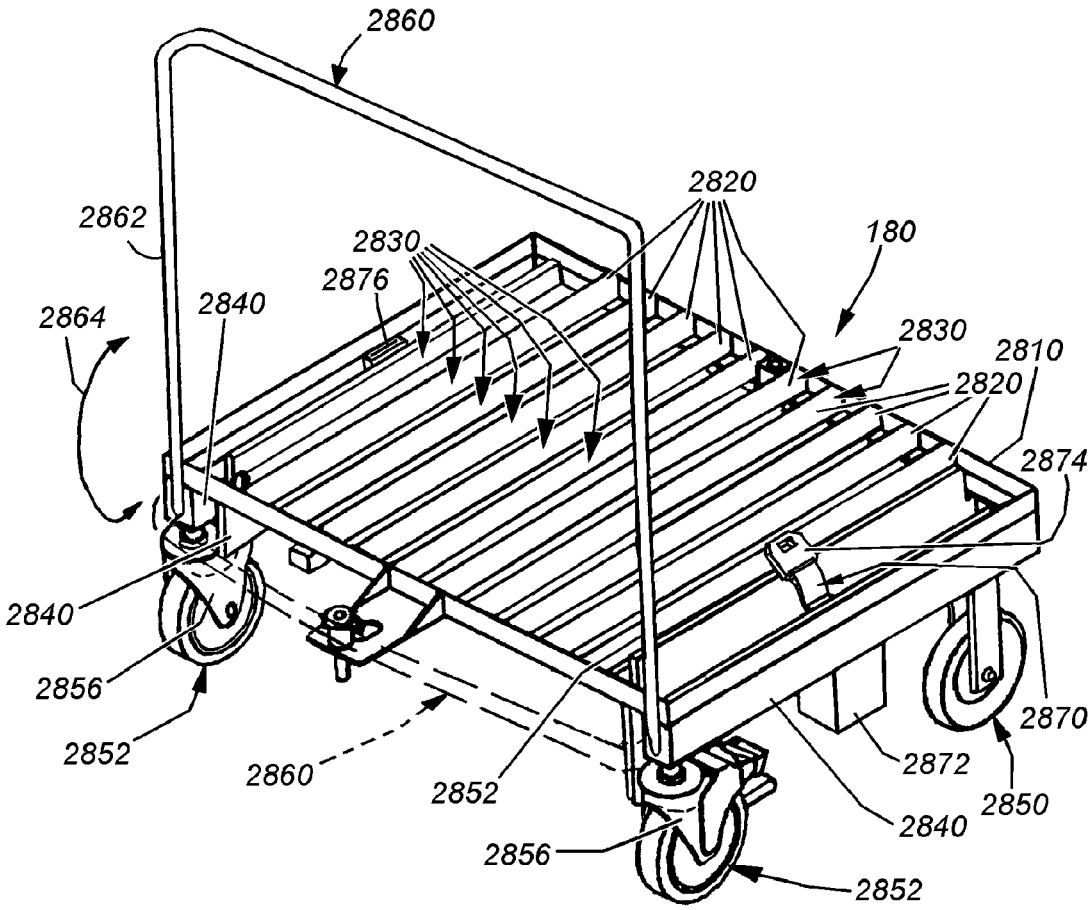
FIG. 28 is a fragmentary perspective view of the cart with handle deployed in a position free of the device's powered conveyor belts that are selectively deployed between stack support ribs.

At some time after the stack 910 is fully deposited on the cart 180, the cart 180 is removed from its position adjacent to the device 100 and moved to a remote location for utilization of the stack in a downstream process. A new cart 180A should be brought into position to receive the new stack 2010 when it is, in turn, completed. The timing of the exchange of carts (double arrow 2710) should occur after a completed stack is fully loaded onto the cart but before the next stack is ready for transport onto another cart. It is desirable that the exchange occur as soon as possible after loading of the cart so that stacking is not unduly interrupted. The exchange is a manual operation, but can be largely automated in alternate embodiments. Before describing removal of the loaded cart 180, the cart structure 180 will be described in further detail. Referring to FIG. 28, the cart 180 consists of a sturdy, rectangular metal frame enclosing a set of parallel ribs that are relatively thin and oriented upright to provide clearance spaces 2830 therebetween. The spaces are sufficient in width to accommodate individual belts of the transport system 197 as shown in FIG. 1. A pair of side beams 2840 support the frame 2810 and attach to four wheels (three are shown) adjacent to each of the four corners of the cart 180. The rearward wheels 2850 are filed while the forward wheels 2852 are mounted on swiveling casters 2856 to provide streerability. The precise layout and number of wheels is highly variable in accordance with alternate embodiments. Likewise the layout of the cart frame and its shape and size are highly variable.

The frame 2810, in this embodiment, includes a coupler for use with a conventional draw bar (not shown). This coupler can be omitted in other embodiments. A retractable handle 2860 is also provided. The handle includes a pair of uprights 2862 that can be withdrawn (double arrow 2864; see also arrow 2866 in FIG. 25) into the open tubular center of each side beam 2840 so as to retract the handle and stow it away (stowed position shown in phantom). An appropriate stop and hinging mechanism is provided at the ends of the uprights 2862 and ends of the side beams 2840 to allow the handle to remain locked at secure in the illustrated upright position. Such a mechanism can include appropriate catches or straps to hold the uprights in place against the side beam ends once raised. The cart also includes a retractable strap that is stored in a reel along one side of the frame 2810. The strap 2870 includes an end piece 2874 that can be secured to a hitch 2876 on the opposing side of the frame 2810. The strap 2870 can be passed around a tall stack to help stabilize it during movement.

Figure 29:
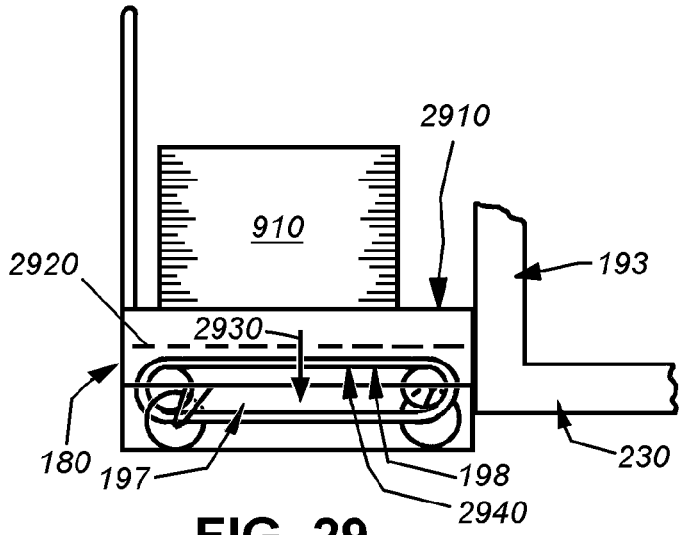
FIG. 29 is a schematic side cross section showing the lowering of the device's powered conveyor belts to allow removal of a docked cart therefrom.
Figure 30:
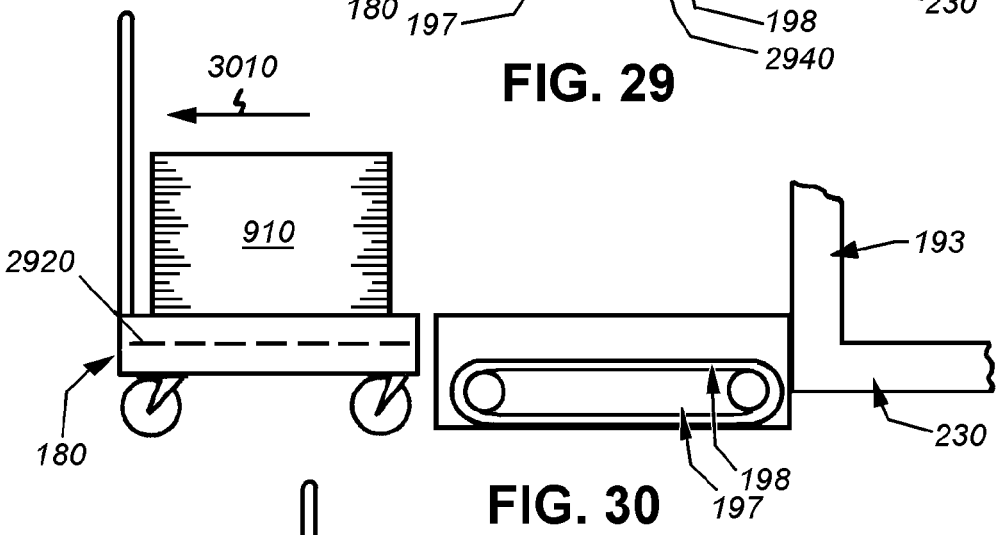
FIG. 30 is a schematic side cross section showing the removal of the cart with completed stack from the device's conveyor belts subsequent to lowering.
Figure 31:
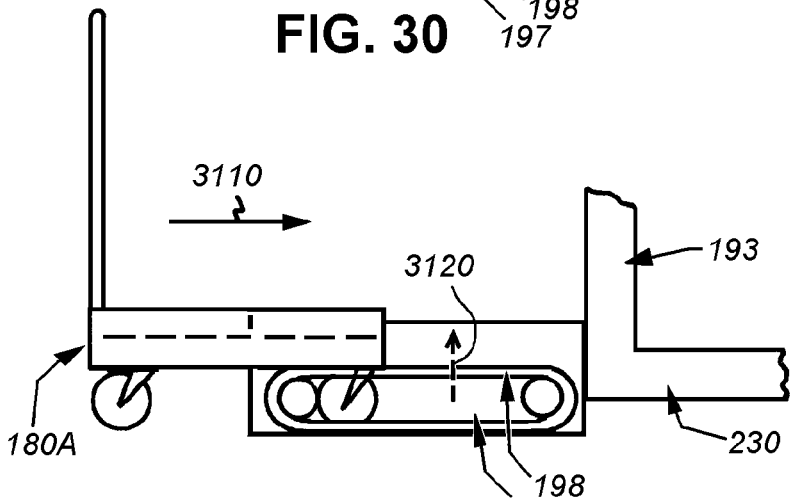
FIG. 31 is a schematic side cross section of the passage of an empty cart onto the lowered device conveyor belts.
Figure 32:
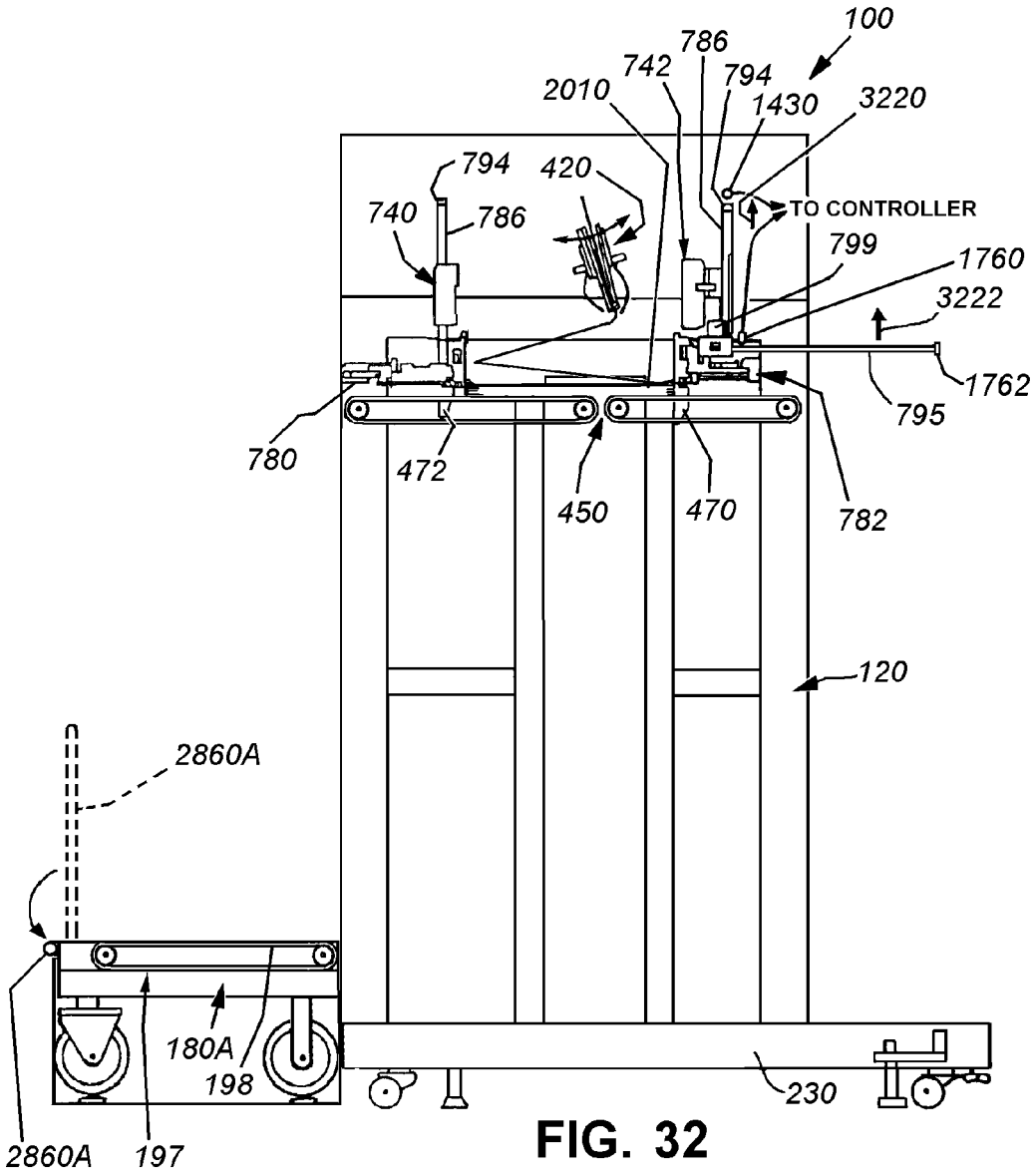
FIG. 32 is a simplified side cross section of the device framework including the internal components from FIG. 11 showing the formation of the new stack on the supporting mechanism subsequent to the retraction of the temporary support rods and movement of the rods and associated components upwardly, while a new empty cart is now in place to eventually receive the new stack upon its completion.

FIGS. 29-32 describe the exchange of carts 180 and 180A in further detail. As shown in FIG. 27, the cart 180 with a completed stack is initially locked in place as the belts 198 of the transport system are in a raised position. This effectively prevents the cart from being undocked from the device because the belts are seated in the gaps 2830 between cart ribs 2820 and captured by the surrounding frame 2810 (see FIG. 28). As shown in FIG. 29, the height of the front and rear frame below the cart top 2910 is represented by a dashed line 2920. Either automatically, upon transport of a completed stack, or under the direction of an operator, the belt lift motor assembly (292 in FIG. 2) is powered to lower (arrow 2930) the belts 198 as a unit. The belts can be lowered sufficiently so that the top side 2940 of the belts 198 reside below the level of the frame front and rear. This provides effective clearance for rolling the cart out of the transport system 197. Hence, as shown in FIG. 30, the cart 180 is backed (arrow) out of the transport system 197. While the belts remain lowered the new, empty cart 180A is moved (arrow 3110) onto the transport system in alignment with the device frame base 230 as shown in FIG. 31. A variety of tracks, rails and alignment keys can be employed to ensure that the cart is properly positioned. In this manner, the belts can be powered to raise (dashed arrow 3120) the belts 198 between the cart ribs 2820. The new cart 180A is positioned and ready to receive the new stack as shown in FIG. 32.

With further reference to FIG. 32, the completed stack (910) has been removed on cart 180 and new cart 180A is in place. The temporary support rods 793, 795 are now fully withdrawn and the supporting mechanism is located to receive the growing stack. The lowered rear compression plate 782, which carries the rods 793, 795, is now moved upwardly (arrows 3220, 3222) from a lowered position that was used to provide clearance for the growing stack to a fully raised position. This lifting of the plate 782 occurs using the above-described motor and lead screw assembly 796 (FIGS. 7 and 7A). After the rear compression plate is raised the new stack 2010 continues to form, with the supporting mechanism alternating between continued lowering to accommodate the growing stack and raising to compress the stack as described above (see the sequence of actions detailed, for example, in FIGS. 9-15).

D. Web Thread-Up Procedure

Figure 33:
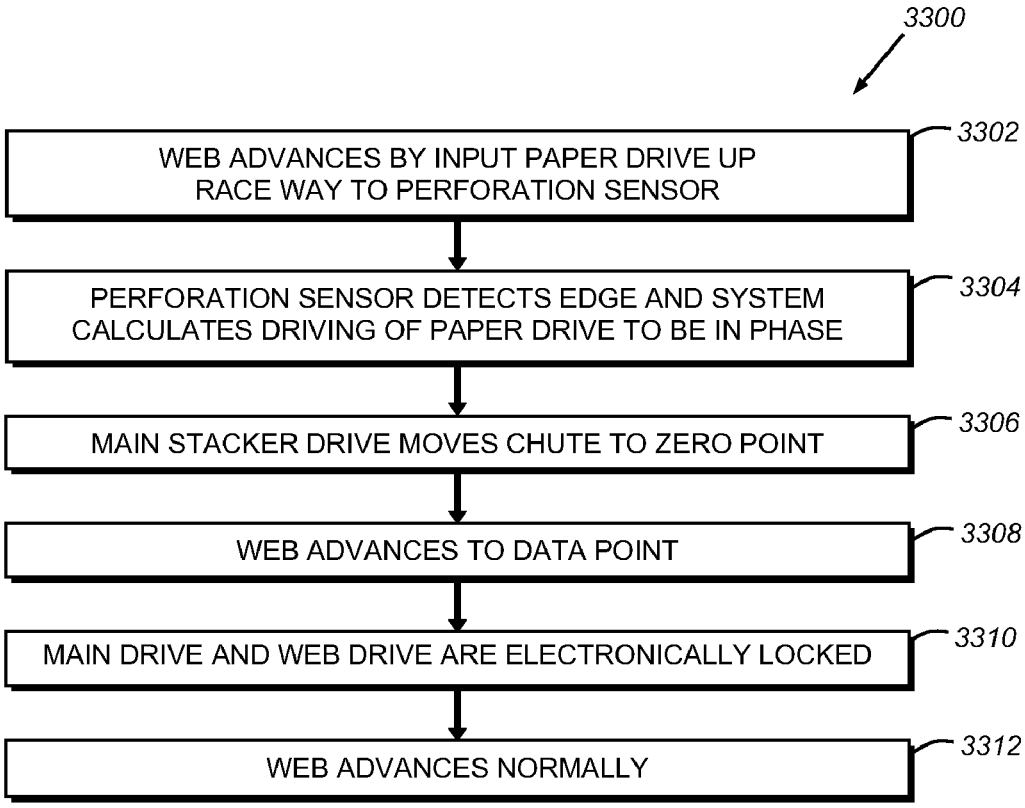
FIG. 33 is a flow diagram of a procedure for delivering a top of new web form to the device with desired registration.

FIG. 33 is a flow diagram of an exemplary procedure 3300 for thread-up of a web having a leading end in the device. The device must be able to synchronize feeding of web with the folding components to ensure that the cutter, director chute and beaters act upon proper fold lines. Since the folding/cutting components' central (main) drive motor (150 in FIG. 1) and the web feed drive (250 in FIG. 2) can operate independently, this procedure 3300 allows them to be synchronized. During thread-up, a web is driven up the ramp by the feed drive 250 (see FIG. 2) until the leading edge is detected by the mark/perforation sensor 252 and/or the top of form sensor 272 (step 3302). The controller marks the event and calculates the present position of the central drive motor 150 versus the web leading edge (step 3304). The central drive motor then moves the director chute and interconnected folding elements to a known "zero point" (step 3306). The web then advances a predetermined number of pulses (calculated by from the drive 250) to a data point that is known (step 3308). The main drive 150 and the web drive 250 are now "electronically locked" in that a given movement of the main drive is tied to a predetermined movement of the web drive 250 (step 3310). The controller 240 tracks the pulses of each unit and maintains a known ratio of one to the other as the web advances normally (step 3312). The synchronization assures that the fold lines correspond with the appropriate position of the cutter, chute and beaters. After synchronizing the drives, registration of the web versus the cutting/folding components is maintained by tracking marks or perforation, and advancing or retarding the web drive, as described above.

E. Director Chute Adjustment

Figure 34:
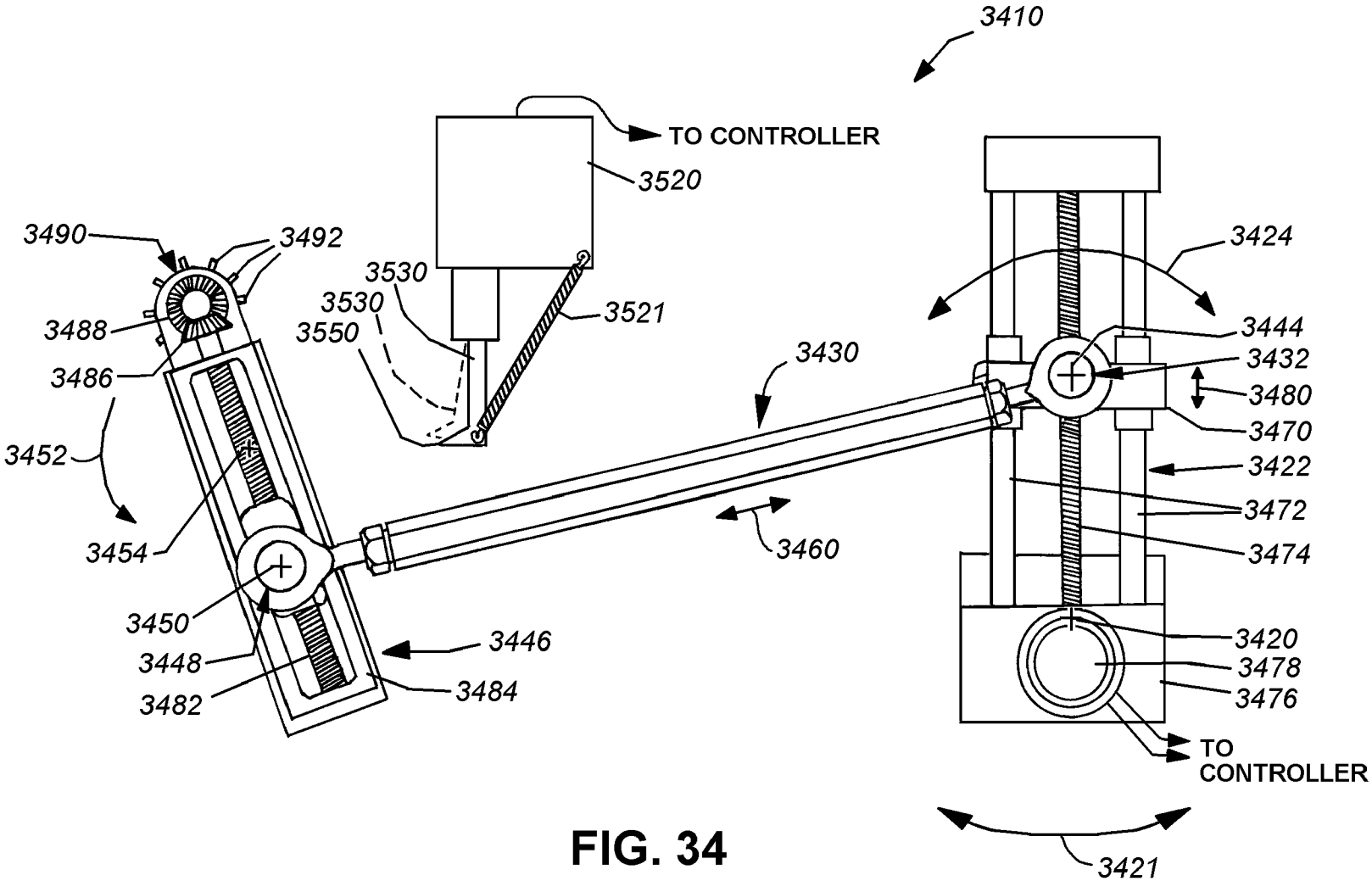
FIG. 34 is a fragmentary side view of a mechanism for adjusting the director chute to accommodate differing length forms in the device according to an embodiment of this invention.
Figure 35:
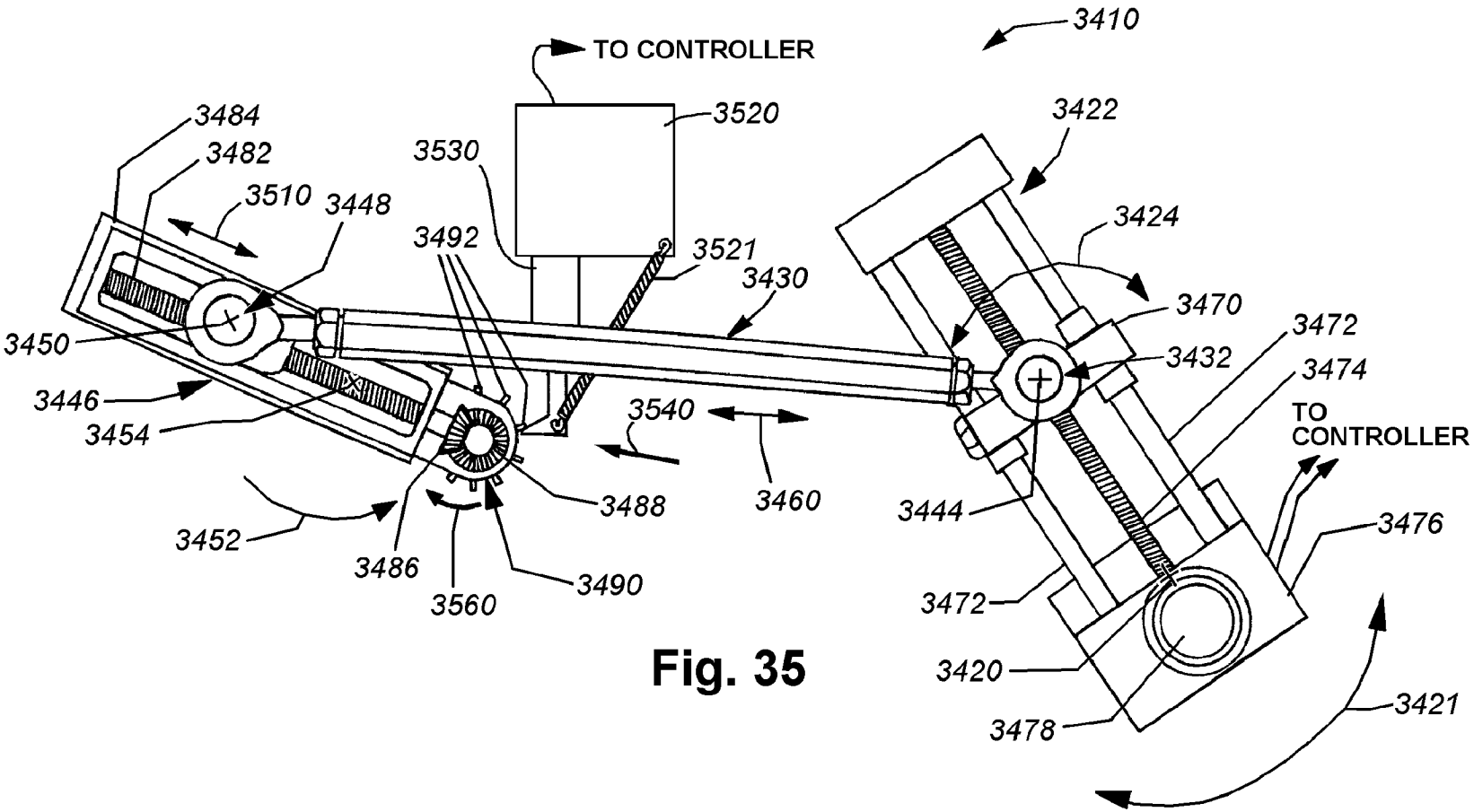
FIG. 35 is a fragmentary side view of a mechanism of FIG. 34 detailing the adjustment of the chute swing position by activation of a ratchet and pawl system.

The adjustment of components to accommodate folded sheets of differing widths and lengths is accomplished by driving pairs of orthogonal lead screws 710, 712 as described above. The adjustment for front-to-rear form length requires the beaters and spirals to move toward and away from each other as appropriate. The director chute 420 is also adjusted so that its swing arc is shortened or lengthened as appropriate to match the form length selected by the operator. FIGS. 34 and 35 detail the director chute adjustment mechanism 3410, which resides on the exterior of the device frame as illustrated in FIG. 1. The director chute is moved in a reciprocal swinging (pendulum) motion (double arrow 3421) via an axle that is aligned along an axis 3420. The axle is interconnected to a lever arm 3422. The lever arm 3422 is driven in a reciprocal motion (double arrow 3424) by a fixed-length connecting rod 3430. The connecting rod 3430 is interconnected to the lever arm 3422 by a first pivot member 3432 aligned about an axis 3444. The connecting rod 3430 is interconnected at its opposite end to a rotating drive arm 3446 at a second pivot member 3448 aligned on an axis 3450. The drive arm 3446 is driven by the central drive motor 150, through appropriate power transmission, in a single rotational direction (arrow 3452). The drive arm 3446 is connected to the power transmission at an axis 3454 that is radially separated from the connecting rod's pivot axis 3450. Thus, the unidirectional drive of the drive arm 3446 is translated into reciprocating linear motion (double arrow 3460) in the connecting rod. The connecting rod thereby drives the pendulum motion of the lever arm 3422, and thus, the director chute.

To adjust the distance of the chute swing arc is accomplished by moving the two connecting rod pivot axes 3444 and 3450. The first pivot member 3432 includes a slide block 3470 that travels on a pair of rails 3472 that are part of the lever arm 3422. A central, first rotating lead screw 3474 drives a threaded nut embedded in the block 3470. The screw 3474 is driven by a gear box 3476 operatively connected to a motor 3478. The motor can include an encoder or stepper function, and is controlled by the controller 240. The motor 3478 rotates a predetermined distance to provide radial adjustment (double arrow 3480) to the first pivot assembly 3432 with respect to the chute axis 3420. Changing the position of the first pivot 3470 will change the swing arc distance. However, taken alone, it will also cause the chute to swing off-center. To re-center the chute, the second pivot member 3448 rides along slide frame 3484 and is engaged by a second rotating lead screw 3482. Referring to FIG. 35, the second rotating lead screw 3482 is connected to a bevel gear 3486 that engages an orthogonal bevel gear 3488. The bevel gear 3488 is interconnected to a wheel 3490 having a plurality or radially directed posts 3492 disposed at even arc distances about the wheel 3490. The wheel is movably restrained at fixed rotational positions that conform to each post by a spring-loaded ball-detent system or other indexing mechanism. In other words, the wheel can be rotated under predetermined force, but tends to become seated at a given index position once moved. As the wheel 3490 is indexed, it rotates the lead screw 3482 to thereby radially move the second pivot member (double arrow 3510) with respect to the drive axis 3454. The adjustment of the second pivot member allows the centering of the director chute to be restored for any given adjustment in swing arc length. The controller must combine the adjustments of each pivot member 3432 and 3448 to achieve the proper centering and swing arc distance. In general the controller may rely upon values stored in a look up table (or upon another mathematical operation) to provide the appropriate adjustment factors to each pivot member for a given form length.

The second pivot member 3448 is radially adjusted according to a novel indexing system. While a motor, such as the lever arm motor can be employed in alternate embodiments, size limitations render an indexer approach desirable. A solenoid 3520 interconnected with the controller drives a spring-loaded (spring 3520) pawl 3530. The pawl 3530 is normally biased by the spring 3520 into a non-interfering relation with the wheel 3490 (shown in FIG. 34). When the solenoid is energized, the pawl moves (arrow 3540) toward the wheel 3490 (shown in FIG. 35 and in phantom in FIG. 34). The pawl tip 3550 is located so, when that it is engaged, that it causes the wheel to rotate or index (arrow 3560) by one post for each revolution of the drive lever 3446. In this manner rotation of the main drive can be used to adjust the radial position of the second pivot member 3448 by selectively applying the pawl 3530. Since adjustment is typically performed before thread-up, when form length is set by the operator, the controller can instruct the main drive (and thus, the drive lever) to rotate in either direction. This allows the second pivot member to be moved radially either toward or away from the drive axis 3454.

F. Stack Inverter

Figure 36:
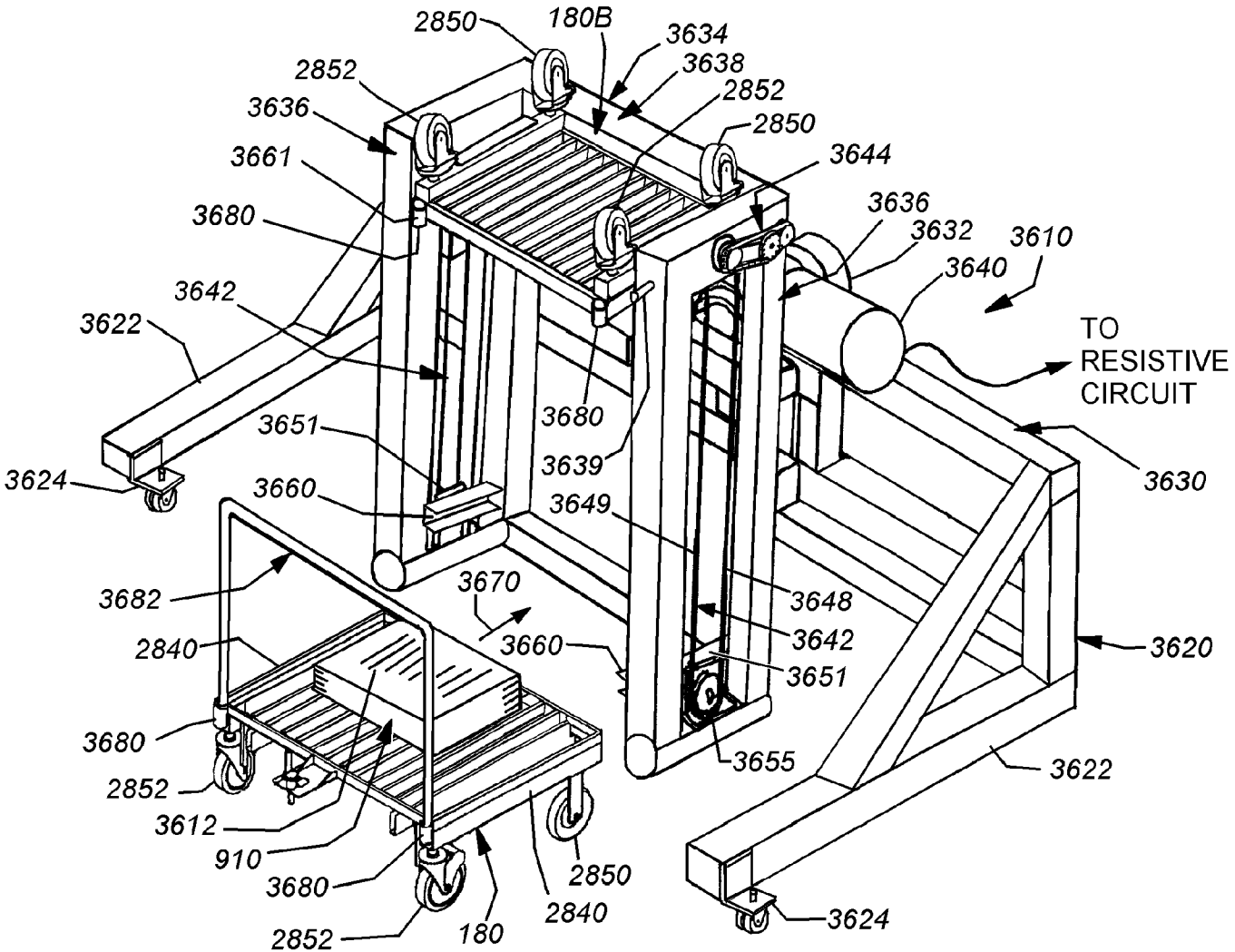
FIG. 36 is a perspective view of a device for inverting stacks delivered on carts in accordance with an embodiment of this invention showing the movement of a new stack into the device for inversion.
Figure 36A:
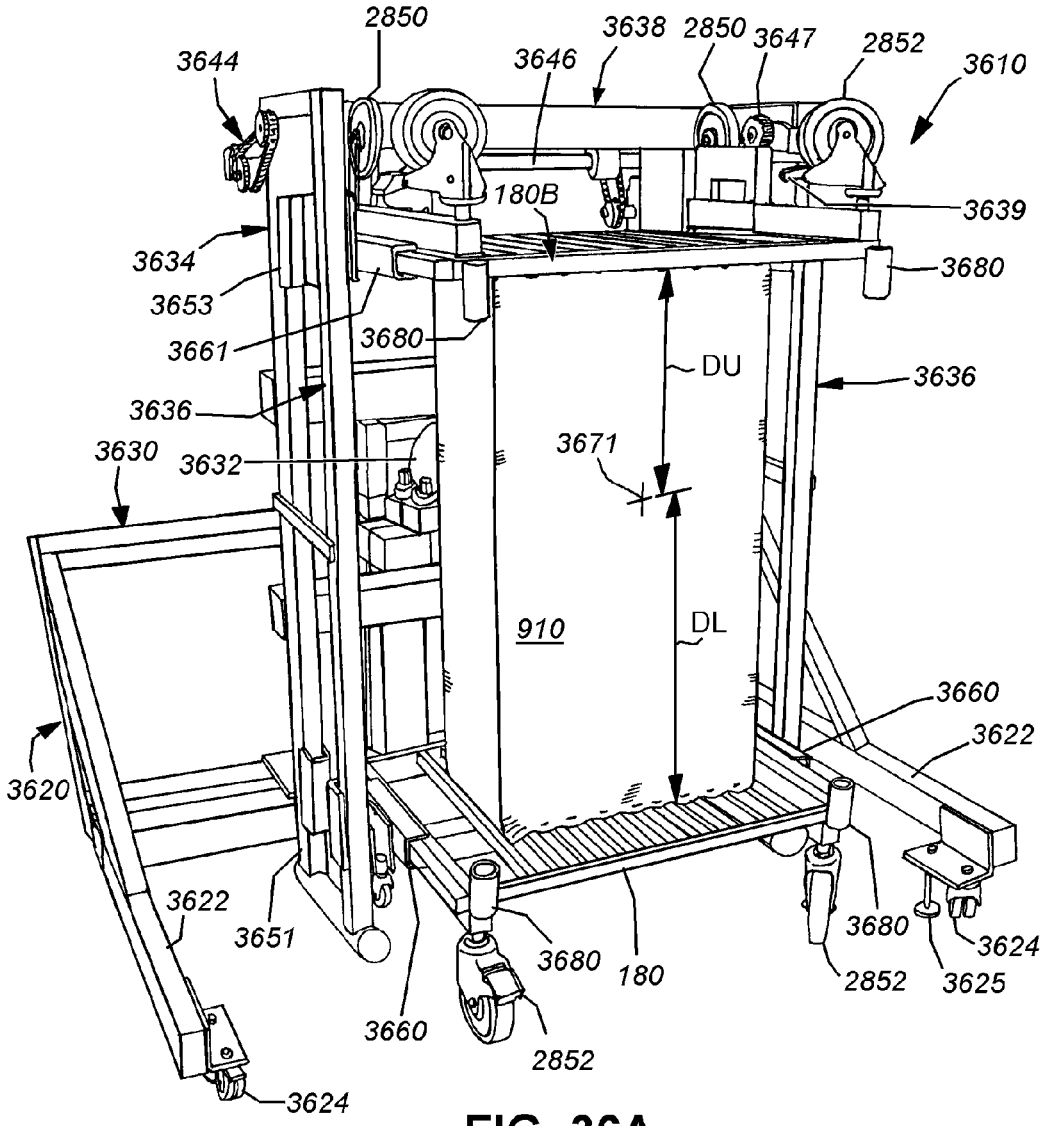
FIG. 36A is a perspective view of the device for inverting stacks of FIG. 36 showing the movement loading of the stack by movement of top and bottom carts together.

It is often desirable to reverse the stacking direction of a large stack of folded web so that the page order of sheets is inverted. For example, inversion of a stack may be desirable to facilitate the feeding or merging of jobs together—particularly where two merged job ends must both be present at the tops of their respective stacks to be accessed and joined together. However, turning over a large stack of web, weighing several hundred pounds can prove difficult. FIGS. 36 and 36A detail a stack inverter 3610 according to an embodiment of this invention. In this example the inverter 3610 is being presented with the cart 180 (FIG. 36) containing the finished stack 910. The top sheet 3612 of the stack contains printing that the user desires to be located at the bottom of the stack, instead.

The inverter 3610 comprises a frame 3620 having a pair of widely spaced, parallel base legs 3622 that are open on the front, cart-loading side. In this embodiment, the base includes wheels or casters 3624 at the frame corners for enhanced portability. The base 3620 can also (or alternately) include fixed pads 3625 (FIG. 36A) for where and when a fixed, stationary position is desired. The rear of the frame 3620 includes an upright cross beam assembly 3630 from which is mounted a pivot assembly 3632. The pivot assembly supports the stack-holding framework 3634. This framework 3634 consists of a parallel pair of box frames 3636 that project outwardly from a rear frame 3638. The rear frame 3638 is attached at an approximate centroid to the pivot assembly 3632. The pivot assembly 3632 allows the framework 3634 to be rotated thereabout manually by grasping the depicted handle 3639 that projects from the front top of framework 3634.

While the framework is relatively balanced about the centroidal/rotational axis, the inertia of the frame and a loaded stack can cause the framework to be difficult to stop once rotation has begun. A geared motor 3640 is operatively connected to the pivot via appropriate chains, belts and the like. The motor rotates at an increased multiple relative to the rotation of the framework 3634. The motor leads are interconnected with a resistive circuit that is tuned to apply resistance to the current generated by the motor's rotation. In this manner, the motor acts as an electrically powered rotational damper. Mechanical dampers can be applied in alternate embodiments. In further embodiments, rotation can be effected by a powered motor that either assists or takes over for the manual rotating operation described above.

The framework's box frames 3636 each include a chain lifter assembly 3642 similar in construction to the lifter 190 of the device 100. The lifter 3642 is powered by an appropriate motor (not shown) and transmission. The transmission comprises a pair chain drives 3644 that interconnect to each upper lifter chain sprocket 3647 and are tied to a common shaft 3464 that runs behind the framework 3634, and that allows the lifter motor to drive both lifters 3642 concurrently. The opposing chains 3648, 3649 of each lifter 3642 move a respective slide base 3652, 3653. The slide bases 3651 and 3653 roll between uprights of the side box frames 3636. As the lifter chains move, the bases are translated either toward or away from each other, depending upon the direction of end sprocket (3647 and 3655) rotation. Each slide base 3651, 3653 carries a respective channel bracket 3660, 3661. The channel brackets move between positions at the bottom and top of the framework and a position near the pivot/centroid 3632. Hence, the brackets 3660, 3661 move evenly toward and away from each other with respect to the pivot point 3632, ensuring that balance is maintained regardless of bracket position.

As shown in FIG. 36, the channel brackets are sized and arranged to capture the side frames 2850 of the cart 180. The brackets 3660 are lowered so as to meet the cart and allow it and its stack to be slid into the framework. A loaded cart is shown in FIG. 36A. The upper brackets are provided with an upside-down (inverted) cart 180B. By moving the lifter after the cart 180 and stack 910 are loaded, he inverted cart moves downwardly into contact with the top of the stack, while the lower cart 180 and stack 910 move upwardly an equal amount. The resulting engaged stack is pressed between the carts and the cart wheels 2852 and 2850 are raised out of contact with the floor. The stack is balanced with respect to the centroid axis 3671 with the distance DU between the stack top and centroid equaling the distance DL between the stack bottom and the centroid. In this manner the framework is relatively easy to rotate by grasping and pulling the handle 3639.

Note that the cart 180 of this embodiment is modified to include a pair of sockets 3680 for receiving a removable handle 3682. This differs from the hinged handle 2860 described above. The handle 3680 can be adapted to stow away in the tubular openings of the cart side frames as described above.

Figure 37A:
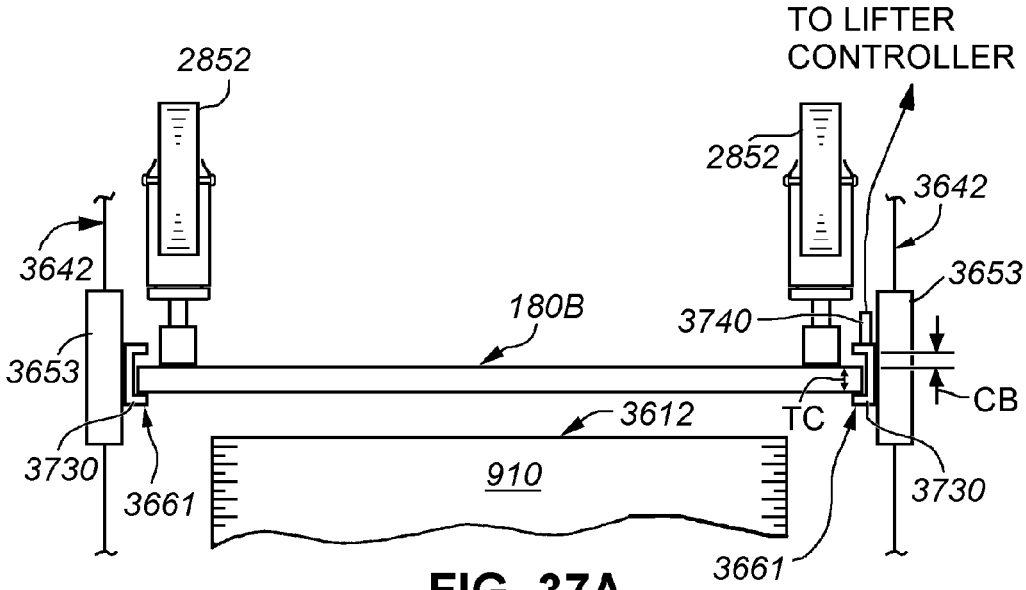
FIG. 37A is a fragmentary front view of the upper cart support assembly for the inverting device of FIG. 36 showing the position of the cart within the supporting brackets before stack compression.
Figure 37B:
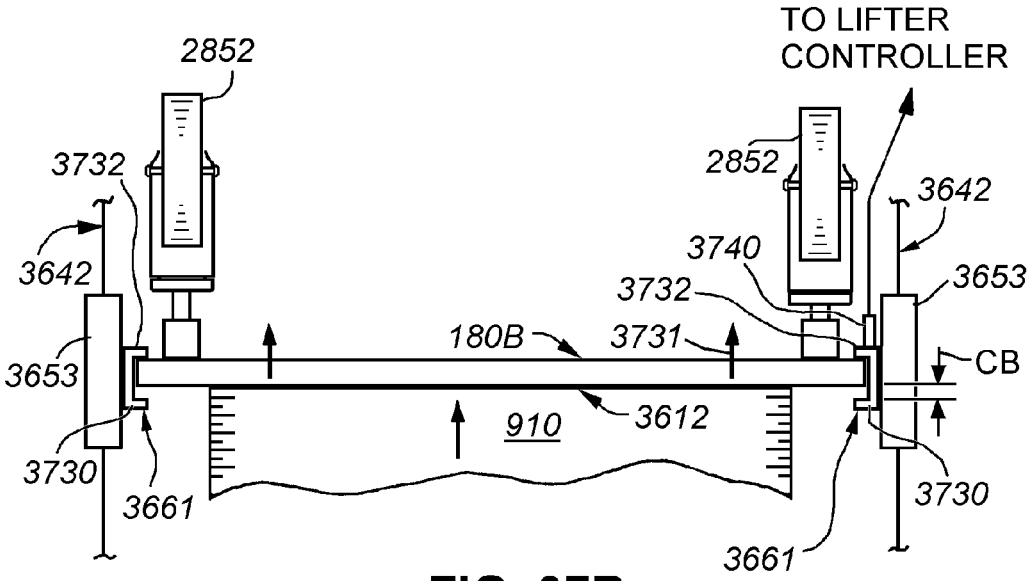
FIG. 37B is a fragmentary front view of the upper cart support assembly for the inverting device of FIG. 36 showing the position of the cart within the supporting brackets after stack compression.
Figure 37:
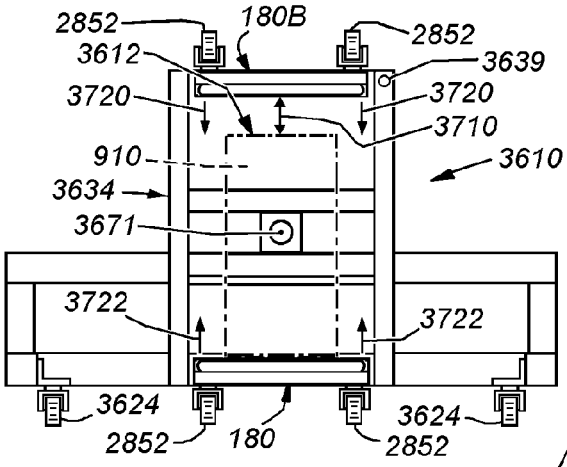
FIG. 37 is a simplified front view of the inverting device of FIG. 36 showing the placement of a cart with a full stack thereinto.

Once the cart 180 is loaded in the framework 3634, the stack inversion procedure occurs in accordance with FIGS. 37-40. In FIG. 37, the upper cart 180B on brackets 3661 is located at a vertical clearance 3710 above the loaded cart 180 and stack 910 (shown in phantom at full height). The operator caused the lifter to bring the carts 180, 180B toward each other (arrows 3720, 3722) until the upper cart 180B contacts the top surface 3612 of the stack 910. The movement of the carts toward each other can be limited based upon contact with the stack 910 by a conventional sensor (including, for example, and optical sensor or pressure sensor that ensures a maximum predetermined amount of pressure is applied to the top 3612 of the stack 910. FIGS. 37A and 37B detail an arrangement for the upper brackets 3661 in which the channels have additional clearance CB in excess of the thickness TC of the cart side (which is engaged by the brackets 3661). When the upper cart 180B is uncontacted (FIG. 37A), the cart sides rest against respective bottom plates 3730 of the brackets 3661 due to gravity. However, as shown in FIG. 37A, when the stack becomes compressed, the upper cart 180B moves (arrows 3731) into contact with the upper plate 3732 of the respective bracket 3661. At this time a contact or sensor 3740 residing at the upper plate 3732 is triggered, causing the lifter motor to cease upward movement. Appropriate adjustments to the timing of motor movement can be made to provide the required pressure to the stack. Compression should be sufficient to contain the stack, but avoid damaging it. The sensor can comprise a pressure sensor in various embodiments or a simple switch with a slight stop delay applied to the motor to ensure appropriate compression (e.g. causing the motor to apply a few extra steps after a stop signal).

Figure 38:
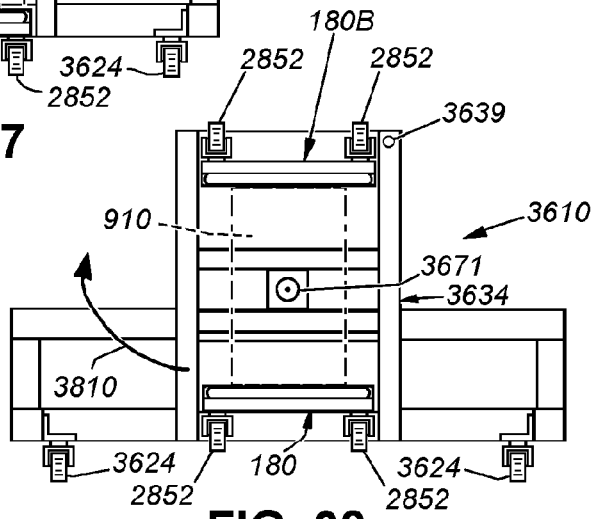
FIG. 38 is a simplified front view of the inverting device of FIG. 36 showing the movement of the hold-down support onto the top of the full cart.
Figure 39:
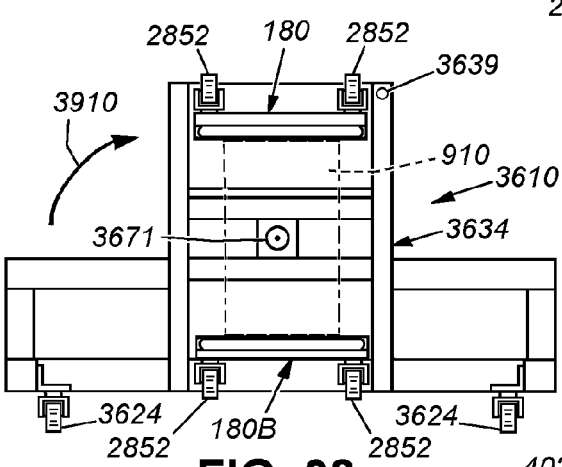
FIG. 39 is a simplified front view of the inverting device of FIG. 36 showing the rotational inversion of the stack and cart.

As shown in FIG. 38, once the stack 910 is vertically compressed and contained by the carts 180, 180B, the operator rotates the framework 3634 (curved arrow 3810, and 3910 in FIG. 39) about the pivot axis 3671 to flip the framework 3634 with carts 180. 180B and stack 910 into an inverted orientation. The wheels of the lower cart 180 are lifted sufficiently off the floor to avoid interference as the framework is rotated. Since the stack 910 is generally centered relative to the pivot axis 3671, the rotation of the framework 3634 is relatively balanced and minimal force is required. The pressure applied by the lifter is sufficient to maintain the stack in a firmly packed column, without appreciable skew as the framework rotates through a full 180 degrees to the inverted orientation as shown in FIG. 39. Note that various sensors, physical stops or constraints can be used to control the limits of rotational movement to prevent rotation of the framework beyond 180 degrees.

When inverted, the cart 180 resides at the top of the framework 3634 with wheels 2852 (and 2850) facing skyward. The stack 910 is now supported against gravity by the (formerly) upper cart 180B. The inverted stack 910 is now ready for transfer to a second waiting cart.

Figure 40:
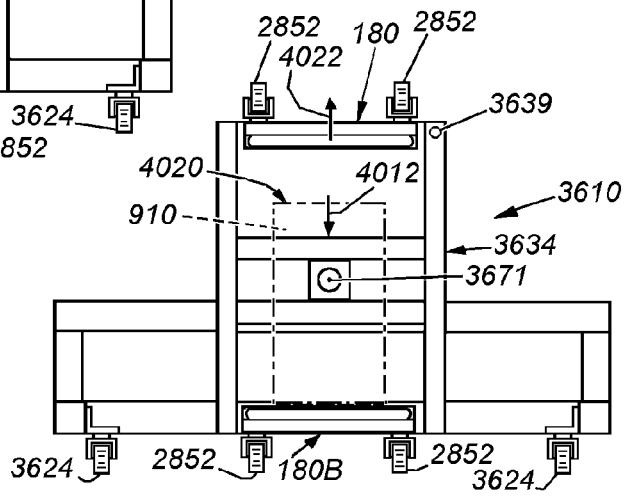
FIG. 40 is a simplified front view of the inverting device of FIG. 36 showing the placement of an empty cart into the device and movement of the inverted stack downwardly thereonto.

As now shown in FIG. 40, the inverted stack 910 is decompressed as the lifter moves the cart 180B and stack 910 downwardly (arrow 4012). This moves the new stack top 4020 out of engagement with the inverted cart 180 (arrow 4020). The now empty (formerly) lower cart 180 is moved upwardly (arrow 4022) away from the stack 910 by the lifter, and now resides at the top of the framework 3634. Once the wheels of the cart 180B with the inverted stack contact the floor, the cart 180 can be withdrawn from the brackets 3661, and moved to a remote location. Due to the relative symmetry of the inverter framework 3634, the cart 180 can remain in this position after the cart 180B and inverted stack are withdrawn. The next cart can be driven into the brackets 3661 at this time and the inversion of a new stack can occur. Either rotating the inverter counter clockwise, opposite the direction shown above, or continuing the depicted clockwise rotation—when no fixed rotational stop is provided.

G. An Interconnected Stack Transport System

Figure 41:
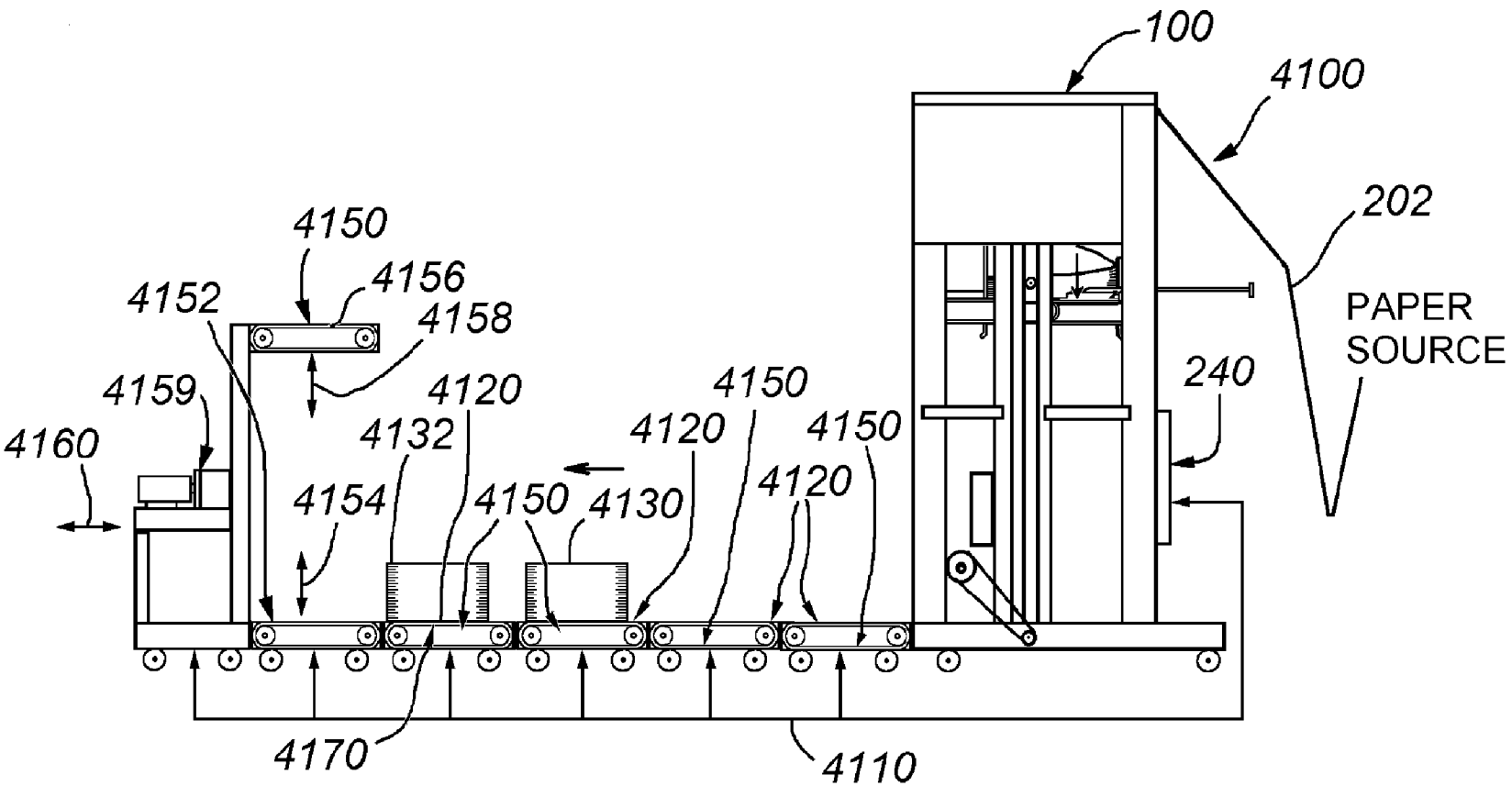
FIG. 41 is a side view of an implementation of the device of FIG. 1 in conjunction with a joined train of carts and an inverting device in accordance with an embodiment of the invention.

It is contemplated that the device, carts and other stack handling units described herein can be combined into a continuous unit that allows for handling and transport of stacks over a distance with minimal relocation of carts or other units. FIG. 41 details an integrated system 4100 in accordance with an embodiment of this invention the device 100 receives continuous web 202 from a source, and separates folds and stacks the web as also described above. The controller 240 is adapted to control other downstream devices via a communication link 4110. These devices can include one or more permanently (or semi-permanently) attached transport carts 4120 that are positioned to remove complete stacks (exemplary stacks 4130 and 4132) from the device 100, and transfer them to a remote location for further handling. To facilitate transfer, each cart 4120 is provided with an integral, or separately attached belt transport system 4150. The carts can be coupled together by any appropriate linking or locking mechanism. In general, a variety of wheel brakes, interconnections and cart-to-cart locking mechanisms (not shown) can be employed to hold the depicted chain together.

In this embodiment, each transport system 4150 is controlled by the controller. Appropriate sensors can be embedded in each system 4150 to detect the presence and location of a stack. In alternate embodiments, the systems 4150 can be adapted to transfer stacks automatically therealong, based upon the arrival of stacks from an upstream location. In one embodiment, the system 4100 can be used to fill a train of carts as shown. These carts can be subsequently decoupled and wheeled to a remote location for further processing. In this manner, a number of stacks can be filled without the need to constantly dock and undock a single cart from the device. In this example, three or four carts can be filled before operator service is required. In practice, the train of powered carts can be made long enough to receive an entire output of stacks from a given production run. Alternatively, carts at some location along the train can be removed and replaced with empty carts to receive the downstream-most stack(s) in the output stream.

In another embodiment, the carts can act as a modular conveyor to another downstream utilization device. In this illustrated example, the downstream device is a version 4150 of the above-described portable stack inverter (3610 in FIG. 36). The inverter can be selectively wheeled into place, or removed from the train as desired (double arrow 4160). This allows the inverter 4150 to receive stacks from the downstream-most cart (4170) in the train, and be wheeled around thereafter to deposit an inverted stack at another location. The framework includes a vertically moving belt assembly 4152 that receives stacks, supporting their bottoms, and elevates them (double arrow 4154). A second overlying belt assembly 4156 moves downwardly (double arrow 4158) to meet the top of each stack. The inverter 4150 rotates on a pivot assembly 4159 to thereby support the stack on the upper belt assembly 4156. The upper assembly subsequently lowers to deliver the inverted stack to a waiting cart or other utilization device after decoupling from the train. Note that the carts contemplated herein may also be adapted to allow transfer of stacks thereon to a dolly to further ease movement of stacks to remote locations. A dolly with tines that pass between ribs may be particularly suited to pass beneath and thereafter pivotally raise a stack on a cart. Note also, it is contemplated that the inverter can be adapted to receive stacks directly from the device supporting mechanism 450 through use of appropriate receiving conveyers aligned with the supporting mechanism. The inverter can be selectively wheeled into and out of a docked engagement for this purpose.

H. Optional Outfeed Roller System for Use with Conventional Carts

Figure 42:
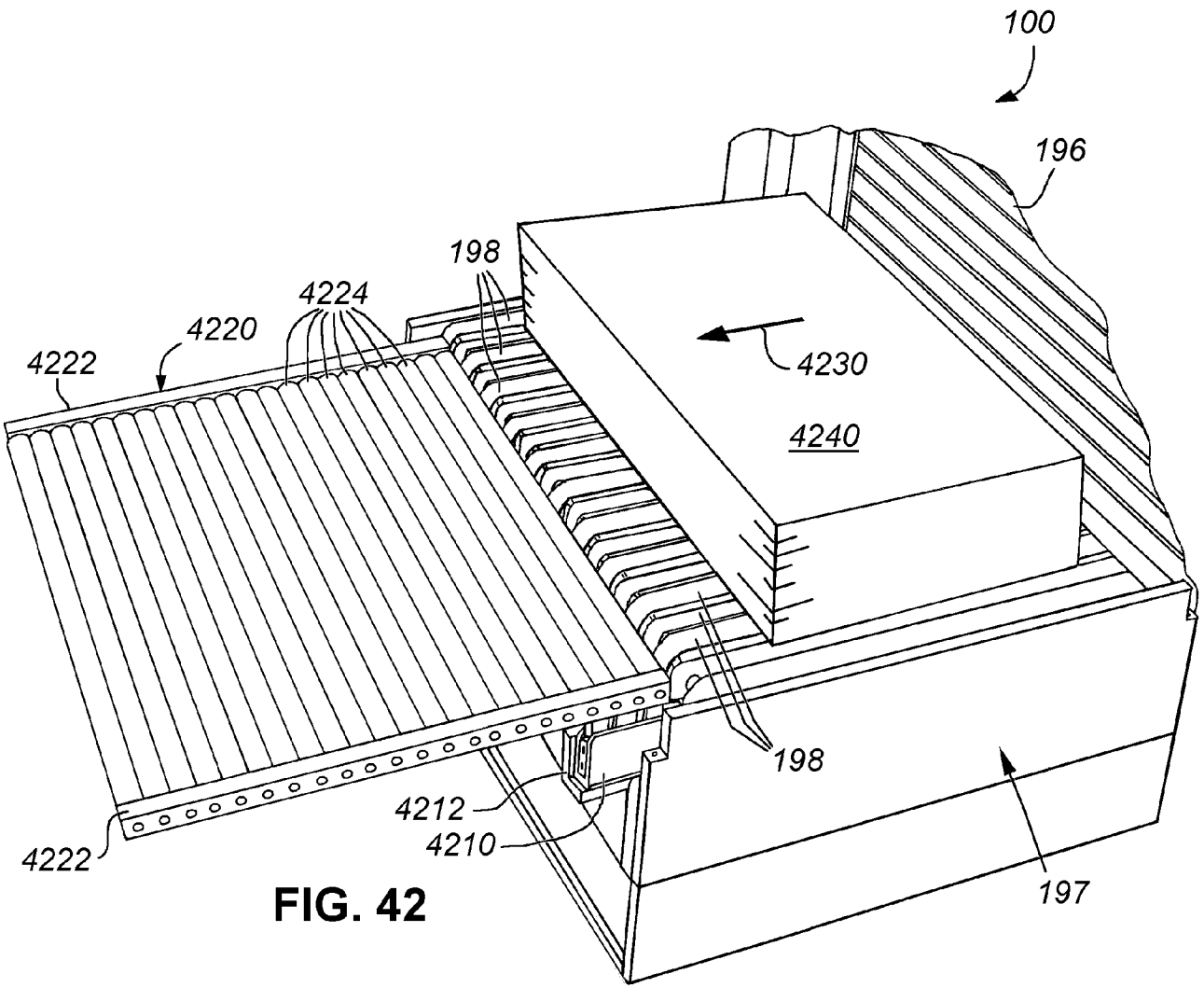
FIG. 42 is a fragmentary perspective view of the stack conveyor system for the device of FIG. 1 including an optional outfeed roller unit for use with conventional carts and dollies showing an exemplary stack ready to be moved onto the outfeed roller unit.
Figure 43:
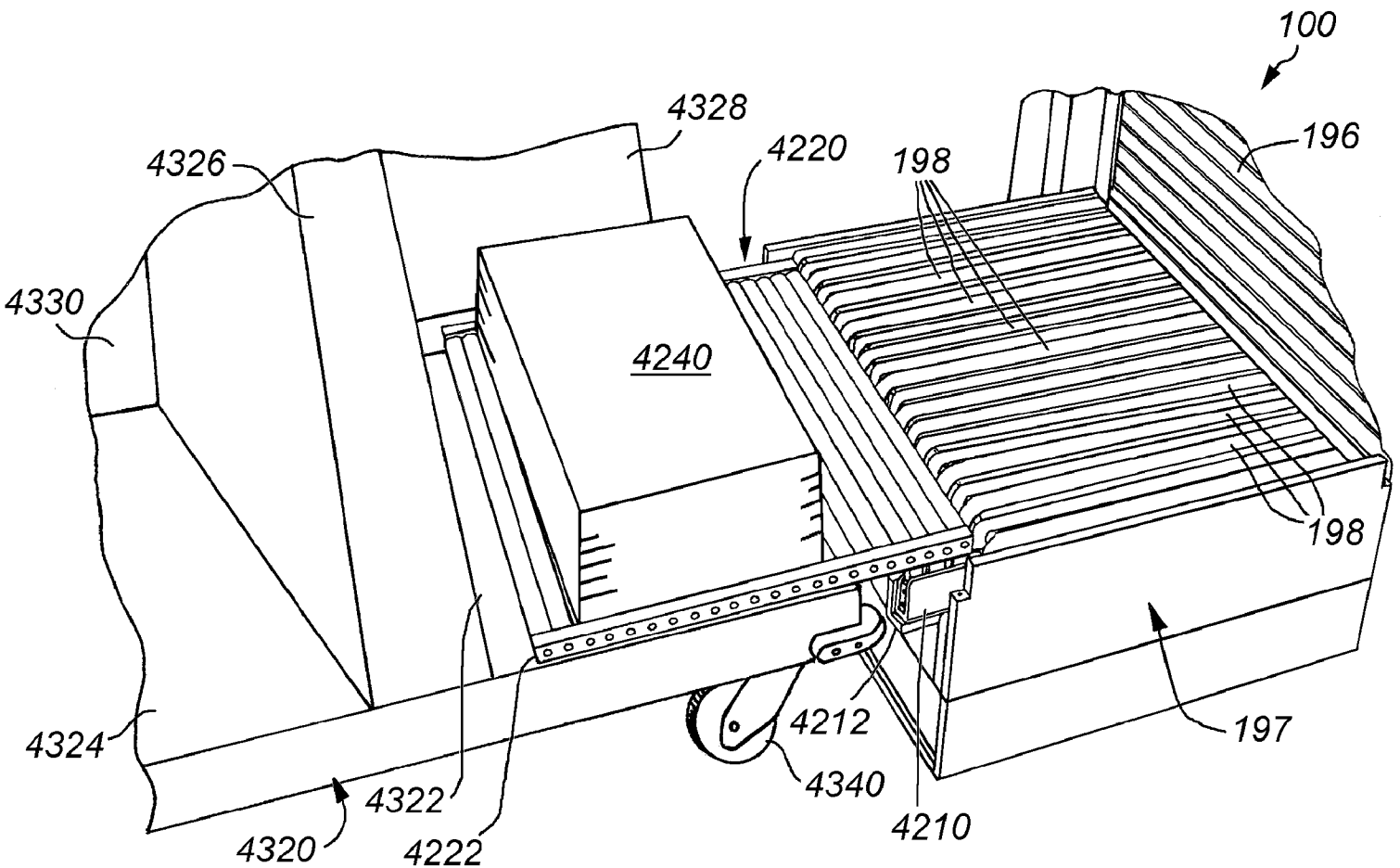
FIG. 43 is a fragmentary perspective view of the stack conveyor system and optional outfeed roller unit of FIG. 42 showing the exemplary stack moved onto the outfeed roller unit and a conventional cart positioned to receive the stack.

The above description of the device generally references a slatted cart 180 that is adapted to dock with the device conveyor system 197. The slats are arranged to pass between conveyor belts employed by the system 197 to extract stacks from the device's moving stack supporting mechanism 450. In some implementations, a user may desire to employ a more conventional cart or dolly to transport stacks that is not designed to interface with the conveyor system. As shown in FIG. 42, the front housing of the conveyor system 197 is removable to expose a pair of side beams 4210. The side beams 4210 allow brackets 4212 of a special outfeed attachment 4120 to be secured thereto. The attachment defines a pair of side frames that enclose a set of rollers 4224. The frame and rollers cover a sufficient area to support the largest expected stack footprint. The number of rollers is highly variable. In this embodiment, 20-22 closely spaced rollers are employed with a diameter of between ½ and 1 inch. The rollers are mounted at a level approximately in line with the belts 198 of the conveyor system 197. The belts thereby direct (arrow 4230) the exemplary stack 4240 as shown in FIG. 43. The outfeed unit is sufficiently thin (approximately 1-2 inches in thickness vertically) to enable the carrying surface of a conventional cart or dolly to pass beneath it. In FIG. 43 the cart 4320 is a commercially available four quadrant cart with separate carrying surfaces 4322, 4324 that are divided by tapered upstanding walls 4326, 4328 and 4330. The cart rolls on caster wheels 4340. In this example the user has rolled the carrying surface 4322 beneath the outfeed unit 4220.

Figure 44:
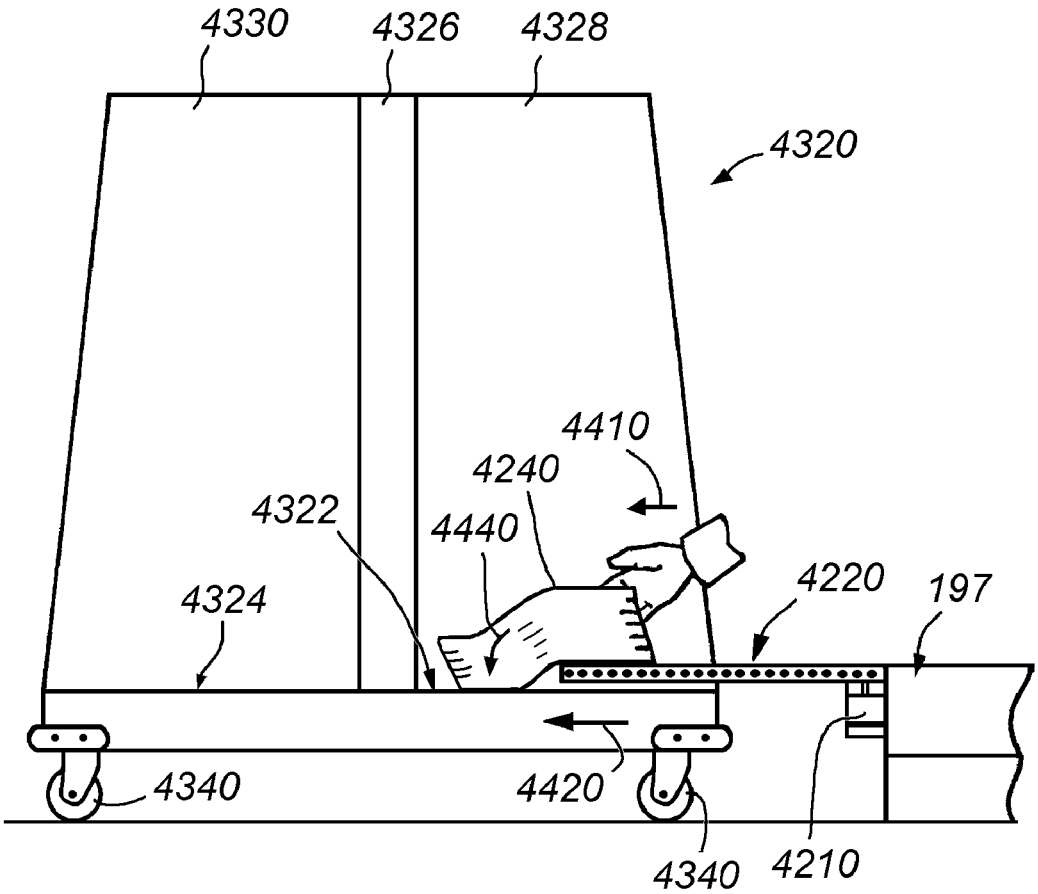
FIG. 44 is a fragmentary side view of the stack conveyor system and optional outfeed roller unit of FIG. 42 showing the exemplary stack being biased off of the outfeed roller unit and onto the conventional cart.

As shown in FIG. 44, once the user has positioned the cart 4320, he or she can manually bias (arrow 4410) the stack 4322 as shown while simultaneously withdrawing (arrow 4420) the cart 4320 in a like direction. The large number of rollers significantly reduces friction and allows even heavy stacks to move with relative ease. Bearings or other friction reducing elements can also be applied between the rollers and frame members 4222. In an alternate embodiment, a powered roller set can be employed or belts (powered or unpowered) can be employed. The stack 4240 drops (arrow 4440) onto the cart carrying surface 4322 as shown. So long as the stack bottom is not excessively high above the carrying surface 4322, the stack should drop easily on to the surface without causing the stack to collapse. The surface is often tapered inwardly so that the stack rests against an upwardly tapered wall and is less likely to topple.

Figure 45:
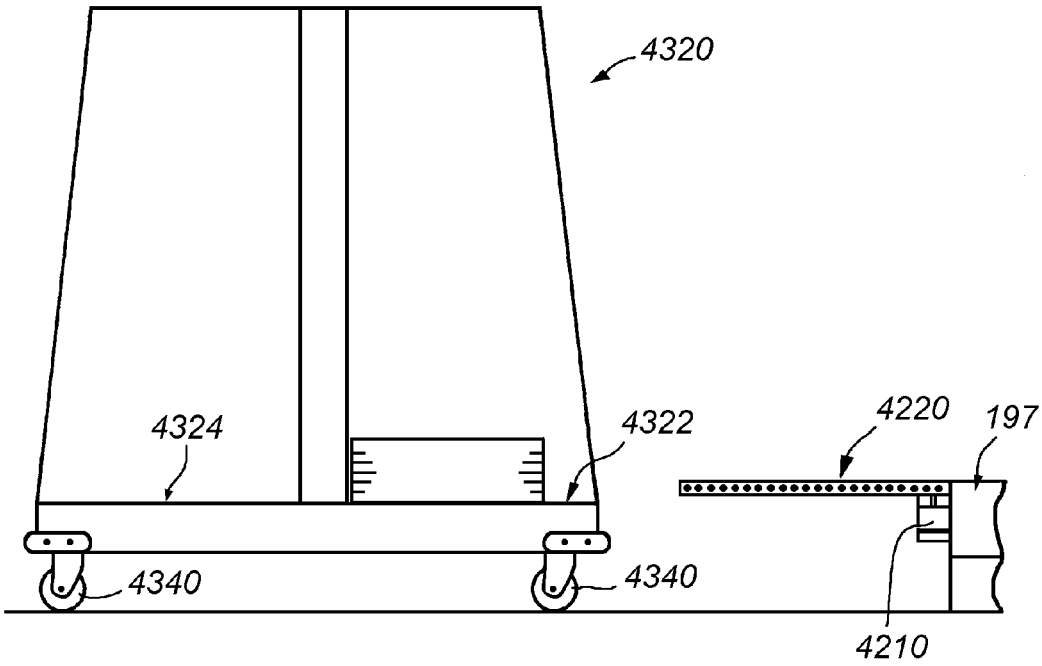
FIG. 45 is a fragmentary side view of the stack conveyor system and optional outfeed roller unit of FIG. 42 showing the exemplary stack after being fully biased off of the outfeed roller unit and onto the conventional cart with the cart now remote from the outfeed unit.

Once the cart is fully withdrawn, the biased stack now rests on the cart 4320 as shown in FIG. 45. The adjacent quadrants of the cart can be loaded with additional stacks and/or the cart and stack(s) can be moved to a remote location for further processing.

The foregoing has been a detailed description of illustrative embodiments of this invention. Various modifications and additions can be made without departing from the spirit and scope thereof. For example, the sensors and motors used herein are exemplary and a variety of techniques for driving and controlling the start, stop and limits of movement are expressly contemplated. The sizes for stacks (height, length and width) are exemplary, and the device and other system components herein can be scaled appropriately to accommodate differing size ranges. In addition, while a linear output train is shown for the system, use of curved conveyors and/or sloped conveyor surfaces are expressly contemplated. Also, as noted generally above, carts herein can include integral conveyors or other rolling surfaces for moving stacks thereonto, including passive (or freewheeling) rollers/belts or rollers/belts that are driven by a power transmission or takeoff from an upstream, docked unit. It is also expressly contemplated that the controller and/or other control units employed herein can perform their functions based upon electronic hardware, software comprising a computer-readable medium including program instructions or a combination of hardware and software. Accordingly, this description is meant to be taken by way of example, and not to otherwise limit the scope of this invention.

What is claimed is:

1. An apparatus for folding and stacking a continuous web comprising:

a folding and stacking mechanism that outputs folded continuous web defining a plurality of zigzag folded pages to a folding area;

a compression plate assembly that projects into a portion of the folding area at predetermined times to interfere with movement of edges of the folded pages past the compression plate assembly;

a supporting mechanism that moves cyclically away from the compression plate assembly and toward the compression plate assembly to cause the edges of the folded pages in a stack supported between the compression plate assembly and the supporting mechanism to pressurably engage and be compressed by the compression plate assembly;

a plurality of stack guides that engage the edges of the folded pages in the stack when the supporting mechanism moves toward the compression plate assembly so as to align the folded edges, the stack guides passing through the supporting mechanism when the supporting mechanism is within a predetermined distance from the compression plate assembly; and a temporary support assembly that extends into the folding area when the continuous web is separated so as to support the folded pages of a leading end of the separated web while the folded pages of the trailing end of the separated web are directed away by the supporting mechanism in the stack to a stack transfer location.

2. The apparatus as set forth in claim 1 further comprising an infeed ramp that directs the continuous web to a location over the director chute, the location being sufficient in height above a base of the apparatus so that the stack of the folded pages has a height of at least 3 feet.

3. The apparatus as set forth in claim 1 wherein the supporting mechanism comprises a conveyor belt assembly that directs the stack out of a frame of the apparatus when the conveyor belt assembly is located at the stack transfer location, the stack guides constructed and arranged to pass between discrete belts of the conveyer belt assembly.

4. The apparatus as set forth in claim 3 further comprising a docking area at the stack transfer location for a downstream stack-handling support surface that receives the stack from the supporting mechanism.

5. The apparatus as set forth in claim 4 wherein the docking area includes a stack-handling conveyor belt assembly that selectively moves into and out of the path of travel of the stack so as to selectively assist the stack in moving downstream onto the stack-handling support surface from the supporting mechanism.

6. The apparatus as set forth in claim 5 wherein the stack-handling support surface comprises a wheeled cart and the stack-handling conveyor belt assembly is constructed and arranged to move from a lowered position wherein the wheeled cart can move thereover to be positioned adjacent to the supporting mechanism and a raised position wherein belts of the stack-handling conveyor belt assembly reside between each of a plurality of ribs of the wheeled cart that receive the stack thereon.

7. The apparatus as set forth in claim 1 wherein the folding and stacking mechanism comprises a reciprocating swinging director chute, a plurality of beater assemblies and a plurality of spiral assemblies and wherein the swinging director chute is interconnected with a lever arm, the lever arm being interconnected to a connecting rod having a first pivot end and a second pivot end, the first pivot end being adjustably movable along the lever arm to set a swing arc and the second pivot end being connected to a drive arm, the drive arm being connected to a central drive that is operatively connected to the beaters and the spirals, the drive arm including a lead screw that is connected to, and rotates to radially adjust a position of the second pivot, the lead screw being operatively connected to an index wheel, the index wheel having a plurality of radially directed posts, and a movable pawl that advances the index wheel when moved to an engaging position with the posts each time the drive arm rotates past the pawl.

8. The apparatus as set forth in claim 1 further comprising a wheeled stack inverter that receives the stack from a wheeled cart, adapted to receive the stack from the supporting mechanism, the inverter including a framework that receives the wheeled cart therein and an overlying, movable belt assembly that selectively engages a top of the stack, opposite the wheeled cart, the framework being attached to an inverter base through a pivot assembly, the framework and the pivot assembly being constructed and arranged to invert the stack with the cart received in the framework and the belt assembly being engaged to the top of the stack.

9. A system for creating and handling stacks of continuous zigzag folded web comprising:

a continuous web source that directs continuous web to an infeed location;

a folding and stacking mechanism that folds the continuous web into zigzag folded pages and directs the zigzag folded pages to a folding area;

a supporting mechanism that cyclically moves away from the folding area to draw folded pages through the folding area and onto a stack and that moves toward the folding area to compress the stack;

a continuous web cutter that separates the continuous web into a leading end and a trailing end;

a temporary support that allows the leading end to rest thereon as upstream folded pages are formed by the folding and stacking mechanism while the trailing end is drawn away on the stack to a stack transfer location by the supporting mechanism;

a plurality of stack guides that engage the edges of the folded pages in the stack when the supporting mechanism moves toward the compression plate assembly so as to align the folded edges, the stack guides passing through the supporting mechanism when the supporting mechanism is within a predetermined distance from the compression plate assembly; and a downstream stack-handling support surface that receives the stack from the supporting mechanism.

10. The system as set forth in claim 9 wherein the supporting mechanism comprises a conveyor located on a vertical lifter assembly within a framework.

11. The system as set forth in claim 10 wherein the temporary support comprises a plurality of rods that move between an extended position that interferes with passage of folded pages through the folding area and a retracted position remote from interference with the folding area.

12. The system as set forth in claim 9 wherein the stack guides include a plurality of front stack guides, rear stack guides and side stack guides that are located around a perimeter dimension of the folded pages.

13. The system as set forth in claim 12 further comprising compression plates that each include a retractable finger assembly, each finger assembly moving selectively between a retracted position that is free of interference with edges of the folded pages and an extended position that engages and interferes with the edges.

14. The system as set forth in claim 9 wherein the supporting mechanism comprises a conveyor located on a vertical lifter assembly within a framework and wherein the compression plates are each mounted on a shaft assembly that is spring-loaded with respect to a frame of the apparatus so as to apply movable pressure in response to engagement by edges of the folded pages, and further comprising a sensor operatively connected with at least one of the compression plates so that a limit of movement of the vertical lifter assembly toward the folding area is controlled in response to the sensor.

15. The apparatus as set forth in claim 14 wherein the temporary support is mounted on one of the compression plates and wherein the shaft assembly is slidably mounted with respect to the frame and further comprising a motor assembly that moves the shaft assembly interconnected with the one of the compression plates upon which the temporary support assembly is mounted away from the folding and stacking mechanism at a predetermined rate when the temporary support is extended.

16. The system as set forth in claim 15 wherein the shaft assembly is operatively interconnected with the supporting mechanism so that presumably movement of the shaft assembly causes the supporting mechanism to reverse cyclical movement toward the compression plates and thereby move away from the compression plates for a predetermined distance.

17. The system as set forth in claim 9 wherein the frame includes an adjustment mechanism constructed and arranged so that a spacing between the front stack guides and the rear stack guides can be changed and a distance between the compression plates can be changed.

18. The system as set forth in claim 9 wherein the folding and stacking mechanism comprises a reciprocating swinging chute, a plurality of beater assemblies and a plurality of spiral assemblies.

19. The system as set forth in claim 18 wherein each of the plurality of spiral assemblies are mounted on the frame so as to be adjustable by the adjustment mechanism.

20. The system as set forth in claim 19 further comprising an infeed ramp that directs the continuous web to a location over the chute, the location being sufficient in height above a base of the apparatus so that the stack of the folded pages has a height of at least 3 feet.

21. The system as set forth in claim 9 wherein the supporting mechanism comprises a conveyor having a plurality of discrete belts that directs the stack out of a frame of the apparatus when the conveyor is located at the stack transfer location, the stack guides constructed and arranged to pass between the discrete belts.

22. The system as set forth in claim 21 further comprising a docking area at the stack transfer location for receiving the stack-handling supporting surface so that the stack-handling support surface can receive the stack from the supporting mechanism.

23. The system as set forth in claim 22 further comprising a removably attachable outfeed unit having a plurality of rollers in a frame constructed and arranged to receive the stack from the transport conveyor and to admit an underlying cart, the rollers being further constructed and arranged to allow the stack to be biased onto the cart as the cart is withdrawn while the stack is biased onto the cart.

24. The system as set forth in claim 9 wherein the supporting mechanism comprises a conveyor belt assembly that directs the stack out of a frame of the apparatus when the conveyor is located at the stack transfer location.

25. The system set forth in claim 9 wherein the folding and stacking mechanism comprises a reciprocating swinging director chute, a plurality of beater assemblies and a plurality of spiral assemblies and wherein the swinging director chute is interconnected with a lever arm, the lever arm being interconnected to a connecting rod having a first pivot end and a second pivot end, the first pivot end being adjustably movable along the lever arm to set a swing arc and the second pivot end being connected to a drive arm, the drive arm being connected to a central drive that is operatively connected to the beaters and the spirals, the drive arm including a lead screw that is connected to, and rotates to radially adjust a position of the second pivot, the lead screw being operatively connected to an index wheel, the index wheel having a plurality of radially directed posts, and a movable pawl that advances the index wheel when moved to an engaging position with the posts each time the drive arm rotates past the pawl.

26. The apparatus as set forth in claim 9 further comprising a plurality of perforator units located upstream of the folding and stacking members, the perforator units forming perforations along opposing widthwise edges of the web.

* * * * *